US010487531B2

(12) United States Patent
Volin

(10) Patent No.: US 10,487,531 B2
(45) Date of Patent: Nov. 26, 2019

(54) ADJUSTABLE-CANOPIES ADJUSTABLE-AWNING CENTRAL-LOCK POPUP

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 9 days.

(21) Appl. No.: 15/939,299

(22) Filed: Mar. 29, 2018

(65) Prior Publication Data

US 2019/0284831 A1 Sep. 19, 2019

Related U.S. Application Data

(60) Provisional application No. 62/644,948, filed on Mar. 19, 2018.

(51) Int. Cl.

| | |
|---|---|
| ***E04H 15/50*** | (2006.01) |
| ***E04H 15/46*** | (2006.01) |
| ***E04H 15/16*** | (2006.01) |
| ***E04H 15/54*** | (2006.01) |
| ***E04H 15/58*** | (2006.01) |
| *E04H 15/18* | (2006.01) |

(52) U.S. Cl.

CPC ..... *E04H 15/50* (2013.01); *E04H 15/16* (2013.01); *E04H 15/46* (2013.01); *E04H 15/54* (2013.01); *E04H 15/58* (2013.01); *E04H 15/18* (2013.01)

(58) Field of Classification Search

CPC ..... E04H 15/50; E04H 15/16; E04H 15/18; E04H 15/54; E04H 15/34; E04H 15/46

See application file for complete search history.

(56) References Cited

U.S. PATENT DOCUMENTS

| | | | | |
|---|---|---|---|---|
| 2,151,908 A | | 3/1939 | Gottlieb | |
| 2,265,479 A | | 12/1941 | Goodman | |
| 2,799,286 A | * | 7/1957 | Nordmeyer | E04H 15/06 135/118 |

(Continued)

FOREIGN PATENT DOCUMENTS

| | | | | |
|---|---|---|---|---|
| CA | 2843289 A1 | * | 9/2014 | |
| CH | 675446 A5 | * | 9/1990 | E04H 15/50 |
| WO | WO-2013116545 A1 | * | 8/2013 | E04H 15/50 |

*Primary Examiner* — David R Dunn
*Assistant Examiner* — Danielle Jackson

(57) ABSTRACT

An adjustable-canopy adjustable-awning central-lock popup comprises: an adjustable ring canopy, an adjustable central canopy, an adjustable surrounding awning, a central intersector, foldable top trusses bolted to the central intersector, corner and side trusses, four upper posts, four upper corner intersectors bolted to the corner and side trusses, four lower corner intersectors slid on the four upper posts and bolted to the corner trusses, post-centering clamps and tick-preventing teeth and water-discharging grooves molded to the four sleeves, four lower posts inserted inside the four upper posts, a central square post attached to the central intersector, central-locking double nipples attached to the central square post, a central-locking adjustable ring adjustably and slidably locked by the central-locking double nipples on the central square post at multiple different positions for locking the adjustable ring canopy and the adjustable central canopy and the adjustable awning at multiple different positions, and four pulley-wheels attached to the bottom ends of the four lower posts, respectively.

20 Claims, 47 Drawing Sheets

(56) References Cited

U.S. PATENT DOCUMENTS

| | | | | |
|---|---|---|---|---|
| 3,085,586 | A | 4/1963 | McDonough | |
| 3,199,518 | A | 8/1965 | Glidewell | |
| 4,779,635 | A | 10/1988 | Lynch | |
| 4,885,891 | A | 12/1989 | Lynch | |
| 5,035,253 | A | 7/1991 | Bortles | |
| 5,244,001 | A | 9/1993 | Lynch | |
| 5,511,572 | A | 4/1996 | Carter | |
| 5,638,853 | A | 6/1997 | Tsai | |
| 6,141,934 | A | 11/2000 | Zeigler | |
| 6,283,136 | B1 | 9/2001 | Chen | |
| 7,178,542 | B2 | 2/2007 | Carter | |
| 7,836,907 | B2 | 11/2010 | Carter | |
| D670,003 | S | 10/2012 | Lovley, II | |
| 8,418,711 | B2 | 4/2013 | Park | |
| 8,544,489 | B2 * | 10/2013 | Choi | E04H 15/50 135/140 |
| 8,776,815 | B2 | 7/2014 | Park | |
| 9,528,292 | B1 | 12/2016 | Lovley, II | |
| 9,556,639 | B2 | 1/2017 | Hunt | |
| D785,201 | S | 4/2017 | Hassman | |
| 9,683,387 | B2 | 6/2017 | Lovley, II | |
| 2003/0029490 | A1 * | 2/2003 | Price | E04H 15/50 135/131 |
| 2006/0062632 | A1 * | 3/2006 | Jang | E04H 15/46 403/109.6 |
| 2006/0266401 | A1 | 11/2006 | Wu | |
| 2011/0308559 | A1 | 12/2011 | Ma | |
| 2014/0030012 | A1 * | 1/2014 | Lee | F16B 7/105 403/326 |
| 2014/0130837 | A1 * | 5/2014 | Sy-Facunda | E04H 15/50 135/120.3 |
| 2015/0144170 | A1 * | 5/2015 | Hunt | E04H 15/34 135/151 |
| 2018/0371786 | A1 * | 12/2018 | Pan | E04H 15/64 |

* cited by examiner

ADJUSTABLE-CANOPIES ADJUSTABLE-AWNING CENTRAL-LOCK POPUP

REFERENCE TO PREVIOUSLY FILED PROVISIONAL PATENT APPLICATION

Provisional Patent Application No. 62/630,242 was filed on 2018 Feb. 13.

Provisional Patent Application No. 62/644,948 was filed on 2018 Mar. 19.

FIELD OF THE INVENTION

The present invention relates to a collapsible popup, which is cheap to produce, is easy to ship as one unit, requires no assembly, and can be quickly and easily be unfolded. Particularly, the present invention relates to an adjustable-central-canopy adjustable-ring-canopy adjustable-surrounding-awning single-central-innersurface-square-lock popup, comprises:

1) Post-centering tick-preventing water-discharging wind-and-smoke-redirecting adjustable-ring-canopy system,
2) Central-innersurface-locking wind-and-smoke-redirecting adjustable-central-canopy system,
3) Wind-and-smoke-redirecting adjustable-surrounding-awning system, and
4) Multi-function hook-rope-stake-pulley-wheel system.

DESCRIPTION OF THE PRIOR ART

A number of collapsible popups have been introduced.

U.S. Pat. No. 2,151,908, issued 1939 Mar. 28, to Max E. Gottlieb, relates to chapel tents and particularly to the collapsible of folding type which is used at cemeteries during funeral services. An object of this invention is to provide a shelter tent suitable for the purposes mentioned which will fold up compactly to as to be easily transported and yet be sturdy enough to withstand all sorts of inclement weather without the aid of auxiliary and troublesome anchors.

U.S. Pat. No. 2,265,479, issued 1941, Dec. 9, to Dwight Goodman, relates primarily to chapel tents, but is also obviously useful in temporary shelters for concessions, and as a display tent or the like. An object of the invention resides in the provision of a tent frame which may be readily folded in a compact manner for transportation, and yet which is sufficiently strong to remain in set-up condition despite all sorts of inclement weather.

U.S. Pat. No. 3,085,586, issued 1963 Apr. 16, to Elon D. McDonough, refers to a portable structure of the type employing a foldable frame and a flexible covering for the frame. An object of this invention is to provide a foldable structure which is adapted to form an enclosure for large areas, which structure is of economical and light weight construction and which can be readily collapsed and disassembled for compact storage and transportation.

U.S. Pat. No. 3,199,518, issued 1965 Aug. 10, to Herman A. Glidewell, describes a collapsible and foldable frame which may be employed as a shelter when suitable covering material is placed thereover. The device is primarily intended as a collapsible frame over which camouflage material can be placed to provide a hunting blind, but could, of course, be employed as a frame over which any desired covering material (such as tarpaulin) could be placed to provide protection against the weather.

U.S. Pat. No. 4,779,635, issued 1988 Oct. 25, to James P. Lynch, demonstrates a canopy structure which is provided and includes a framework unit and a flexible covering. The framework unit is formed by a plurality of upright corner members and a plurality of roof support members that are pivotally connected at the top ends of the corner members and, in an erected position, extend upwardly and inwardly to a central apex where they are pivotally connected to one another.

U.S. Pat. No. 4,885,891, issued 1989 Dec. 12, to James P. Lynch, relates to an extendible scissors truss such as may be utilized in a collapsible canopy structure wherein the extendible scissors truss has members pivotally connected to form truss cells. The reinforcement member has first and second end portions joined by a linking portion to form a Z-like configuration.

U.S. Pat. No. 5,035,253, issued 1991 Jul. 30, to Allan D. Bortles, demonstrates a rain runoff awning for collecting runoff from a tent canopy. Fabric is stretched between and secured to outwardly extending arms which are attached to the canopy frame. The fabric forms a gutter or trough along an edge of the canopy for receiving runoff from the canopy and directing the runoff away from entrance and exit areas of the canopy.

U.S. Pat. No. 5,244,001, issued 1993 Sep. 14, to James P. Lynch, describes an expandable framework structure which can be folded for storage and expanded for use, especially as a canopy when a covering is placed on top of the framework. The framework includes a plurality of upright supports and a plurality of edge scissor assemblies that interconnect adjacent ones of the upright supports.

U.S. Pat. No. 5,511,572, issued 1996 Apr. 30, to Mark C. Carter, describes a collapsible shelter which includes a truss and canopy framework that permits a flexible, collapsible canopy to be moved between a raised position and a lowered position. The collapsible shelter includes at least three legs supporting flexible poles removably mounted to the tops of the legs and forming the framework of the canopy. X-shaped truss pairs of link members are connected to each of the legs on each side of the shelter between adjacent legs.

U.S. Pat. No. 5,638,853, issued 1997 Jun. 17, to Tony M. L. Tsai, demonstrates a tent structure which includes four poles interconnected by four scissors-type linkages forming a square structure and four intermediate pivot connecting members. Each pole comprises a fixed connector and a sliding connector.

U.S. Pat. No. 6,141,934, issued 2000 Nov. 7, to Theodore R. Zeigler, depicts a folding frame system which includes a roof assembly including at least three pivotably attached strut pairs, adjacent pairs of the at least three pivotably attached strut pairs defining at least three corners of the roof assembly. The roof assembly is movable between a roof assembly closed position in which struts of the at least three strut pairs are disposed parallel to each other and a roof assembly open position in which struts of the at least three strut pairs are locked in non-parallel positions and ends of the struts of each strut pair of the at least three strut pairs define a rectangle.

U.S. Pat. No. 6,283,136, issued 2001 Sep. 4, to Fengchun Chen, refers to a collapsible tent which comprises top connecting means at the top of the tent; a plurality of upright legs; a slider slideably received on each upright leg; upper roof support bars pivotally connected to the top connecting means; lower roof support bars which each are connected at one end to its respective upper roof support bar and at the other end to a top of its respective upright leg.

U.S. Pat. No. 7,178,542, issued 2007 Feb. 20, to Mark C. Carter, demonstrates a lightweight erectable canopy shelters which include a plurality of legs connected together by an extendible perimeter assembly of link members. In one embodiment, the roof structure is formed by a pole members pivotally mounted to the upper ends of the legs so as to extend across the shelter, and movable between a lowered position and a raised, upwardly arching position.

U.S. Pat. No. 7,836,907, issued 2010 Nov. 23, to Mark C. Carter, refers to a quickly erectable dome shelter which includes an extendible perimeter truss assembly with link members connected between adjacent legs, a central truss assembly of link members, and a roof framework, including pairs of curved upper and lower peak truss members, that is movable between a lowered, collapsed configuration and a raised, upwardly arching position.

U.S. Pat. No. 8,418,711, issued 2013 Apr. 16, to Bumjun Park, demonstrates a collapsible canopy support which includes beams for supporting a canopy with each beam having a plurality of elongated beam segments coupled together to form the beam. A segment coupler provides for pivotally coupling a first beam segment to a second beam segment. A segment locking assembly is adapted for selectively securing the first beam segment relative to the second beam segment.

U.S. Pat. No. 8,776,815, issued 2014 Jul. 15, to Bumjun Park, relates to a collapsible shelter assembly which includes legs, a truss system, a cover, cover supporting rods and mounting brackets. Each of the legs has an upper and a lower end. The truss system is configured to link each pair of legs together and define a base perimeter.

U.S. Pat. No. 9,528,292, issued 2016 Dec. 27, to Jack B. Lovley, II, refers to a canopy which includes a frame assembly having a perimeter frame portion, a central frame portion and multiple legs. The frame assembly also includes one or more overhang frame portions, each of which can include a main overhang frame member and a strut. Each overhang frame portion can extend diagonally from the associated corner of the frame assembly.

U.S. Pat. No. 9,556,639, issued 2017 Jan. 31, to David Lewis Hunt, refers to a portable shelter framing system which is disclosed herein. The portable shelter framing system includes a plurality of corner support members; a plurality of crossbeam members, each of the crossbeam members configured to be connected between a pair of the plurality of corner support members without the use of tools.

U.S. Pat. No. 9,683,387, issued 2017 Jun. 20, to Jack B Lovley, II, relates to a canopy shelter link point for increased structural integrity particularly when subject to bending forces about the link point. The canopy shelter link point can include an increased overlap distance between two cross members, reduced spacing between adjacent cross members, and/or extension features located about an end of the cross members to reduce the misalignment angle between two cross members.

U.S. Pat. No. D670,003, issued 2012 Oct. 30, to Jack B Lovley, II, depicts an ornamental design for a canopy.

U.S. Pat. No. D785,201, issued 2017 Apr. 25, to Ellen Hassman, depicts an ornamental design for a gazebo canopy.

U.S. Publication No. 20060266401, published 2006 Nov. 30, to Weidan Wu, relates to a tarpaulin shelter with collapsible doorframes, including doorframes, the lower end of which is connected to the base and the upper end is connected with corner joint and cross beam, characterized in that the doorframe includes at least three upright poles, in which at least a set of x-scissor member are arranged between the middle upright pole and each side upright pole, said scissor is composed of two cross rods of which the middle portions are mutually hinged together.

U.S. Publication No. 20110308559, published 2011 Dec. 22, to Oliver Ma, relates to a shelter that includes a slider and a strut mechanism mounted on support posts of the shelter that automatically actuate and extend from the side of the support posts when the shelter is expanded from its collapsed state. The strut mechanism provides support for an eave that extends outside from all or a portion of the perimeter of the shelter defined by the corners of the support posts.

DISADVANTAGES OF THE PRIOR ART

The prior art have failed to solve many problems associated with collapsible popup, as follows:

1) No prior art mention or disclose any collapsible popup, having
   adjustable ring canopy 102,
   adjustable central canopy 124, and
   adjustable surrounding awning 135.
   Therefore, the prior art of collapsible popup:
   a) Can not provide shade to occupants,
      to prevent sunburn;
   b) Can not be adjusted up and down to increase airflow into and out of the adjustable-central-canopy adjustable-ring-canopy adjustable-surrounding awning single-central-innersurface-square-lock popup,
      to keep occupants cool;
   c) Can not help with airflow out of the adjustable-central-canopy adjustable-ring-canopy adjustable-surrounding awning single-central-innersurface-square-lock popup,
      to assist in smoke exiting the adjustable-central-canopy adjustable-ring-canopy adjustable-surrounding awning single-central-innersurface-square-lock popup; and
   d) Can not provide rain protection,
      to keep occupants dry.
2) No prior art mention or disclose any collapsible popup, having central-innersurface-locking adjustable ring 129.
   Therefore, the prior art of collapsible popup:
   a) Can not lock central square post 125 to the rest of the canopy structure,
      to increase overall strength of the adjustable-central-canopy adjustable-ring-canopy adjustable-surrounding awning single-central-innersurface-square-lock popup;
   b) Can not lock canopy together,
      to prevent the adjustable-central-canopy adjustable-ring-canopy adjustable-surrounding awning single-central-innersurface-square-lock popup from collapsing;
   c) Can not decrease the total number of locking points, to make setup easier; and
   d) Can not lock four post-height-adjusting nipples 120 and central square post 125 on the same plane as central-innersurface-locking adjustable ring 129 and two button tunnels 131,
      to prevent four post-height-adjusting nipples 120 from twisting and bending out of two button tunnels 131 when the wind tries to twist and bend the adjustable-central-canopy adjustable-ring-canopy adjustable-surrounding awning single-central-innersurface-square-lock popup.
3) No prior art mention or disclose any collapsible popup, having pulley-wheels 145.

Therefore, the prior art of collapsible popup:

a) Can not be used as pulleys to thread ropes 141, to tighten canopies;

b) Can not be used to roll the adjustable-central-canopy adjustable-ring-canopy adjustable-surrounding awning single-central-innersurface-square-lock popup along the ground when in collapsed configuration,
to make transportation easier;

c) Can not be used to assist in moving the adjustable-central-canopy adjustable-ring-canopy adjustable-surrounding awning single-central-innersurface-square-lock popup when fully erected,
to help with relocating the adjustable-central-canopy adjustable-ring-canopy adjustable-surrounding awning single-central-innersurface-square-lock popup; and d) Can not be used with ropes 141 to connect four lower posts 121 together and other popups to the adjustable-central-canopy adjustable-ring-canopy adjustable-surrounding awning single-central-innersurface-square-lock popup,
to strengthen and expand structure and to keep four lower posts 121 from bending out.

4) No prior art mention or disclose any collapsible popup, having tick-preventing downward teeth 117.

Therefore, the prior art of collapsible popup:

a) Can not prevent ticks from getting inside four upper posts 112 and four lower posts 121,
to protect occupants from disease;

b) Can not help protect from weather elements getting up inside four upper posts 112 and four lower posts 121,
to help prevent against rust and increase the lifetime of the adjustable-central-canopy adjustable-ring-canopy adjustable-surrounding awning single-central-innersurface-square-lock popup;

c) Can not assist in water drainage,
to help prevent rusting; and d) Can not provide additional structure to four sleeves 115,
to increase strength of four upper posts 112 and four lower posts 121.

5) No prior art mention or disclose any collapsible popup, having post-centering clamps 116.

Therefore, the prior art of collapsible popup:

a) Can not center four lower posts 121 within four upper posts 112,
to help with assembly and disassembly;

b) Can not help keep ticks from entering into four upper posts 112 and four lower posts 121,
to protect occupants;

c) Can not provide addition strength and stability to four upper posts 112 and four lower posts 121,
to keep occupants safe and increase the adjustable-central-canopy adjustable-ring-canopy adjustable-surrounding awning single-central-innersurface-square-lock popup's lifetime; and d) Can not keep four upper posts 112 and four lower posts 121 from binding
to help with adjusting the adjustable-central-canopy adjustable-ring-canopy adjustable-surrounding awning single-central-innersurface-square-lock popup up and down.

6) No prior art mention or disclose any collapsible popup, having central square post 125.

Therefore, the prior art of collapsible popup:

a) Can not provide lateral strength to the adjustable-central-canopy adjustable-ring-canopy adjustable-surrounding awning single-central-innersurface-square-lock popup,
to keep the adjustable-central-canopy adjustable-ring-canopy adjustable-surrounding awning single-central-innersurface-square-lock popup from radially twisting;

b) Can not lock canopy structure together,
to prevent canopy from collapsing;

c) Can not provide multiple adjustment locations,
to give options for setup; and d) Can not decrease the total number of overall locking points,
to make setup easier.

7) No prior art mention or disclose any collapsible popup, having lead-in funnels 130.

Therefore, the prior art of collapsible popup:

a) Can not automatically guide central square post 125 into central-innersurface-locking adjustable ring 129,
to help with setup;

b) Can not automatically guide central square post 125 into both top and bottom of central-innersurface-locking adjustable ring 129,
to make up and down adjustments easier;

c) Can not automatically depress central-innersurface-locking double nipples 128,
to make locking central square post 125 easier; and d) Can not automatically provide less friction between central-innersurface-locking adjustable ring 129 and central square post 125,
to make setup and adjustment easier.

8) No prior art mention or disclose any collapsible popup, having water-discharging grooves 118.

Therefore, the prior art of collapsible popup:

a) Can not allow water to drain from four upper posts 112 and four lower posts 121,
to prevent four upper posts 112 and four lower posts 121 from rusting;

b) Can not prevent water from getting into posts,
to help prolong the life of the adjustable-central-canopy adjustable-ring-canopy adjustable-surrounding awning single-central-innersurface-square-lock popup;

c) Can not help protect against insects,
to help protect occupants; and e) Can not provide addition structure to sleeves,
to increase strength of four upper posts 112 and four lower post 121.

9) No prior art mention or disclose any collapsible popup, having foldable adjustable awning trusses 136.

Therefore, the prior art of collapsible popup:

a) Can not provide support for surrounding awning 135,
to keep surrounding awning 135 fabric from drooping;

b) Can not adjust surrounding awning 135 up,
to redirect airflow out;

c) Can not adjust surrounding awning 135 down,
to redirect airflow down; and d) Can not provide additional support to the adjustable-central-canopy adjustable-ring-canopy adjustable-surrounding awning single-central-innersurface-square-lock popup,
to strengthen overall structure.

10) No prior art mention or disclose any collapsible popup, having four sleeves 115.
Therefore, the prior art of collapsible popup:
a) Can not prevent four upper posts 112 and four lower posts 121 from scratching each other,
to prevent premature wear or rusting;
b) Can not minimize friction between four upper posts 112 and four lower posts 121,
to make raising and lowing easier;
c) Can not protect exposed joints of four upper posts 112 and four lower posts 121,
to prevent rusting and increase lifetime; and
d) Can not join four upper posts 112 and four lower posts 121 together
to provide additional strength and support for posts.

11) No prior art mention or disclose any collapsible popup, having rope and stake holes 140.
Therefore, the prior art of collapsible popup:
a) Can not be used to thread ropes 141 through,
to use with either pulley wheels or hooks;
b) Can not be used to drive a stakes 142 through into the ground,
to secure the adjustable-central-canopy adjustable-ring-canopy adjustable-surrounding awning single-central-innersurface-square-lock popup to the ground;
c) Can not be used as a pulley for ropes 141,
to be used with other pulley-wheels 145 and ropes 141; and
d) Can not be used as a tie-off location for ropes 141,
to increase customization options for ropes 141 and pulley wheels 145.

12) No prior art mention or disclose any collapsible popup, having hooks 139.
Therefore, the prior art of collapsible popup:
a) Can not hook canopy ropes 141 on hooks 139
to lock ropes 141 and all canopies and awning to keep them from slipping;
b) Can not provide a location of rope-and-stake holes 140,
to help with staking four lower posts 121 to the ground;
c) Can not be used as a foot step,
to help with setup and to drive four lower posts 121 into the ground; and
d) Can not hook ropes 141 on hooks 139 from four lower posts 121,
to strengthen structure and keep four lower posts 121 from bending out.

OBJECTS AND ADVANTAGES OF THE INVENTION

The present invention substantially departs from the conventional concepts and designs of the prior art. In doing so, the present invention provides the adjustable-central-canopy adjustable-ring-canopy adjustable-surrounding-awning single-central-innersurface-square-lock popup (having: a) Post-centering tick-preventing water-discharging wind-and-smoke-redirecting ring-canopy system, b) Central-innersurface-locking wind-and-smoke-redirecting central-canopy system, c) Wind-and-smoke-redirecting surrounding-awning system, and d) Multi-function hook-rope-stake-pulley-wheel system), having many unique and significant features, functions, and advantages, which overcome all the disadvantages of the prior art, as follows:

1) It is an object of the new invention to provide an adjustable-central-canopy adjustable-ring-canopy adjustable-surrounding awning single-central-innersurface-square-lock popup, having
adjustable ring canopy 102,
adjustable central canopy 124, and
adjustable surrounding awning 135.
Therefore, the adjustable-central-canopy adjustable-ring-canopy adjustable-surrounding awning single-central-innersurface-square-lock popup:
a) Can provide shade to occupants,
to prevent sunburn;
b) Can be adjusted up and down to increase airflow into and out of the adjustable-central-canopy adjustable-ring-canopy adjustable-surrounding awning single-central-innersurface-square-lock popup,
to keep occupants cool;
c) Can help with airflow out of the adjustable-central-canopy adjustable-ring-canopy adjustable-surrounding awning single-central-innersurface-square-lock popup,
to assist in smoke exiting the adjustable-central-canopy adjustable-ring-canopy adjustable-surrounding awning single-central-innersurface-square-lock popup; and
d) Can provide rain protection,
to keep occupants dry.

2) It is another object of the new invention to provide an adjustable-central-canopy adjustable-surround-canopy adjustable-awning single-central-innersurface-square-lock popup, having
central-innersurface-locking adjustable ring 129.
Therefore, the adjustable-central-canopy adjustable-ring-canopy adjustable-surrounding awning single-central-innersurface-square-lock popup:
a) Can lock central square post 125 to the rest of the canopy structure,
to increase overall strength of the adjustable-central-canopy adjustable-ring-canopy adjustable-surrounding awning single-central-innersurface-square-lock popup;
b) Can lock canopy together,
to prevent the adjustable-central-canopy adjustable-ring-canopy adjustable-surrounding awning single-central-innersurface-square-lock popup from collapsing;
c) Can decrease the total number of locking points,
to make setup easier; and
d) Can lock four post-height-adjusting nipples 120 and central square post 125 on the same plane as central-innersurface-locking adjustable ring 129 and two button tunnels 131,
to prevent four post-height-adjusting nipples 120 from twisting and bending out of two button tunnels 131 when the wind tries to twist and bend the adjustable-central-canopy adjustable-ring-canopy adjustable-surrounding awning single-central-innersurface-square-lock popup.

3) It is another object of the new invention to provide an adjustable-central-canopy adjustable-ring-canopy adjustable-surrounding awning single-central-innersurface-square-lock popup, having
pulley-wheels 145.

Therefore, the adjustable-central-canopy adjustable-ring-canopy adjustable-surrounding awning single-central-innersurface-square-lock popup:

a) Can be used as pulleys to thread ropes 141,
to tighten canopies;

b) Can be used to roll the adjustable-central-canopy adjustable-ring-canopy adjustable-surrounding awning single-central-innersurface-square-lock popup along the ground when in collapsed configuration,
to make transportation easier;

c) Can be used to assist in moving the adjustable-central-canopy adjustable-ring-canopy adjustable-surrounding awning single-central-innersurface-square-lock popup when fully erected,
to help with relocating the adjustable-central-canopy adjustable-ring-canopy adjustable-surrounding awning single-central-innersurface-square-lock popup; and d) Can be used with ropes 141 to connect four lower posts 121 together and other popups to the adjustable-central-canopy adjustable-ring-canopy adjustable-surrounding awning single-central-innersurface-square-lock popup,
to strengthen and expand structure and to keep four lower posts 121 from bending out.

4) It is a further object of the new invention to provide an adjustable-central-canopy adjustable-ring-canopy adjustable-surrounding awning single-central-innersurface-square-lock popup, having
tick-preventing downward teeth 117.

Therefore, the adjustable-central-canopy adjustable-ring-canopy adjustable-surrounding awning single-central-innersurface-square-lock popup:

a) Can prevent ticks from getting inside four upper posts 112 and four lower posts 121,
to protect occupants from disease;

b) Can help protect from weather elements getting up inside four upper posts 112 and four lower posts 121,
to help prevent against rust and increase the lifetime of the adjustable-central-canopy adjustable-ring-canopy adjustable-surrounding awning single-central-innersurface-square-lock popup;

c) Can assist in water drainage,
to help prevent rusting; and d) Can provide additional structure to four sleeves 115,
to increase strength of four upper posts 112 and four lower posts 121.

5) It is an even further object of the new invention to provide an adjustable-central-canopy adjustable-ring-canopy adjustable-surrounding awning single-central-innersurface-square-lock popup, having
post-centering clamps 116.

Therefore, the adjustable-central-canopy adjustable-surround-canopy adjustable-awning single-central-innersurface-square-lock popup:

a) Can center four lower posts 121 within four upper posts 112,
to help with assembly and disassembly;

b) Can help keep ticks from entering into four upper posts 112 and four lower posts 121,
to protect occupants;

c) Can provide addition strength and stability to four upper posts 112 and four lower posts 121,
to keep occupants safe and increase the adjustable-central-canopy adjustable-ring-canopy adjustable-surrounding awning single-central-innersurface-square-lock popup's lifetime; and d) Can keep four upper posts 112 and four lower posts 121 from binding
to help with adjusting the adjustable-central-canopy adjustable-ring-canopy adjustable-surrounding awning single-central-innersurface-square-lock popup up and down.

6) It is another object of the new invention to provide an adjustable-central-canopy adjustable-ring-canopy adjustable-surrounding awning single-central-innersurface-square-lock popup, having
central square post 125.

Therefore, the adjustable-central-canopy adjustable-ring-canopy adjustable-surrounding awning single-central-innersurface-square-lock popup:

a) Can provide lateral strength to the adjustable-central-canopy adjustable-ring-canopy adjustable-surrounding awning single-central-innersurface-square-lock popup,
to keep the adjustable-central-canopy adjustable-ring-canopy adjustable-surrounding awning single-central-innersurface-square-lock popup from radially twisting;

b) Can lock canopy structure together,
to prevent canopy from collapsing;

c) Can provide multiple adjustment locations,
to give options for setup; and d) Can decrease the total number of overall locking points,
to make setup easier.

7) It is yet another object of the new invention to provide an adjustable-central-canopy adjustable-ring-canopy adjustable-surrounding awning single-central-innersurface-square-lock popup, having
lead-in funnels 130.

Therefore, the adjustable-central-canopy adjustable-ring-canopy adjustable-surrounding awning single-central-innersurface-square-lock popup:

a) Can automatically guide central square post 125 into central-innersurface-locking adjustable ring 129,
to help with setup;

b) Can automatically guide central square post 125 into both top and bottom of central-innersurface-locking adjustable ring 129,
to make up and down adjustments easier;

c) Can automatically depress central-innersurface-locking double nipples 128,
to make locking central square post 125 easier; and d) Can automatically provide less friction between central-innersurface-locking adjustable ring 129 and central square post 125,
to make setup and adjustment easier.

8) It is still yet another object of the new invention to provide an adjustable-central-canopy adjustable-ring-canopy adjustable-surrounding awning single-central innersurface-square-lock popup, having
water-discharging grooves 118.

Therefore, the adjustable-central-canopy adjustable-ring-canopy adjustable-surrounding awning single-central innersurface-square-lock popup:

a) Can allow water to drain from four upper posts 112 and four lower posts 121,
to prevent four upper posts 112 and four lower posts 121 from rusting;

b) Can prevent water from getting into posts,
to help prolong the life of the adjustable-central-canopy adjustable-ring-canopy adjustable-surrounding awning single-central-innersurface-square-lock popup;
c) Can help protect against insects,
to help protect occupants; and
d) Can provide addition structure to sleeves,
to increase strength of four upper posts 112 and four lower posts 121.

9) It is still yet an even further object of the new invention to provide an adjustable-central-canopy adjustable-ring-canopy adjustable-surrounding awning single-central-innersurface-square-lock popup, having
foldable adjustable awning trusses 136.
Therefore, the adjustable-central-canopy adjustable-ring-canopy adjustable-surrounding awning single-central innersurface-square-lock popup:
a) Can provide support for surrounding awning 135,
to keep surrounding awning 135 fabric from drooping;
b) Can adjust surrounding awning 135 up,
to redirect airflow out;
c) Can adjust surrounding awning 135 down,
to redirect airflow down; and
d) Can provide additional support to the adjustable-central-canopy adjustable-ring-canopy adjustable-surrounding awning single-central-innersurface-square-lock popup,
to strengthen overall structure.

10) It is still yet an even further object of the new invention to provide an adjustable-central-canopy adjustable-ring-canopy adjustable-surrounding awning single-central-innersurface-square-lock popup, having
four sleeves 115.
Therefore, the adjustable-central-canopy adjustable-surround-canopy adjustable-awning single-central-innersurface-square-lock popup:
a) Can prevent four upper posts 112 and four lower posts 121 from scratching each other
to prevent premature wear or rusting;
b) Can minimize friction between four upper posts 112 and four lower posts 121,
to make raising and lowing easier;
c) Can protect exposed joints of four upper posts 112 and four lower posts 121,
to prevent rusting and increase lifetime; and
d) Can join four upper posts 112 and four lower posts 121 together
to provide additional strength and support for posts.

11) It is still yet an even further object of the new invention to provide an adjustable-central-canopy adjustable-ring-canopy adjustable-surrounding awning single-central-innersurface-square-lock popup, having
rope-and-stake holes 140.
Therefore, the adjustable-central-canopy adjustable-ring-canopy adjustable-surrounding awning single-central-innersurface-square-lock popup:
a) Can be used to thread ropes 141 through,
to use with either pulley wheels or hooks;
b) Can be used to drive stake 142 through into the ground,
to secure the adjustable-central-canopy adjustable-ring-canopy adjustable-surrounding awning single-central-innersurface-square-lock popup to the ground;
c) Can be used as a rope pulley,
to be used with other pulley-wheels 145 and ropes 141; and
d) Can be used as a tie-off location for ropes 141,
to increase customization options for ropes 141 and pulley wheels 145.

12) It is still yet an even further object of the new invention to provide an adjustable-central-canopy adjustable-ring-canopy adjustable-surrounding awning single-central-innersurface-square-lock popup, having
hooks 139.
Therefore, the adjustable-central-canopy adjustable-ring-canopy adjustable-surrounding awning single-central-innersurface-square-lock popup:
a) Can hook canopy ropes 141 on hooks 139
to lock ropes 141 and all canopies and awning to keep them from slipping;
b) Can provide a location of rope-and-stake holes 140,
to help with staking four lower posts 121 to the ground;
c) Can be used as a foot step,
to help with setup and to drive four lower posts 121 into the ground; and
d) Can hook ropes 141 on hooks 139 from four lower posts 121,
to strengthen structure and keep four lower posts 121 from bending out.

Other objects and advantages of the present invention will become apparent from a consideration of the accompanying drawings and ensuing description.

SUMMARY OF THE INVENTION

A multiple-adjustable-canopy-and-awning single-lock popup comprises: an adjustable ring canopy and an adjustable central canopy and an adjustable surrounding awning each being able to be adjusted up and down, a central intersector, foldable top and corner and side trusses each bolted to the central intersector, four upper posts, four upper corner intersectors each bolted to the top and side trusses, four lower corner intersectors and four sleeves each slid on the four upper posts, post-centering clamps and tick-preventing downward teeth and water-discharging grooves each respectively molded to the four sleeves, four lower posts inserted inside the four upper posts, a central square post attached to the central intersector, central-innersurface-locking double nipples attached to the central square post, a central-innersurface-locking adjustable ring adjustably and slidably locked on and unlocked from the central square post for locking and unlocking the central square post and the central-innersurface-locking double nipples to and from the central-innersurface-locking adjustable ring and the foldable adjustable central trusses on the same plane to prevent the popup from radially twisting clockwise or counterclockwise and to lock and unlock the popup after the popup is folded or unfolded, hooks respectively welded or molded to the four lower posts, ropes hooked on at least one of the four lower posts or the hooks, and pulley-wheels each rotatably attached to the hooks for functioning as pulleys and wheels to wrap the ropes thereon to tie the four lower posts together and to roll the popup along the ground.

DETAILED DESCRIPTION OF THE INVENTION

Figure 1A:
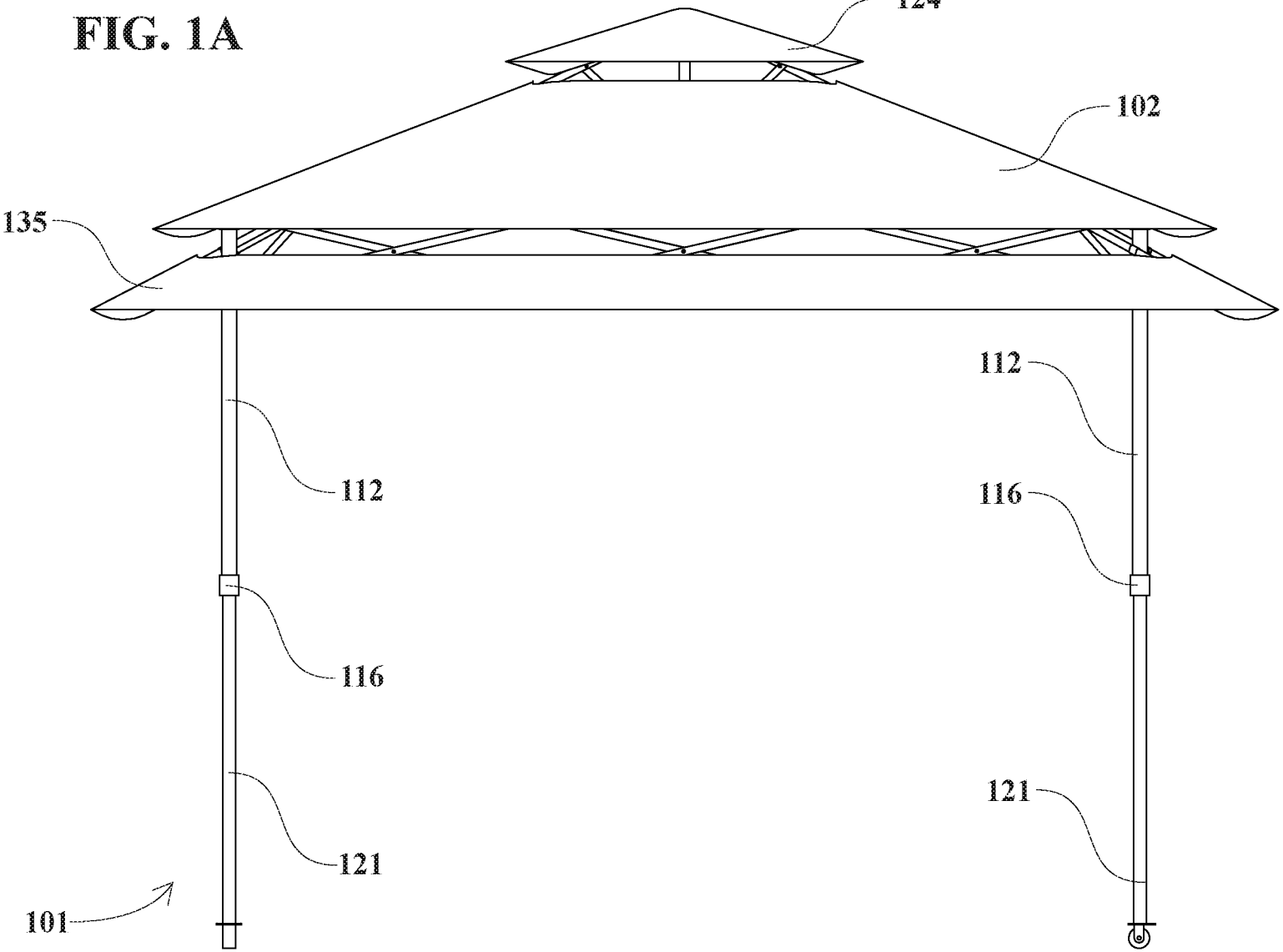
FIG. 1A, FIG. 1B, FIG. 1C, and FIG. 1D illustrate front and perspective views of the assembly of the adjustable-central-canopy adjustable-ring-canopy adjustable-surrounding awning single-central-innersurface-square-lock popup.
Figure 1B:
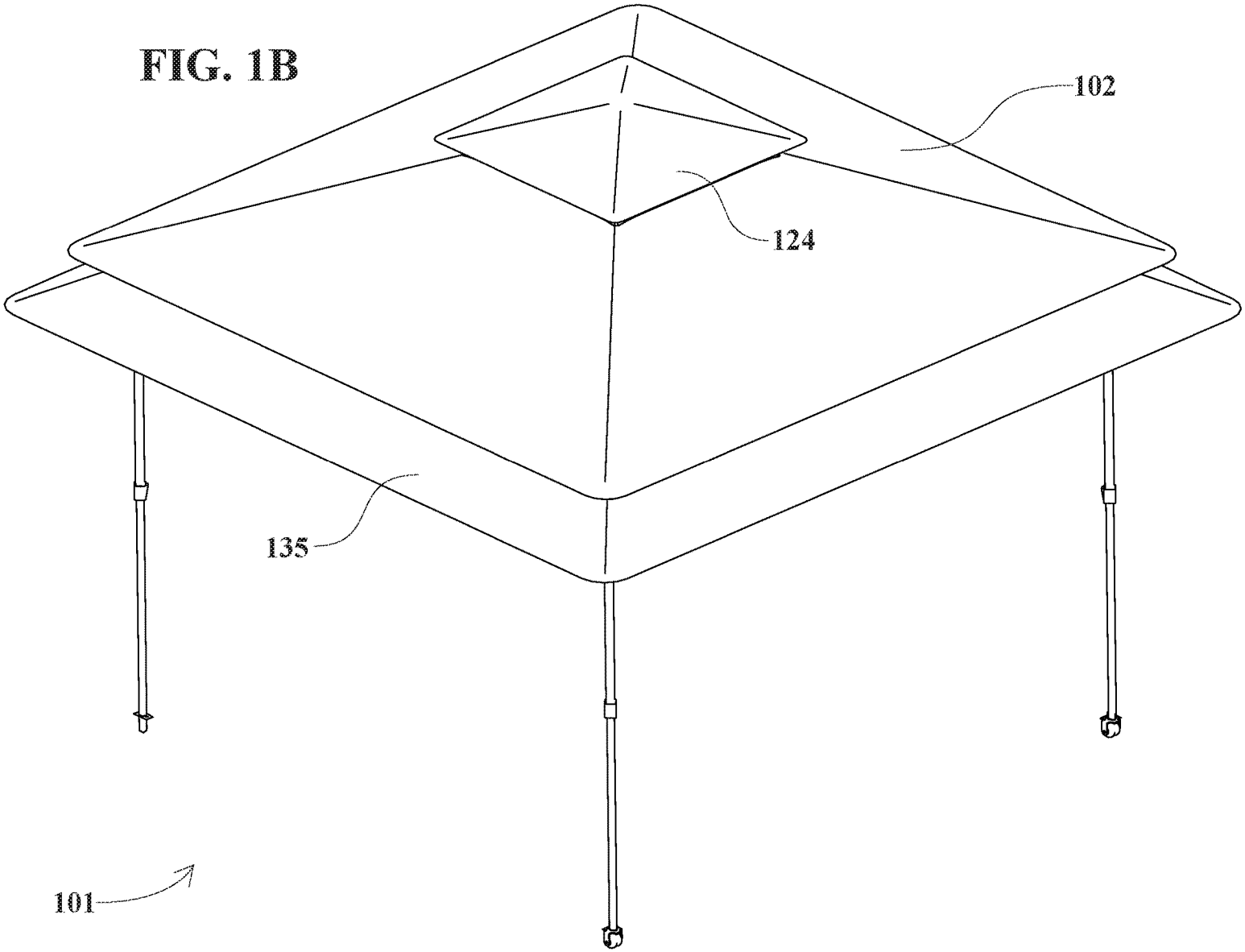
Figure 1C:
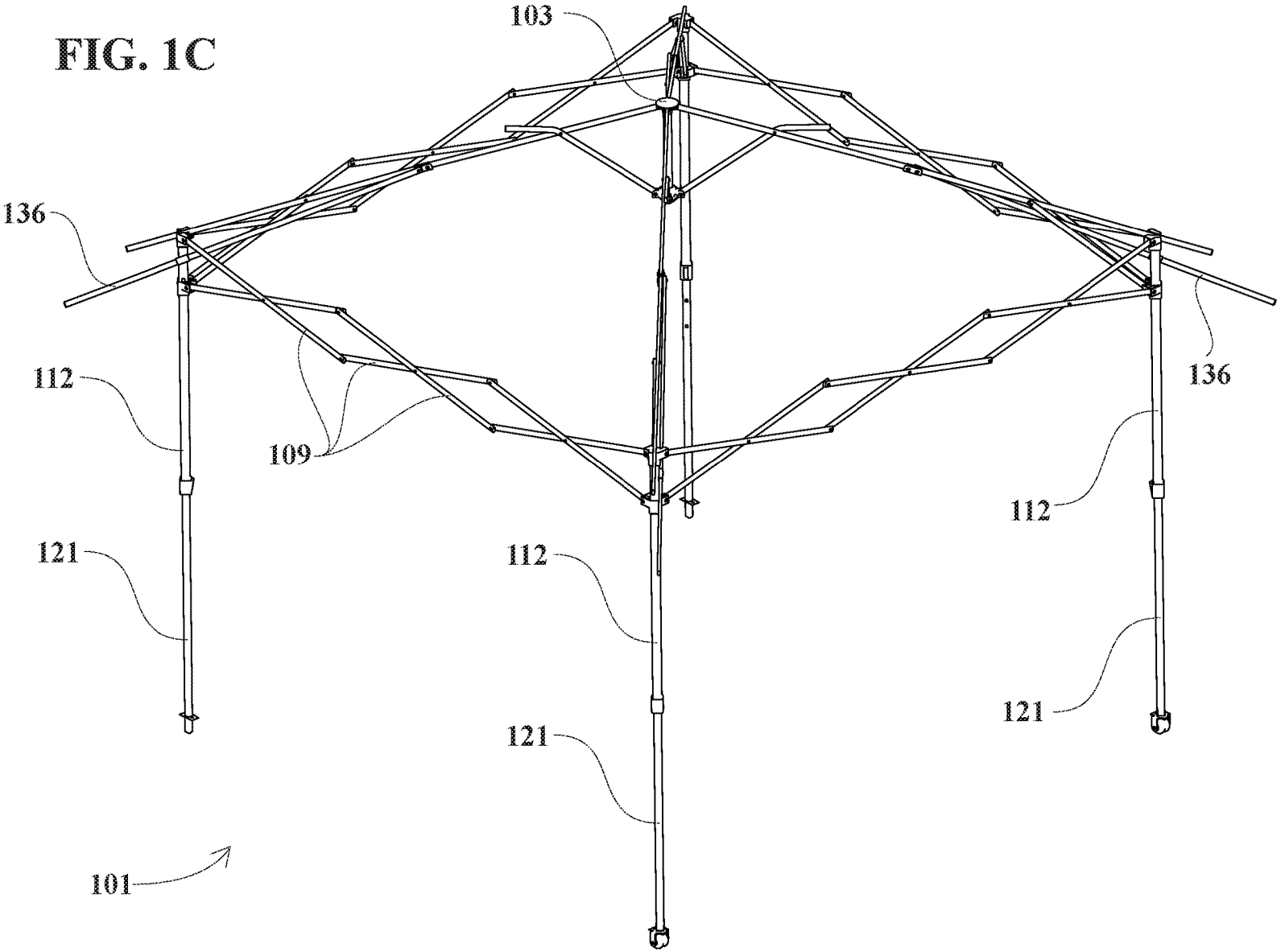
Figure 1D:
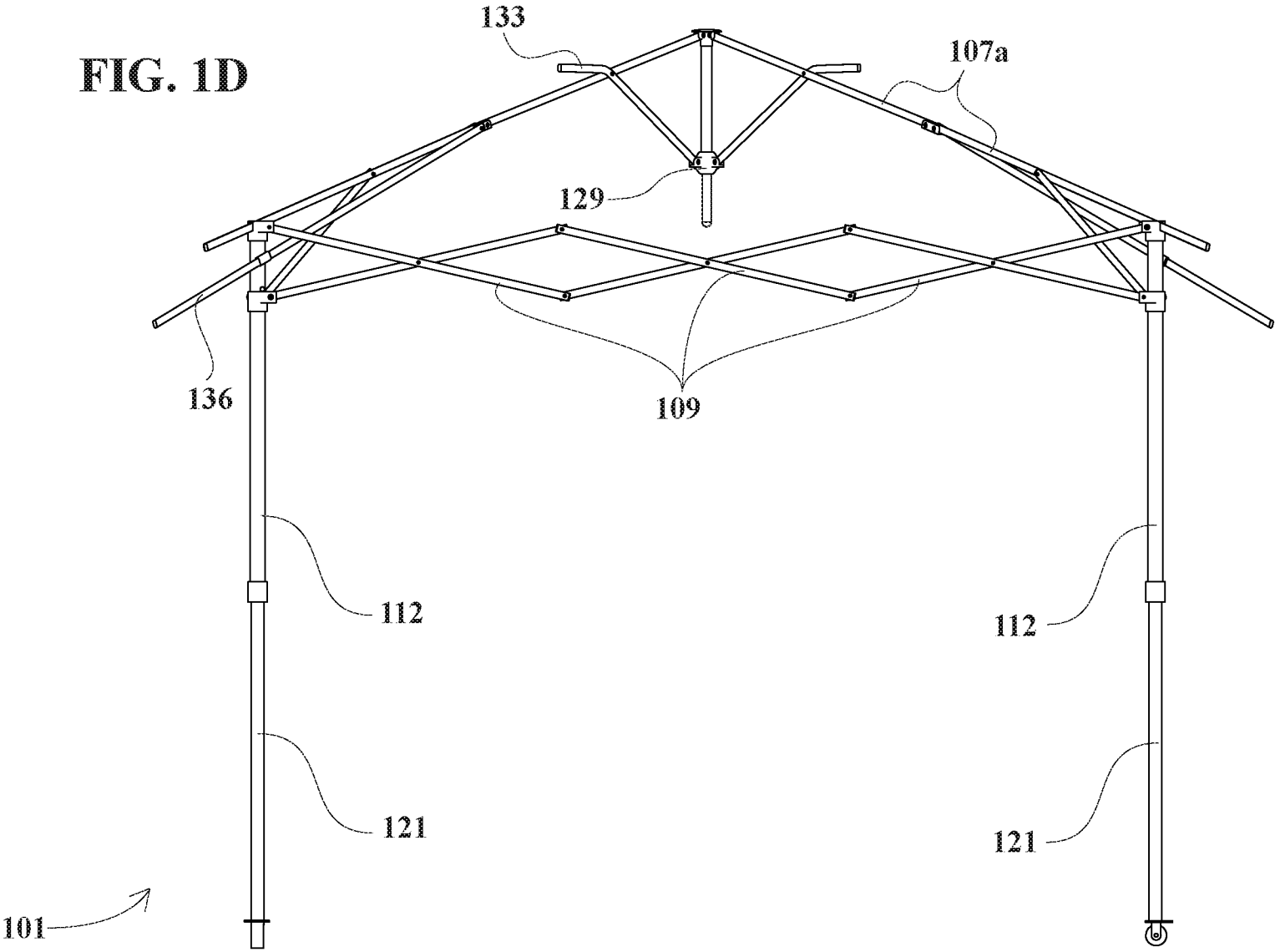
Figure 2A:
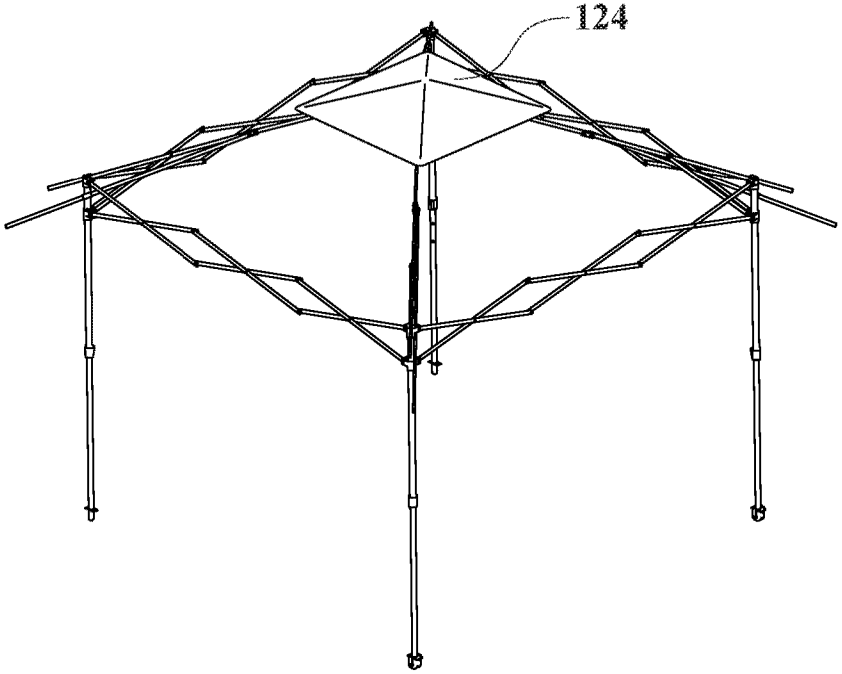
FIG. 2A, FIG. 2B, and FIG. 3 illustrate front and perspective views of the central-innersurface-locking wind-and-smoke-redirecting adjustable-central-canopy system 123.
Figure 2B:
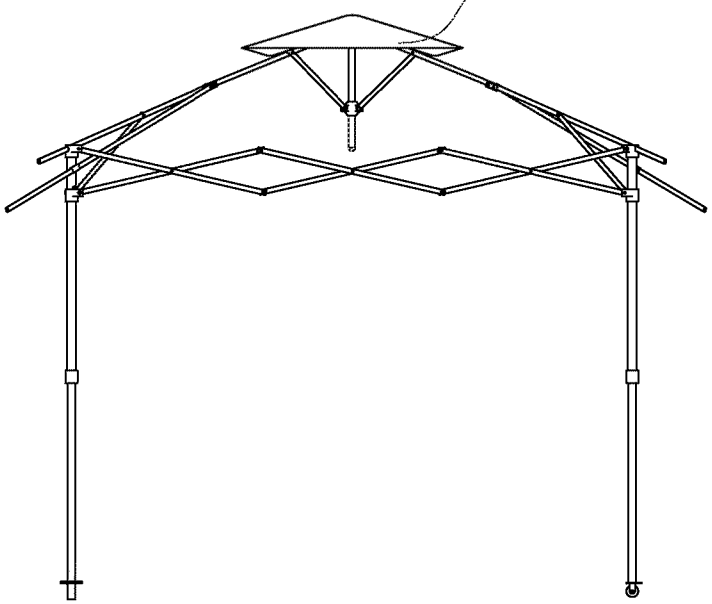
Figure 3:
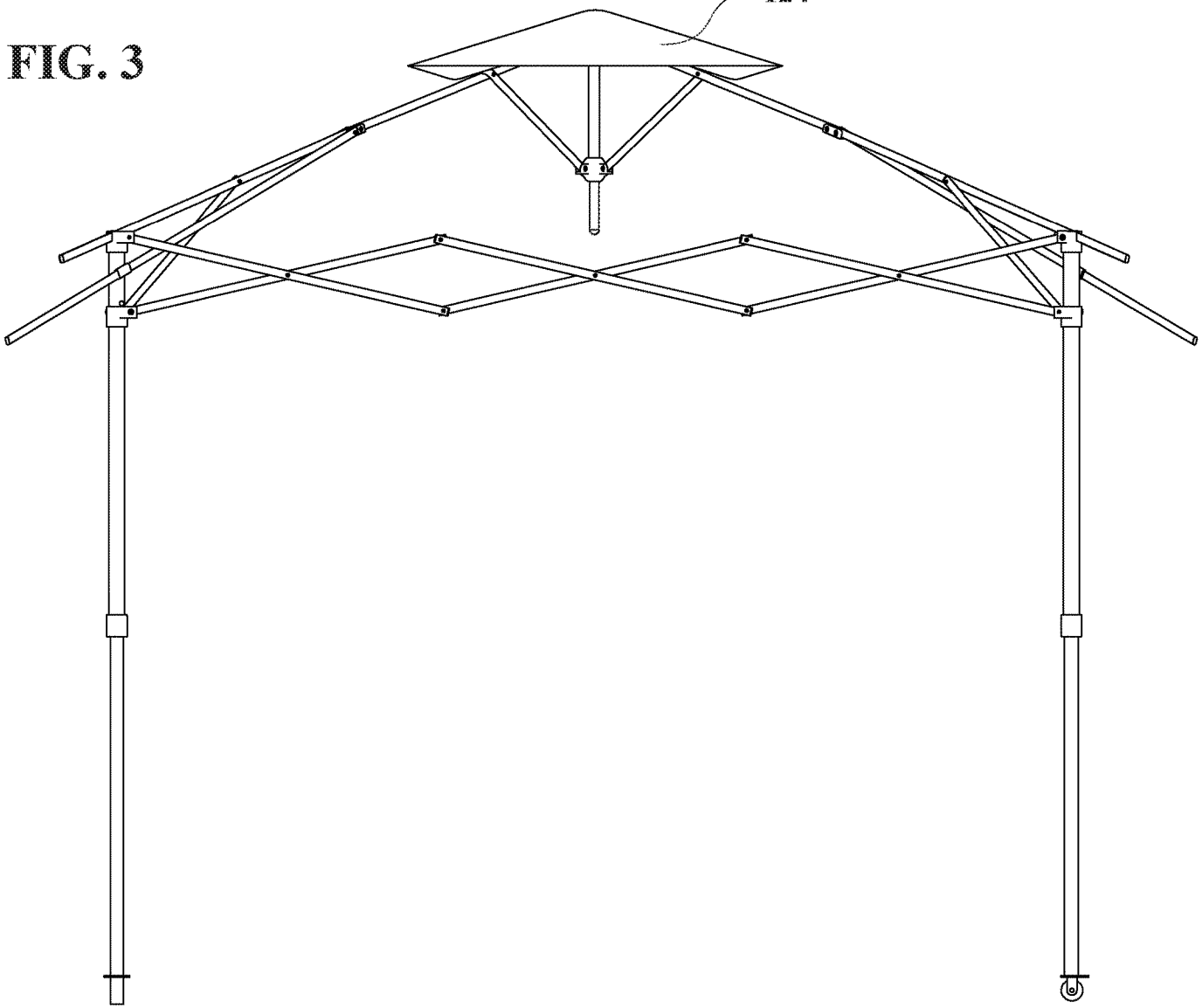
Figure 4A:
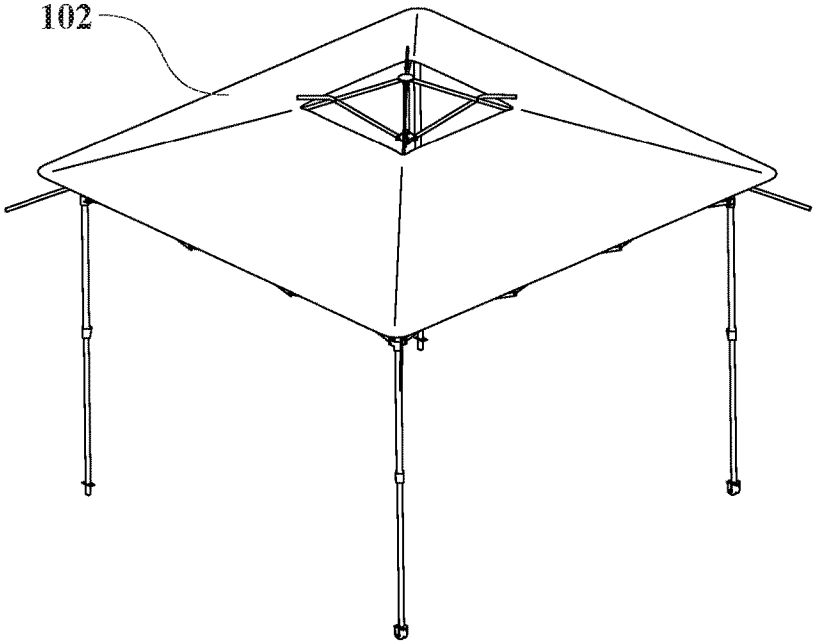
FIG. 4A, FIG. 4B, and FIG. 5 illustrate front and perspective views of the post-centering tick-preventing water-discharging wind-and-smoke-redirecting adjustable-ring-canopy system 101.
Figure 4B:
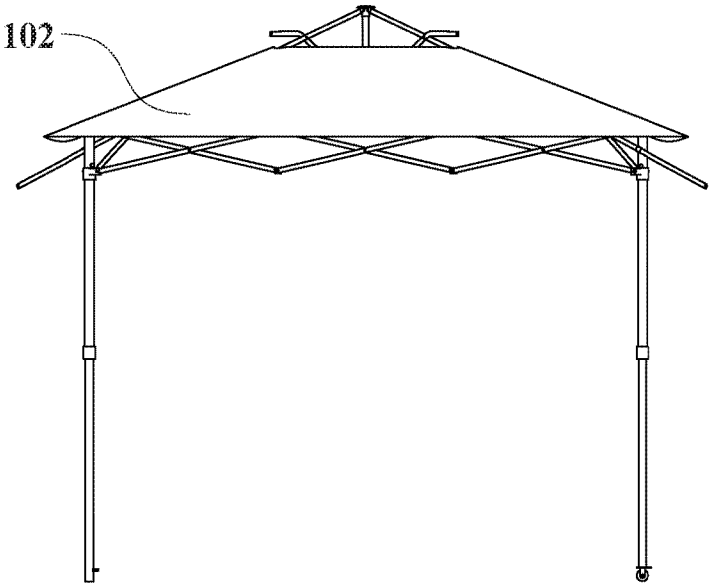
Figure 5:
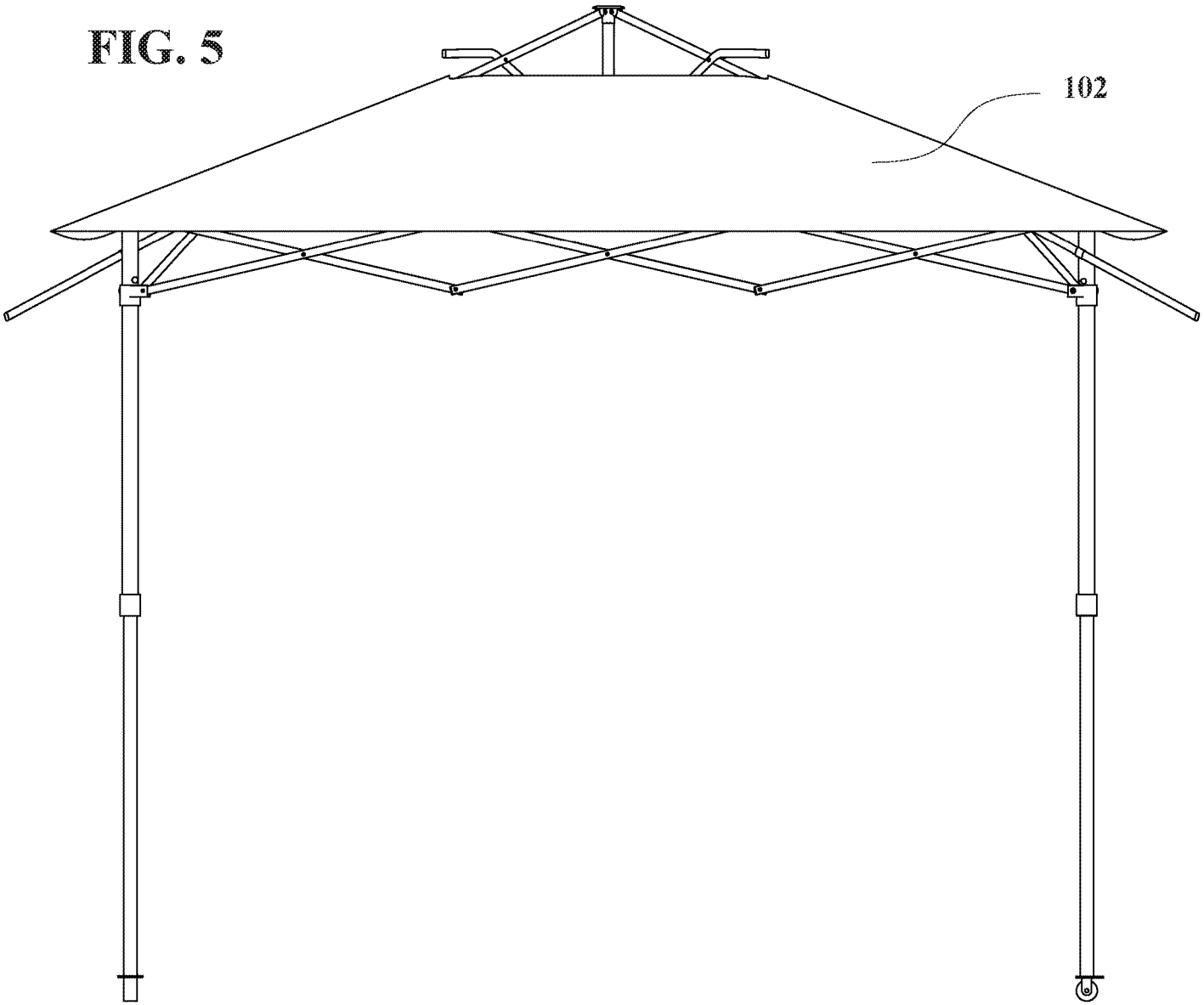
Figure 6A:
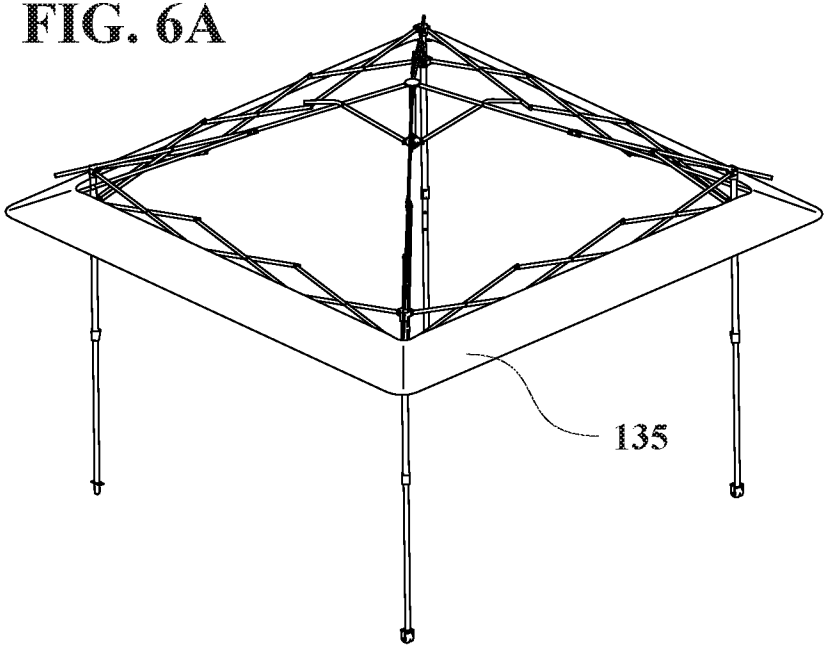
FIG. 6A, FIG. 6B, and FIG. 7 illustrate front and perspective views of the wind-and-smoke-redirecting adjustable-surrounding-awning system 134.
Figure 6B:
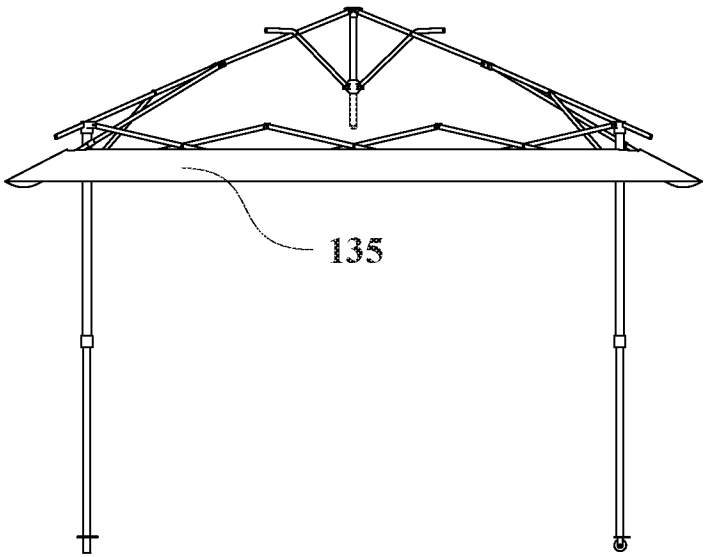
Figure 7:
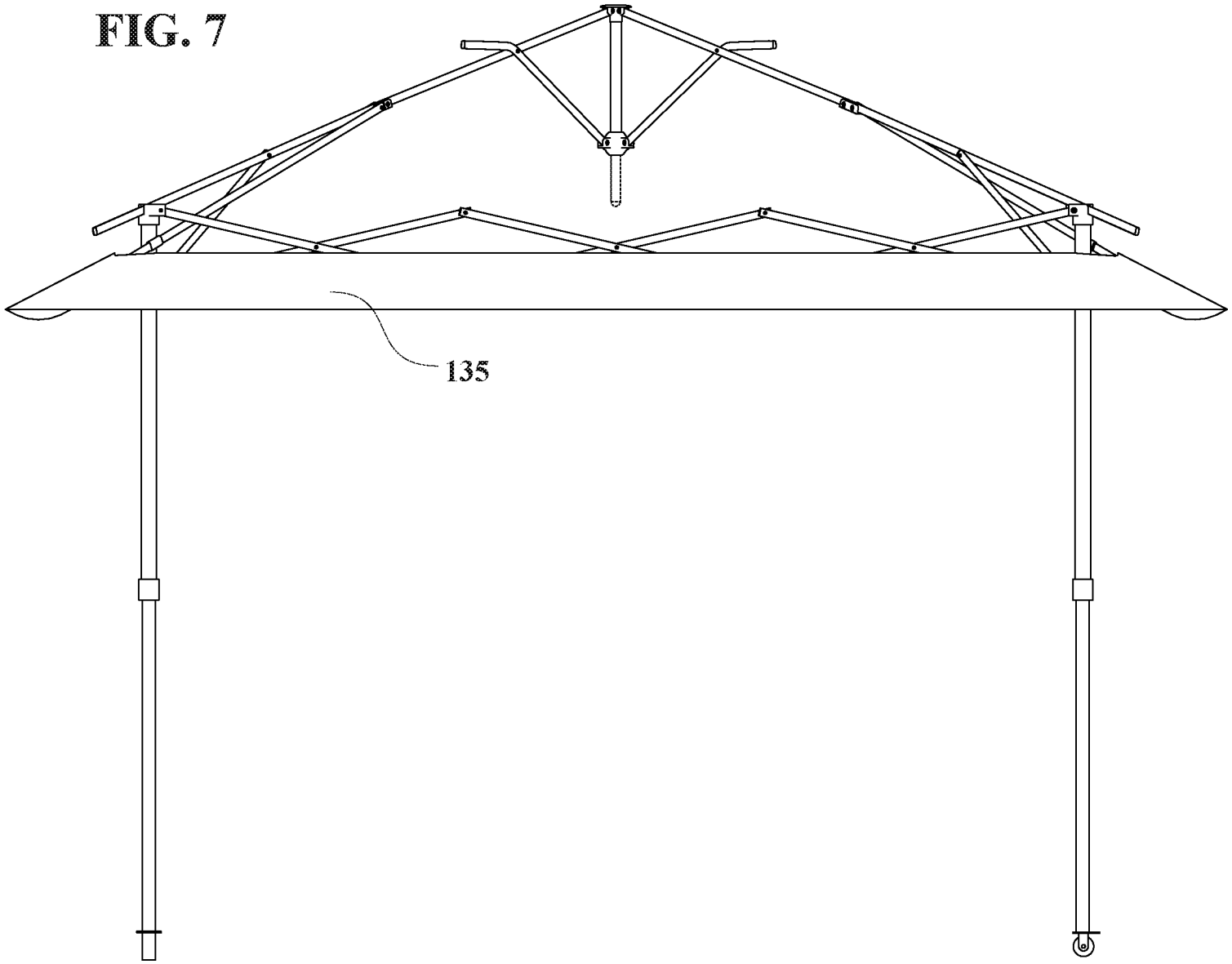
Figure 8:
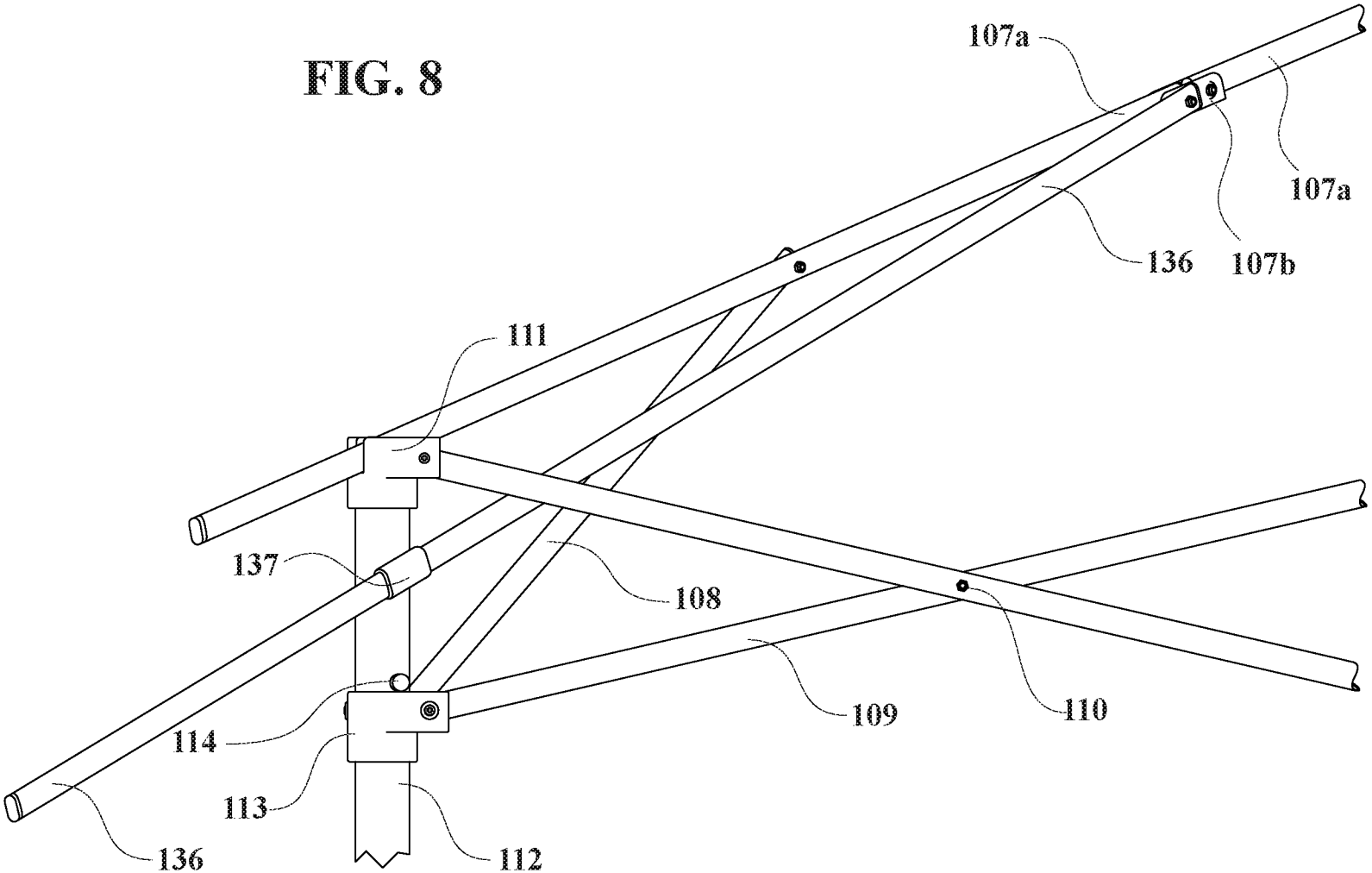
FIG. 8, FIG. 9, FIG. 10, FIG. 11, and FIG. 12 illustrate perspective views of how foldable top trusses 107*a*, foldable corner trusses 108, and foldable side trusses 109 are assembled together.
Figure 9:
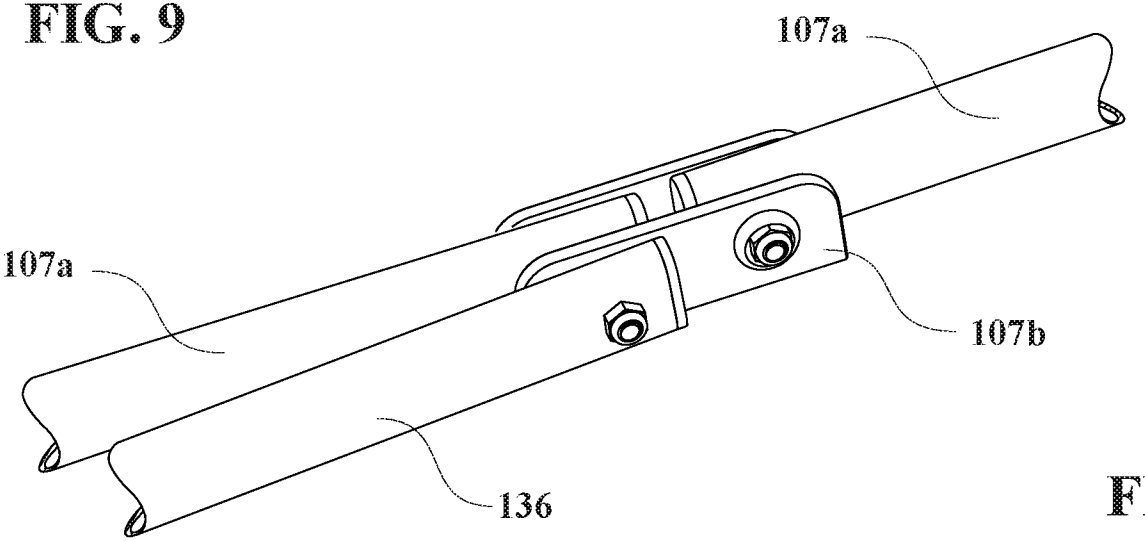
Figure 12:
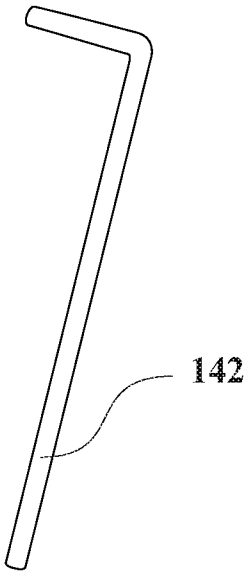
Figure 11:
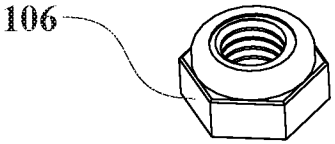
Figure 10:
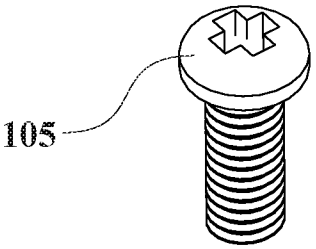
Figure 13B:
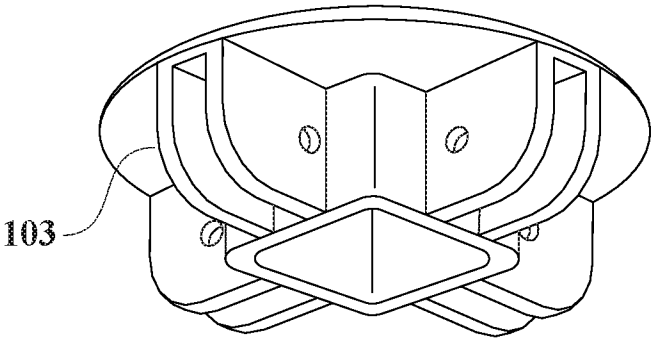
FIG. 13A, FIG. 13B, FIG. 13C, FIG. 14, FIG. 15A, and FIG. 15B illustrate front and perspective views of how the central-innersurface-locking wind-and-smoke-redirecting adjustable-central-canopy system 123 is assembled with central square post 125.
Figure 13A:
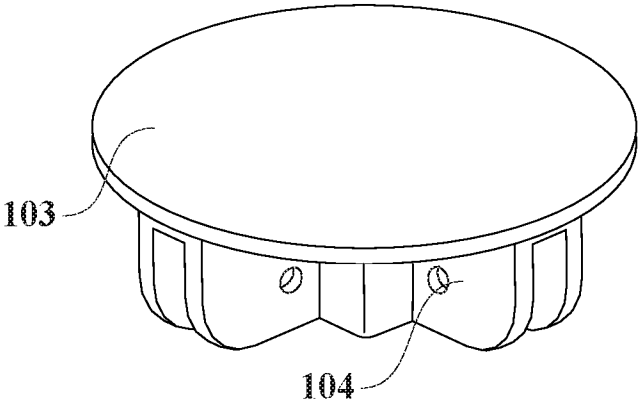
Figure 13C:
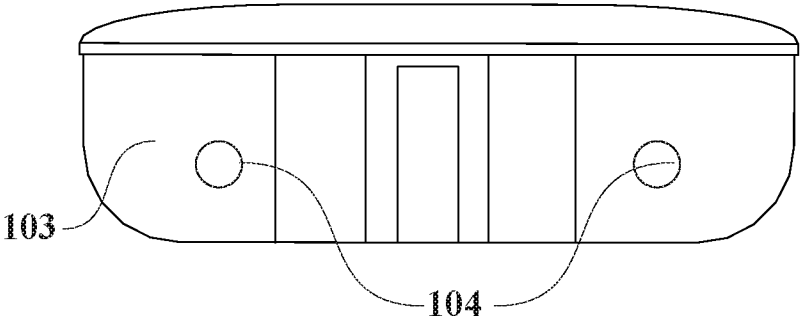
Figure 14:
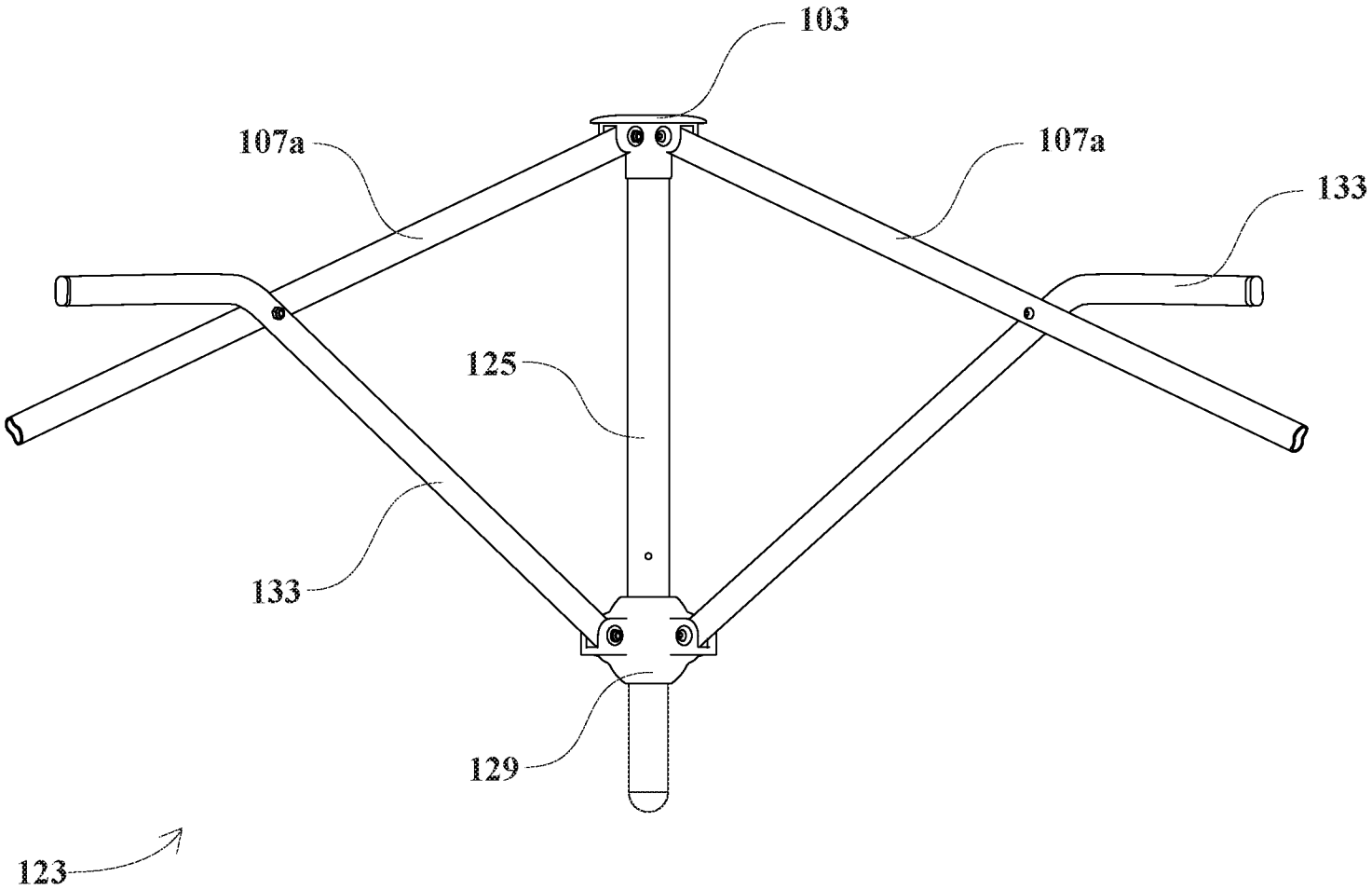
Figure 15A:
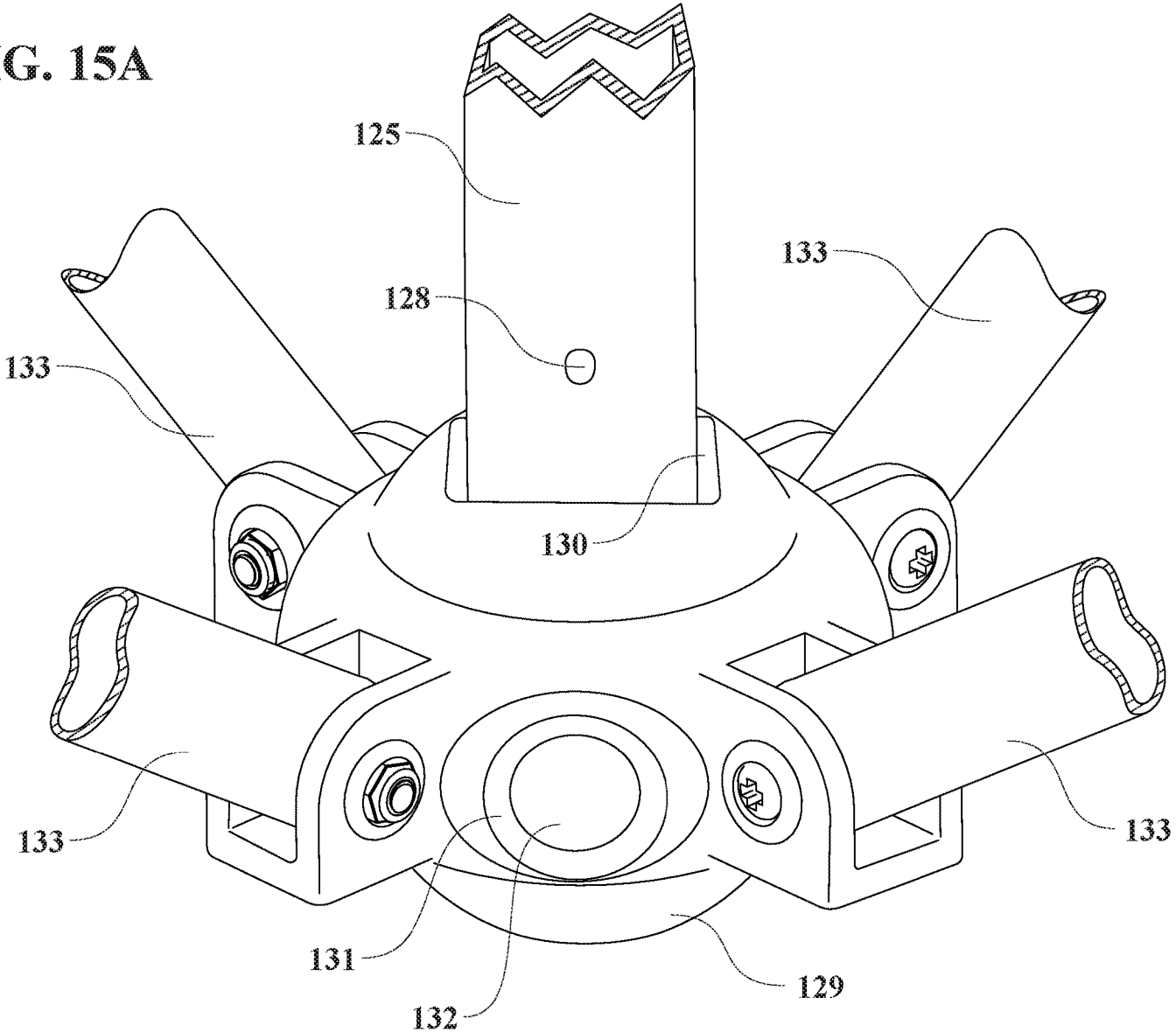
Figure 15B:
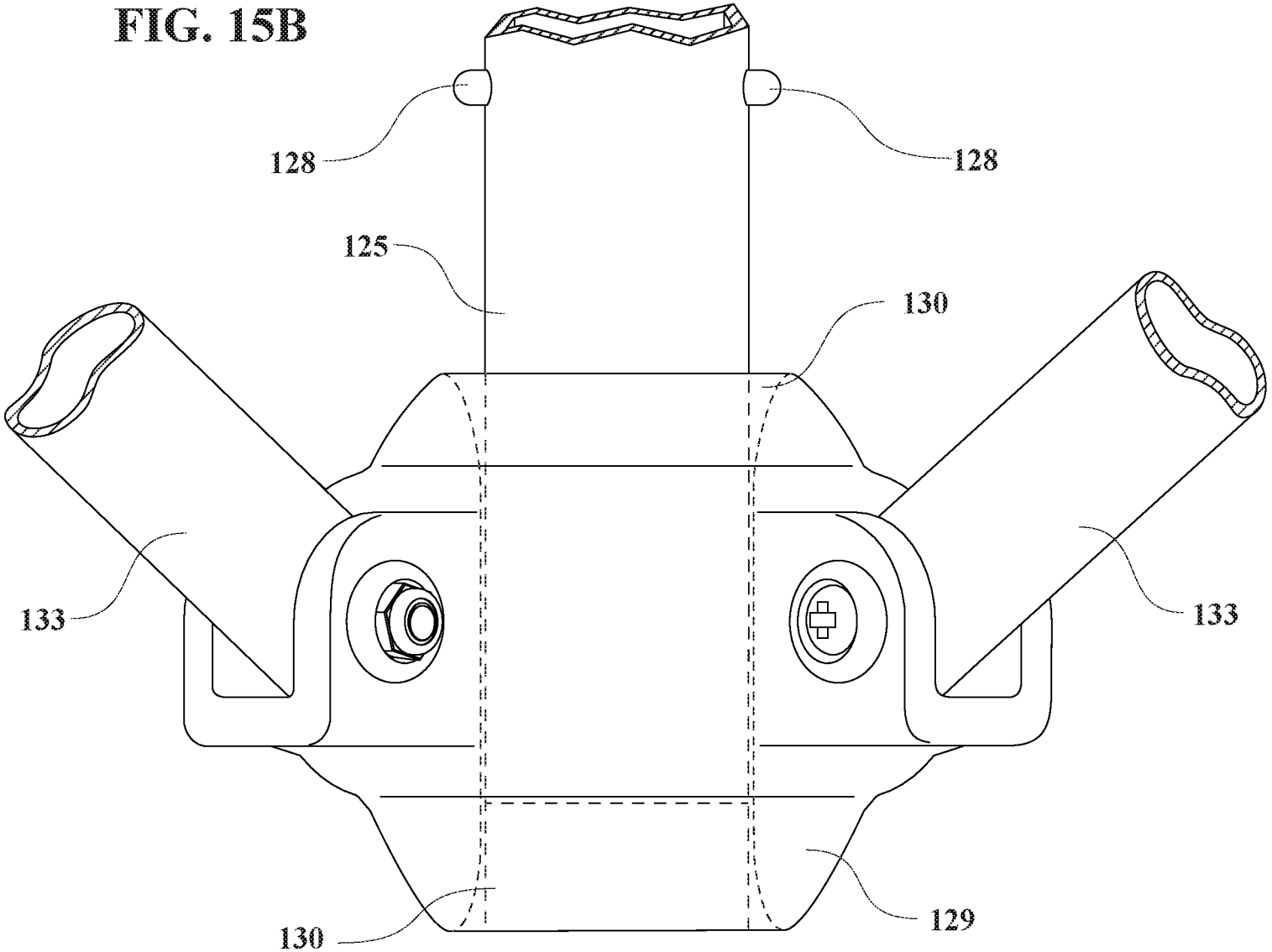

The adjustable-central-canopy adjustable-ring-canopy adjustable-surrounding-awning single-central-innersurface-square-lock popup comprises:

1) Post-centering tick-preventing water-discharging wind-and-smoke-redirecting adjustable-ring-canopy system,
2) Central-innersurface-square-locking wind-and-smoke-redirecting adjustable-central-canopy system,
3) Wind-and-smoke-redirecting adjustable-surrounding-awning system, and
4) Multi-function hook-rope-stake-pulley-wheel system.

Component

Referring to FIG. 1A, FIG. 1B, FIG. 1C, FIG. 1D, FIG. 2A, FIG. 2B, FIG. 3, FIG. 4A, FIG. 4B, FIG. 5, FIG. 6A, FIG. 6B, FIG. 7, FIG. 8, FIG. 9, FIG. 10, FIG. 11, FIG. 12, FIG. 13A, FIG. 13B, FIG. 13C, FIG. 14, FIG. 15A, FIG. 15B, FIG. 16A, and FIG. 16B, the adjustable-central-canopy adjustable-surround-canopy adjustable-awning single-central-innersurface-square-lock popup comprises:

1) Post-centering tick-preventing water-discharging wind-and-smoke-redirecting adjustable-ring-canopy system 101, comprising:
2) Adjustable ring canopy 102,
3) Central intersector 103,
4) Intersector holes 104,
5) Bolts 105,
6) Nuts 106,
7) Foldable top trusses 107*a*,
   Top-truss connectors 107*b*,
8) Foldable corner trusses 108,
9) Foldable side trusses 109,
10) Truss holes 110,
11) Four upper corner intersectors 111,
12) Four upper posts 112,
13) Four lower corner intersectors 113,
14) Four corner-intersector stoppers 114,
15) Four sleeves 115,
16) Post-centering clamps 116, 17) Tick-preventing downward teeth 117,
18) Water-discharging grooves 118,
19) Four post-height-adjusting spring-loaded rockers 119,
20) Four post-height-adjusting nipples 120,
21) Four lower posts 121,
22) Post-height-adjusting holes 122;
23) Central-innersurface-locking wind-and-smoke-redirecting adjustable-central-canopy system 123, comprising:
24) Adjustable central canopy 124,
25) Central square post 125,
26) Central-post holes 126,
27) Central-innersurface-locking double-C-shaped spring 127,
28) Central-innersurface-locking double nipples 128,
29) Central-innersurface-locking adjustable ring 129,
30) Lead-in funnels 130,
31) Two button tunnels 131,
32) Two buttons 132,
33) Foldable adjustable central trusses 133;
34) Wind-and-smoke-redirecting adjustable-surrounding-awning system 134, comprising:
35) Adjustable surrounding awning 135,
36) Foldable adjustable awning trusses 136,
37) Rotatable awning-truss sleeves 137; and
38) Multi-function hook-rope-stake-pulley-wheel system 138, comprising:
39) Hooks 139,
40) Rope-and-stake holes 140,
41) Ropes 141,
42) Stakes 142,
43) Pulley-wheel arms 143,
44) Pulley-wheel axles 144,
45) Pulley-wheels 145.

Material

Referring to FIG. 1A, FIG. 1B, FIG. 1C, FIG. 1D, FIG. 2A, FIG. 2B, FIG. 3, FIG. 4A, FIG. 4B, FIG. 5, FIG. 6A, FIG. 6B, FIG. 7, FIG. 8, FIG. 9, FIG. 10, FIG. 11, FIG. 12, FIG. 13A, FIG. 13B, FIG. 13C, FIG. 14, FIG. 15A, FIG. 15B, FIG. 16A, and FIG. 16B:

1) Post-centering tick-preventing water-discharging foldable wind-and-smoke-redirecting adjustable-ring-canopy system 101 is made of the combined materials of its components.
2) Adjustable ring canopy 102
is made of canvas, fabric, nylon, the like, the equivalent, or flexible material.
3) Central intersector 103
is made of metal or plastic material.
4) Intersector holes 104
each are made of empty space.
5) Bolts 105
each are made of metal or plastic material.
6) Nuts 106
each are made of metal or plastic material.
7) Foldable top trusses 107*a*
each are made of metal or plastic material.
Top-truss connectors 107*b*
each are made of metal or plastic material.
8) Foldable corner trusses 108
each are made of metal or plastic material.
9) Foldable side trusses 109
each are made of metal or plastic material.
10) Truss holes 110
each are made of empty space.
11) Four upper corner intersectors 111
each are made of metal or plastic material.
12) Four upper posts 112
each are made of metal or plastic material.
13) Four lower corner intersectors 113
each are made of metal or plastic material.
14) Four corner-intersector stoppers 114
each are made of metal or plastic material.
15) Four sleeves 115
each are made of metal or plastic material.
16) Post-centering clamps 116
each are made of metal or plastic material.
17) Tick-preventing downward teeth 117
each are made of metal or plastic material.
18) Water-discharging grooves 118
each are made of empty space.
19) Four post-height-adjusting spring-loaded rockers 119
each are made of metal or plastic material.
20) Four post-height-adjusting nipples 120
each are made of metal or plastic material.
21) Four lower posts 121
each are made of metal or plastic material.
22) Post-height-adjusting holes 122
each are made of empty space.
23) Central-innersurface-locking wind-and-smoke-redirecting adjustable-central-canopy system 123 is made of the combined materials of its components.
24) Adjustable central canopy 124
is made of canvas, fabric, nylon, the like, the equivalent, or flexible material.
25) Central square post 125
is made of metal or plastic material.
26) Central-post holes 126
each are made of empty space.
27) Central-innersurface-locking double-C-shaped spring 127
is made of metal or plastic material.
28) Central-innersurface-locking double nipples 128
each are made of metal or plastic material.
29) Central-innersurface-locking adjustable ring 129
is made of metal or plastic material.
30) Lead-in funnels 130
each are made of empty space.
31) Two button tunnels 131
each are made of empty space.
32) Two buttons 132
each are made of metal or plastic material.
33) Foldable adjustable central trusses 133
each are made of metal or plastic material.
34) Wind-and-smoke-redirecting adjustable-surrounding-awning system 134 is made of the combined materials of its components.
35) Adjustable surrounding awning 135
is made of canvas, fabric, nylon, the like, the equivalent, or flexible material.
36) Foldable adjustable awning trusses 136
each are made of metal or plastic material.
37) Rotatable awning-truss sleeves 137
each are made of metal or plastic material.
38) Multi-function hook-rope-stake-pulley-wheel system 138 is made of the combined materials of its components.
39) Hooks 139
each are made of metal or plastic material.
40) Rope-and-stake holes 140
each are made of empty space.
41) Ropes 141
each are made of canvas, fabric, nylon, the like, the equivalent, or flexible material.
42) Stakes 142
each are made of metal or plastic material.

43) Pulley-wheel arms 143
each are made of metal or plastic material.
44) Pulley-wheel axles 144
each are made of metal or plastic material.
45) Pulley-wheels 145
each are made of metal or plastic material.

Shape

Referring to FIG. 1A, FIG. 1B, FIG. 1C, FIG. 1D, FIG. 2A, FIG. 2B, FIG. 3, FIG. 4A, FIG. 4B, FIG. 5, FIG. 6A, FIG. 6B, FIG. 7, FIG. 8, FIG. 9, FIG. 10, FIG. 11, FIG. 12, FIG. 13A, FIG. 13B, FIG. 13C, FIG. 14, FIG. 15A, FIG. 15B, FIG. 16A, and FIG. 16B:

1) Post-centering tick-preventing water-discharging foldable wind-and-smoke-redirecting adjustable-ring-canopy system 101 has the combined shapes of its components.
2) Adjustable ring canopy 102
is formed into a square-ring shape.
3) Central intersector 103
is formed into a round shape with four U-shaped arms.
4) Intersector holes 104
each are formed into a round shape.
5) Bolts 105
each are formed into a bolt shape with a hexagon-shaped head.
6) Nuts 106
each are formed into a hexagonal ring shape.
7) Foldable top trusses 107*a*
each are formed into a rectangular-or-oval-tube shape.
Top-truss connectors 107*b*
each are formed into a U shape.
8) Foldable corner trusses 108
each are formed into a rectangular-or-oval-tube shape.
9) Foldable side trusses 109
each are formed into a rectangular-or-oval-tube shape.
10) Truss holes 110
each are formed into a round shape.
11) Four upper corner intersectors 111
each are formed into a square-tube shape with one closed end, one open end, and three U-shaped arms.
12) Four upper posts 112
each are formed into a tubular shape with a square cross-section.
13) Four lower corner intersectors 113
each are formed into a square-tube shape with open ends and three U-shaped arms.
14) Four corner-intersector stoppers 114
each are formed into a cylindrical shape.
15) Four sleeves 115
each are formed into a square-ring shape.
16) Post-centering clamps 116
each are formed into a waning-moon shape.
17) Tick-preventing downward teeth 117
each are formed into a pyramid shape.
18) Water-discharging grooves 118
each are formed into a half-moon shape.
19) Four post-height-adjusting spring-loaded rockers 119
each are formed into a C shape.
20) Four post-height-adjusting nipples 120
each are formed into a half-moon shape.
21) Four lower posts 121
each are formed into a tubular shape with a square cross-section.
22) Post-height-adjusting holes 122
each are formed into a half-moon shape.
23) Central-innersurface-locking wind-and-smoke-redirecting adjustable-central-canopy system 123 has the combined shapes of its components.
24) Adjustable central canopy 124
is formed into a square shape.
25) Central square post 125
is formed into a tubular shape with a square cross-section.
26) Central-post holes 126
each are formed into a round shape.
27) Central-innersurface-locking double-C-shaped spring 127
is formed into a double-W-shaped shape.
28) Central-innersurface-locking double nipples 128
each are formed into a nipple shape.
29) Central-innersurface-locking adjustable ring 129
is formed into a round-ring shape with a square central hole of multiple square innersurfaces and with multiple surrounding U-shaped truss brackets.
30) Lead-in funnels 130
each are formed into a funnel shape.
31) Two button tunnels 131
each are formed into a cylindrical shape with a body section, a smaller-diameter bottom section, and a smaller-diameter top section.
32) Two buttons 132
each are formed into a cylindrical shape with a body section and a larger-diameter tapered waist section.
33) Foldable adjustable central trusses 133
each are formed into a rectangular-or-oval-tube shape.
34) Wind-and-smoke-redirecting adjustable-surrounding-awning system 134 has the combined shapes of its components.
35) Adjustable surrounding awning 135
is formed into a square-ring shape.
36) Foldable adjustable awning trusses 136
each are formed into a rectangular-or-oval-tube shape.
37) Rotatable awning-truss sleeves 137
each are formed into a rectangular-or-oval-tube shape.
38) Multi-function hook-rope-stake-pulley-wheel system 138 has the combined shapes of its components.
39) Hooks 139
each are formed into a half-moon shape.
40) Rope-and-stake holes 140
each are formed into a round shape.
41) Ropes 141
each are formed into a string shape.
42) Stakes 142
each are formed into a nail shape.
43) Pulley-wheel arms 143
each are formed into a generally rectangular shape.
44) Pulley-wheel axles 144
each are formed into a cylindrical shape.
45) Pulley-wheels 145
each are formed into a pulley shape.

Connection

Referring to FIG. 1A, FIG. 1B, FIG. 1C, FIG. 1D, FIG. 2A, FIG. 2B, FIG. 3, FIG. 4A, FIG. 4B, FIG. 5, FIG. 6A, FIG. 6B, FIG. 7, FIG. 8, FIG. 9, FIG. 10, FIG. 11, FIG. 12, FIG. 13A, FIG. 13B, FIG. 13C, FIG. 14, FIG. 15A, FIG. 15B, FIG. 16A, and FIG. 16B:

1) Post-centering tick-preventing water-discharging foldable wind-and-smoke-redirecting adjustable-ring-canopy system 101 has the combined connections of its components.
2) Adjustable ring canopy 102
is attached to foldable top trusses 107*a*.
3) Central intersector 103
pivotably is bolted to foldable top trusses 107*a*.

4) Intersector holes 104
respectively are molded in central intersector 103,
respectively are molded in four upper corner intersectors 111, and
respectively are molded in four lower corner intersectors 113.
5) Bolts 105
respectively are inserted through intersector holes 104.
6) Nuts 106
respectively are screwed onto bolts 105.
7) Foldable top trusses 107*a*
respectively are attached to said adjustable ring canopy 102 and
respectively and pivotably are bolted to central intersector 103.
Top-truss connectors 107*b*
respectively and pivotably are bolted to foldable top trusses 107*a*.
8) Foldable corner trusses 108
respectively and pivotably are bolted to foldable top trusses 107*a*.
9) Foldable side trusses 109
respectively and pivotably are bolted to one another.
10) Truss holes 110
respectively are drilled into foldable top trusses 107*a*,
respectively are drilled into foldable corner trusses 108,
respectively are drilled into foldable side trusses 109, and
respectively are drilled into foldable adjustable central trusses 133.
11) Four upper corner intersectors 111
respectively and pivotably are bolted to foldable top trusses 107*a* and
respectively and pivotably are bolted to said foldable side trusses 109.
12) Four upper posts 112
respectively are attached to four upper corner intersectors 111.
13) Four lower corner intersectors 113
respectively and pivotably are bolted to said foldable corner trusses 108,
respectively and pivotably are bolted to said foldable side trusses 109, and
respectively and pivotably are slid on four upper posts 112.
14) Four corner-intersector stoppers 114
respectively are attached to four upper posts 112 above four lower corner intersectors 113.
15) Four sleeves 115
respectively are slid on the bottom end of four upper posts 112.
16) Post-centering clamps 116
respectively are molded to four sleeves 115.
17) Tick-preventing downward teeth 117
respectively are molded to four sleeves 115.
18) Water-discharging grooves 118
respectively are molded to four sleeves 115.
19) Four post-height-adjusting spring-loaded rockers 119
respectively are attached to four sleeves 115.
20) Four post-height-adjusting nipples 120
respectively are molded to four post-height-adjusting spring-loaded rockers 119.
21) Four lower posts 121
respectively and slidably are inserted inside four upper posts 112.
22) Post-height-adjusting holes 122
respectively are formed in four upper posts 112 and four lower posts 121.
23) Central-innersurface-locking wind-and-smoke-redirecting adjustable-central-canopy system 123 has the combined connections of its components.
24) Adjustable central canopy 124
is attached to foldable adjustable central trusses 133.
25) Central square post 125
is attached to central intersector 103.
26) Central-post holes 126
respectively are formed in central square post 125.
27) Central-innersurface-locking double-C-shaped spring 127
is inserted inside central square post 125.
28) Central-innersurface-locking double nipples 128
respectively are molded to central-innersurface-locking double-C-shaped spring 127.
29) Central-innersurface-locking adjustable ring 129 adjustably and slidably is locked on and unlocked from central square post 125.
30) Lead-in funnels 130
respectively are molded to one end of central-innersurface-locking adjustable ring 129.
31) Two button tunnels 131
respectively are molded from the outer surface to the inner surface of central-innersurface-locking adjustable ring 129.
32) Two buttons 132
respectively are snapped into two button tunnels 131.
33) Foldable adjustable central trusses 133
respectively and pivotably are bolted to foldable top trusses 107*a*,
respectively are attached to said adjustable central canopy 124, and
respectively and pivotably are bolted to central-innersurface-locking adjustable ring 129.
34) Wind-and-smoke-redirecting adjustable-surrounding-awning system 134 has the combined connections of its components.
35) Adjustable surrounding awning 135
is attached to foldable adjustable awning trusses 136.
36) Foldable adjustable awning trusses 136
respectively and pivotably are bolted to top-truss connectors 107*a* or
respectively and pivotably are bolted to foldable top trusses 107*b*, and
respectively are attached to said adjustable surrounding awning 135.
37) Rotatable awning-truss sleeves 137
respectively and pivotably are attached to four upper posts 112 and
respectively and slidably are slid on said foldable adjustable awning trusses 136.
38) Multi-function hook-rope-stake-pulley-wheel system 138 has the combined connections of its components.
39) Hooks 139
respectively are welded or molded to four lower posts 121.
40) Rope-and-stake holes 140
respectively are formed in hooks 139.
41) Ropes 141
respectively are threaded through at least one of rope-and-stake holes 140 and
respectively are hooked on at least one of four lower posts 121 or hooks 139.
42) Stakes 142
respectively are hammered through rope-and-stake holes 140.

43) Pulley-wheel arms 143
respectively are welded or molded to hooks 139.
44) Pulley-wheel axles 144
respectively are attached to and between pulley-wheel arms 143.
45) Pulley-wheels 145
respectively and rotatably are slid on pulley-wheel axles 144.

Function

Referring to FIG. 17A, FIG. 17B, FIG. 17C, FIG. 18A, FIG. 18B, FIG. 18C, FIG. 19A, FIG. 19B, FIG. 19C, FIG. 19D, FIG. 19E, FIG. 19F, FIG. 19G, FIG. 1911, FIG. 20A, FIG. 20B, FIG. 20C, FIG. 20D, FIG. 20E, FIG. 20F, FIG. 20G, FIG. 2011, FIG. 21A, FIG. 21B, FIG. 21C, FIG. 21D, FIG. 22A, FIG. 22B, FIG. 22C, and FIG. 23:

1 Post-centering tick-preventing water-discharging foldable wind-and-smoke-redirecting adjustable-ring-canopy system 101 is for performing the combined functions of its components.
2) Adjustable ring canopy 102 is for:
a) Providing a cover to protect users from weather elements;
b) Redirecting wind and smoke above adjustable ring canopy 102 into the inside of the adjustable-central-canopy adjustable-surround-canopy adjustable-awning single-central-innersurface-square-lock popup;
c) Redirecting wind and smoke to flow out and away from under the adjustable-central-canopy adjustable-surround-canopy adjustable-awning single-central-innersurface-square-lock popup; and
d) Allowing light to shine into the inside of the adjustable-central-canopy adjustable-surround-canopy adjustable-awning single-central-innersurface-square-lock popup.
3) Central intersector 103 is for:
Foldably attaching to foldable top trusses 107*a*.
4) Intersector holes 104 respectively are for:
Screwing bolts 105 therethrough.
5) Bolts 105 respectively are for:
Attaching central intersector 103, foldable top trusses 107*a*, top-truss connectors 107*b*, foldable corner trusses 108, foldable side trusses 109, four upper corner intersectors 111, four lower corner intersectors 113, central-innersurface-locking adjustable ring 129, and foldable adjustable central trusses 133 together.
6) Nuts 106 respectively are for:
Securing bolts 105.
7) Foldable top trusses 107*a* respectively are for:
Supporting central intersector 103.
Top-truss connectors 107*b* respectively are for:
Pivotably coupling foldable top trusses 107*a*.
8) Foldable corner trusses 108 respectively are for:
Pivotably supporting foldable top trusses 107*a*.
9) Foldable side trusses 109 respectively are for:
Supporting foldable top trusses 107*a*.
10) Truss holes 110 respectively are for:
Inserting bolts 105 therethrough.
11) Four upper corner intersectors 111 respectively are for:
Attaching foldable top trusses 107*a*, foldable corner trusses 108, and foldable side trusses 109 to four upper posts 112.
12) Four upper posts 112 respectively are for:
Slidably sliding over four lower posts 121.
13) Four lower corner intersectors 113 respectively are for:
Slidably attaching foldable side trusses 109 to four upper posts 112.
14) Four corner-intersector stoppers 114 respectively are for:
Preventing four lower corner intersectors 113 from sliding upward.
15) Four sleeves 115 respectively are for:
Preventing four upper posts 112 and four lower posts 121 from scratching each other.
16) Post-centering clamps 116 respectively are for:
Centering four lower posts 121 inside four upper posts 112
(see FIG. 17A and FIG. 17B).
17) Tick-preventing downward teeth 117 respectively are for:
Preventing ticks from getting inside four upper posts 112 and four lower posts 121
(see FIG. 17C).
18) Water-discharging grooves 118 respectively are for:
Allowing water to discharge out of four upper posts 112 and four lower posts 121 in the directions of arrows 146 (see FIG. 17C).
19) Four post-height-adjusting spring-loaded rockers 119 respectively are for:
Pushing four post-height-adjusting nipples 120 into post-height-adjusting holes 122 to secure four upper posts 112 to four lower posts 121.
20) Four post-height-adjusting nipples 120 respectively are for:
Snap-locking into post-height-adjusting holes 122 to secure four upper posts 112 to four lower posts 121.
21) Four lower posts 121 respectively are for:
Adjusting the height of the adjustable-central-canopy adjustable-surround-canopy adjustable-awning single-central-innersurface-square-lock popup.
22) Post-height-adjusting holes 122 respectively are for:
Allowing four post-height-adjusting nipples 120 to snap-lock threrethrough to secure four upper posts 112 to four lower posts 121.
23) Central-innersurface-locking wind-and-smoke-redirecting adjustable-central-canopy system 123 is for performing the combined functions of its components.
24) Adjustable central canopy 124 is for:
a) Covering the center of the adjustable-central-canopy adjustable-surround-canopy adjustable-awning single-central-innersurface-square-lock popup;
b) Redirecting wind and smoke above adjustable ring canopy 102 into the inside the adjustable-central-canopy adjustable-surround-canopy adjustable-awning single-central-innersurface-square-lock popup;
c) Redirecting wind and smoke to flow out and away from under the adjustable-central-canopy adjustable-surround-canopy adjustable-awning single-central-innersurface-square-lock popup; and
d) Allowing light to shine into the inside of the adjustable-central-canopy adjustable-surround-canopy adjustable-awning single-central-innersurface-square-lock popup.
25) Central square post 125 is for:
a) Locking central-innersurface-locking adjustable ring 129 thereon;
b) Preventing the adjustable-central-canopy adjustable-surround-canopy adjustable-awning single-central-innersurface-square-lock popup from radially twisting clockwise out of its desired shape;
c) Preventing the adjustable-central-canopy adjustable-surround-canopy adjustable-awning single-central-innersurface-square-lock popup from radially twisting counterclockwise out of its desired shape; and d) Reinforcing the adjustable-central-canopy adjustable-surround-canopy adjustable-awning single-central nnersurface-square-lock popup with its square cross-section.

26) Central-post holes 126 respectively are for:
Allowing central-innersurface-locking double nipples 128 to snap-lock therein to secure central square post 125 to central-innersurface-locking adjustable ring 129 and foldable adjustable central trusses 133.

27) Central-innersurface-locking double-C-shaped spring 127 is for:
Pushing central-innersurface-locking double nipples 128 into central-post holes 126.

28) Central-innersurface-locking double nipples 128 respectively are for:
a) Snap-locking into and out of central-innersurface-locking adjustable ring 129
in the opposite directions of arrows 147*a*, 147*b*, 147*c*, and 147*d* when central-innersurface-locking adjustable ring 129 slides up and down central square post 125
in the opposite directions of arrows 148*a* and 148*b* (see FIG. 18A, FIG. 18B, and FIG. 18C);
b) Locking and unlocking central square post 125 central-innersurface-locking double nipples 128 to and from central-innersurface-locking adjustable ring 129 and foldable adjustable central trusses 133
on the same plane 149*a* or 149*b*
(see FIG. 18A, FIG. 18B, and FIG. 18C);
c) Adjusting the height of adjustable central canopy 124, to raise and lower adjustable central canopy 124
to open and close the opening between adjustable central canopy 124 and adjustable ring canopy 102
in the opposite directions of arrows 150*a* and 150*b*
(see FIG. 19A, FIG. 19B, FIG. 19C, and FIG. 19D)
to raise and lower adjustable central canopy 124;
d) Adjusting the height of adjustable surrounding awning 135,
to raise and lower adjustable surrounding awning 135
in the opposite directions of arrows 151*a* and 151*b*
(see FIG. 19A, FIG. 19B, FIG. 19C, and FIG. 19D);
e) Locking and unlocking the adjustable-central-canopy adjustable-surround-canopy adjustable-awning single-central-innersurface-square-lock popup after the single-central-innersurface-square-lock popup is folded or unfolded.

Figure 16B:
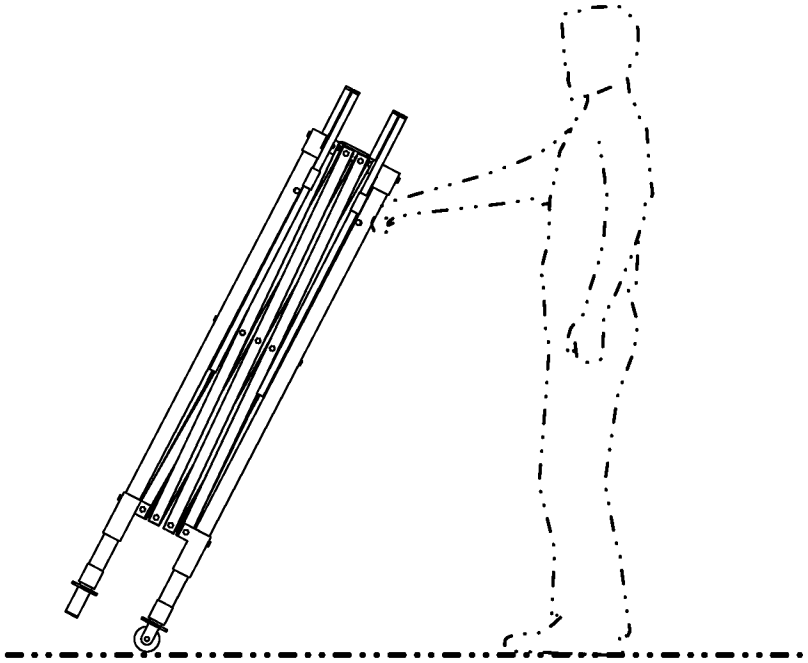
FIG. 16A and FIG. 16B illustrate front views of the adjustable-central-canopy adjustable-ring-canopy adjustable-surrounding awning single-central-innersurface-square-lock popup when folded and rolled away for transportation and storage.
Figure 16A:
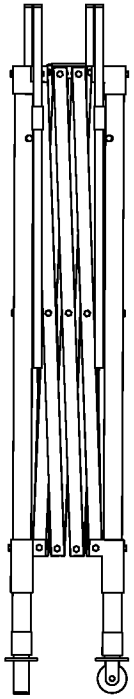
Figure 17A:
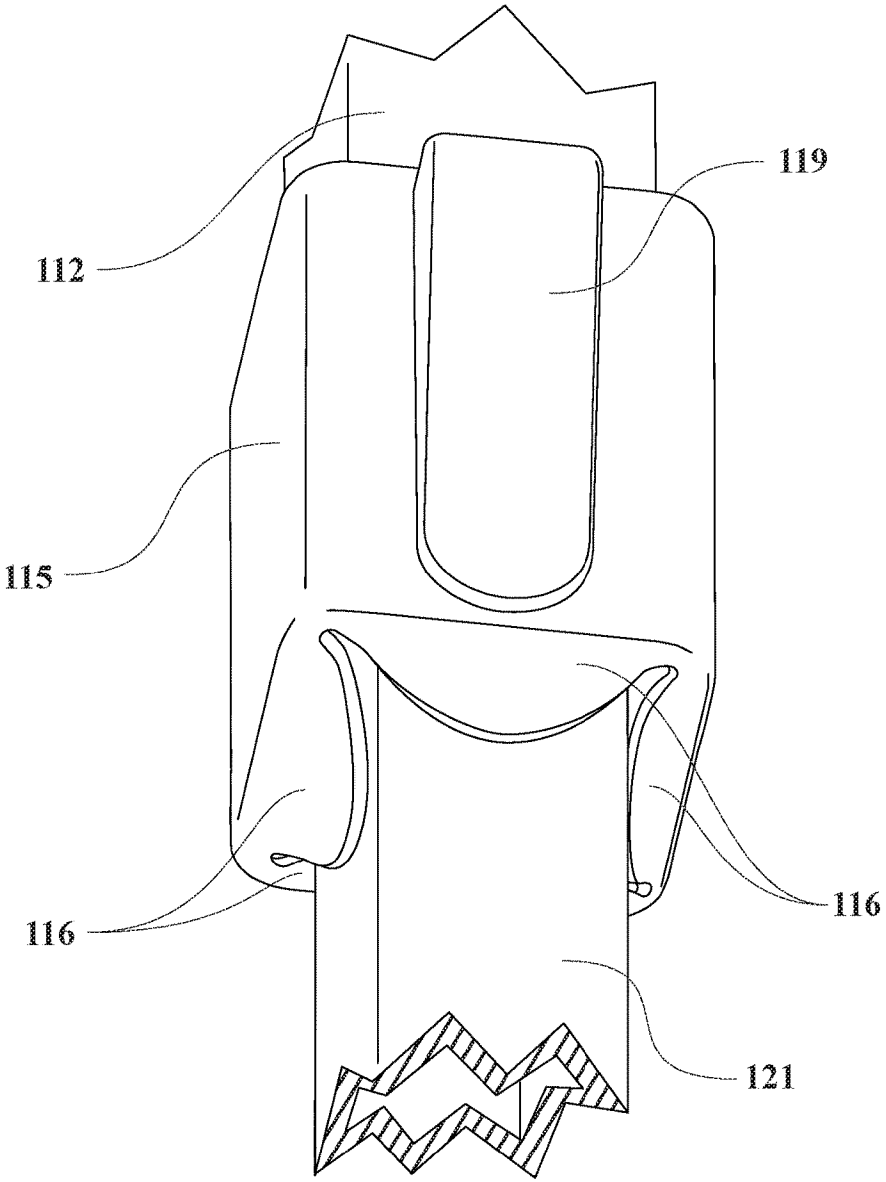
FIG. 17A, FIG. 17B, and FIG. 17C illustrate perspective and cross-sectional views of post-centering clamps 116, tick-preventing downward teeth 117, and water-discharging grooves 118.
Figure 17B:
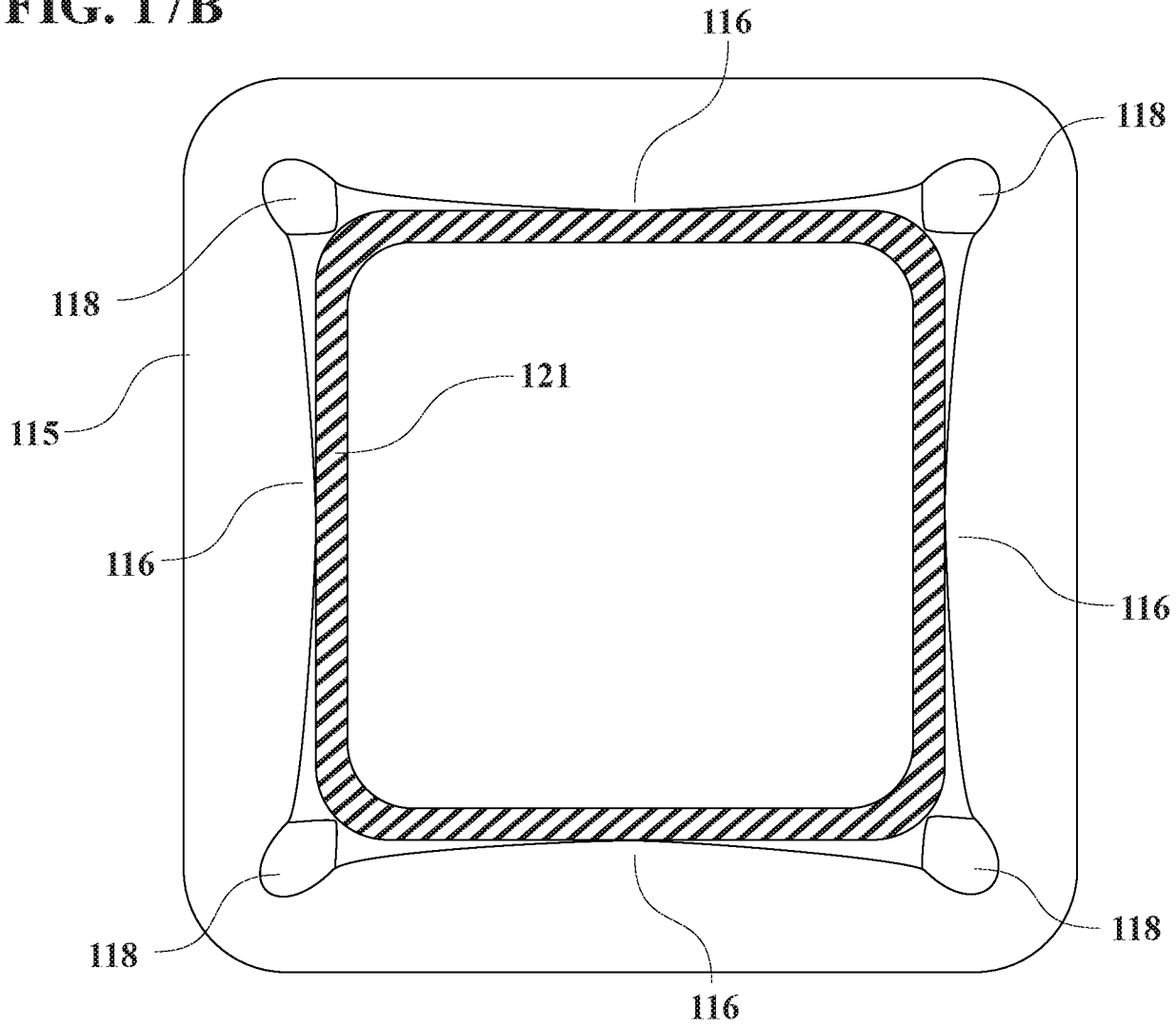
Figure 17C:
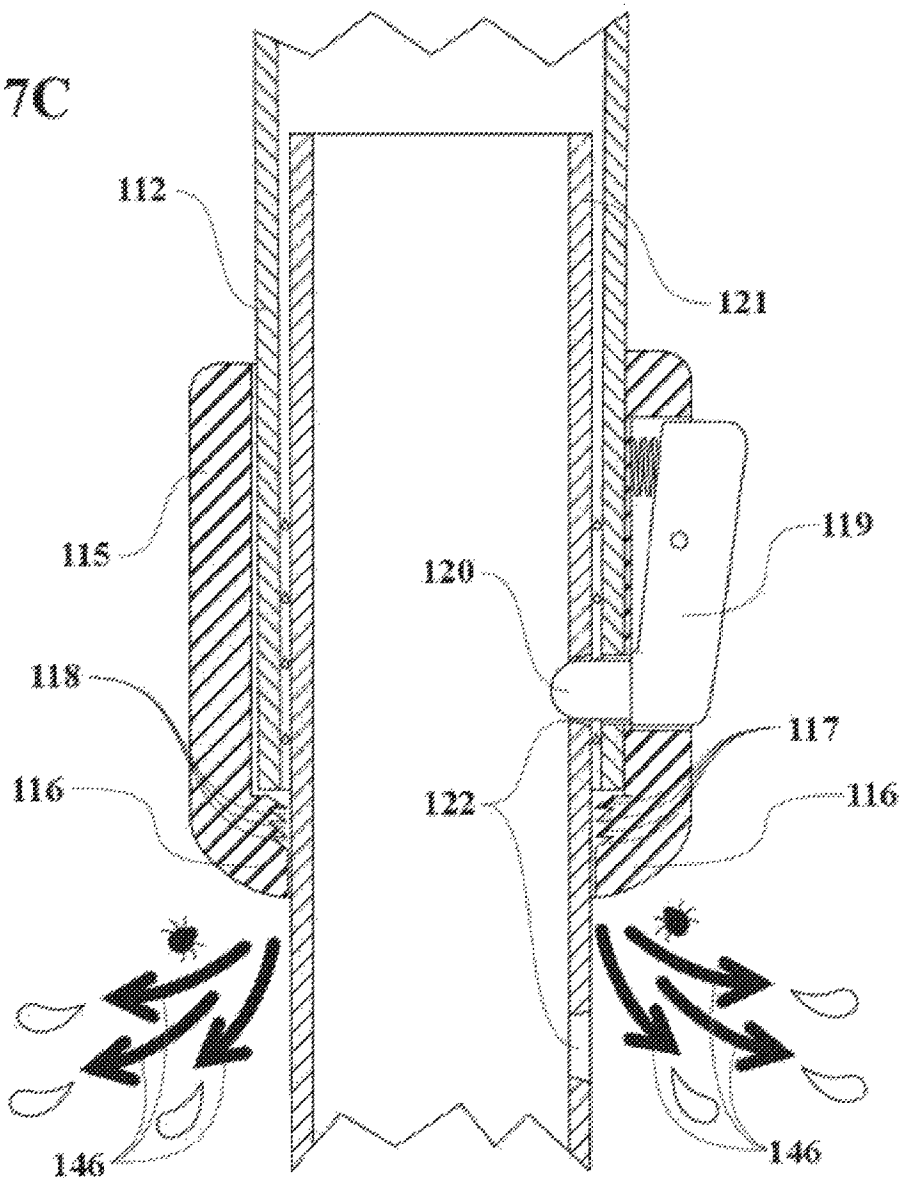
Figure 18A:
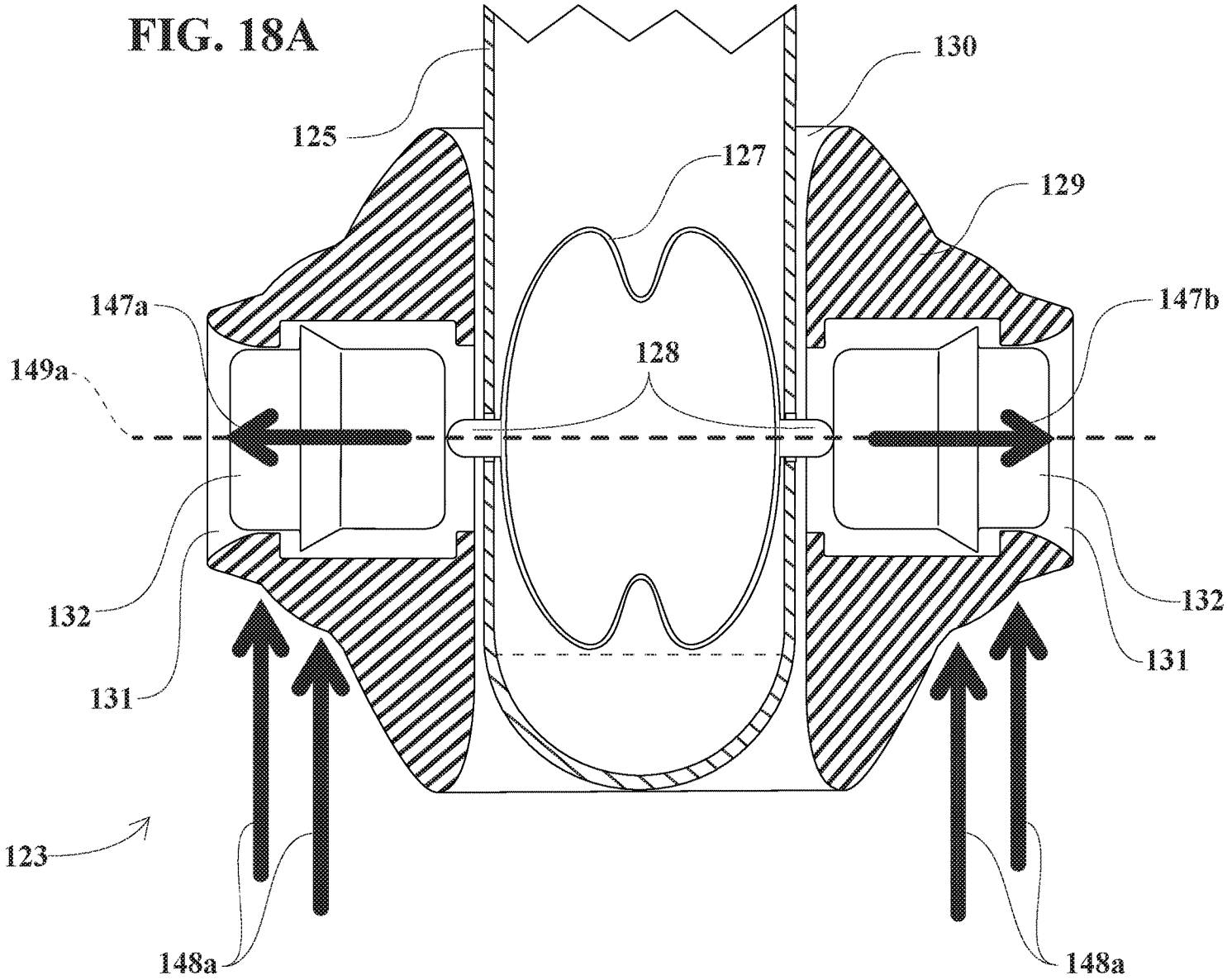
FIG. 18A, FIG. 18B, and FIG. 18C illustrate cross-sectional views of how to adjustably lock central-innersurface-locking adjustable ring 129 at multiple different elevations.
Figure 18B:
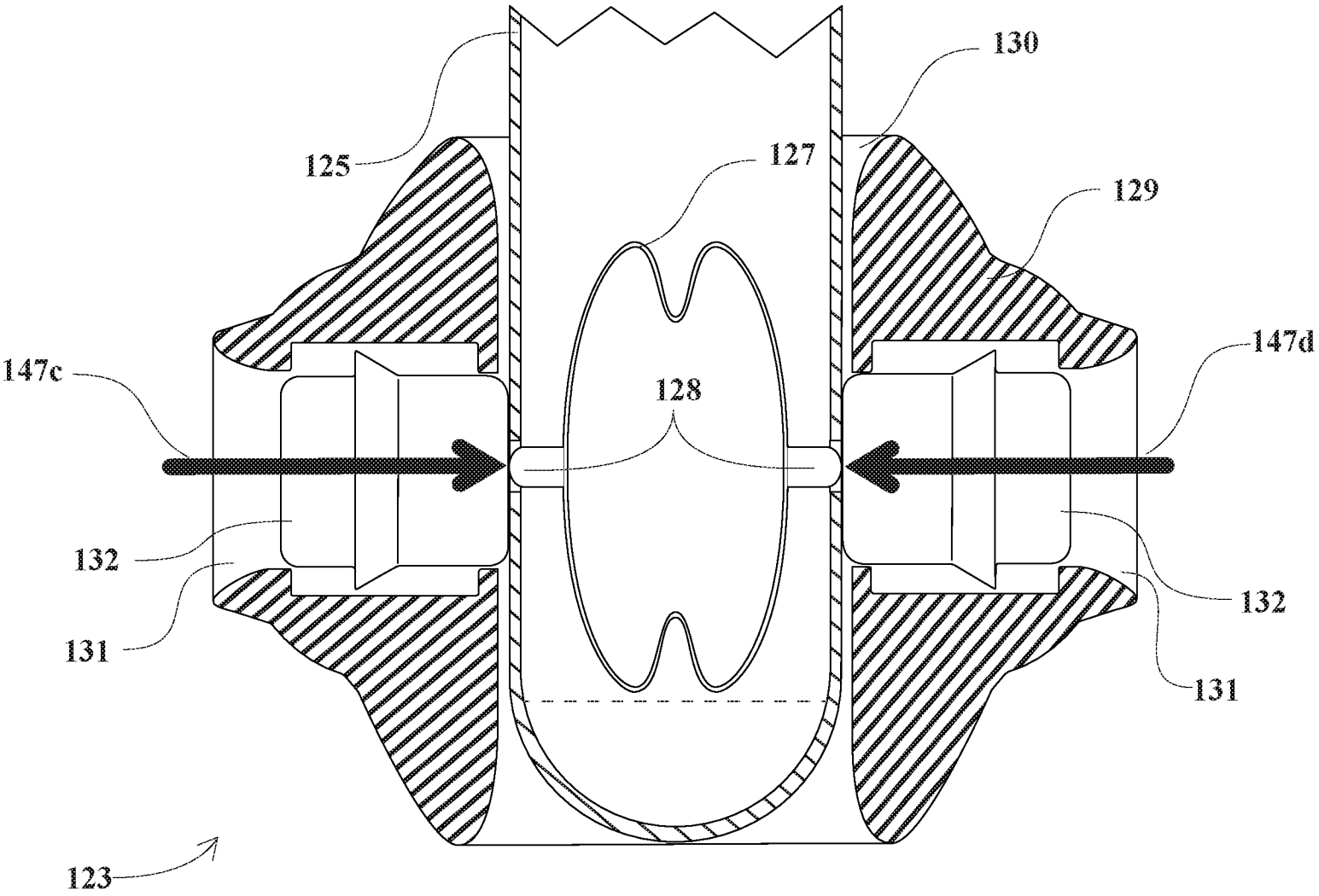
Figure 18C:
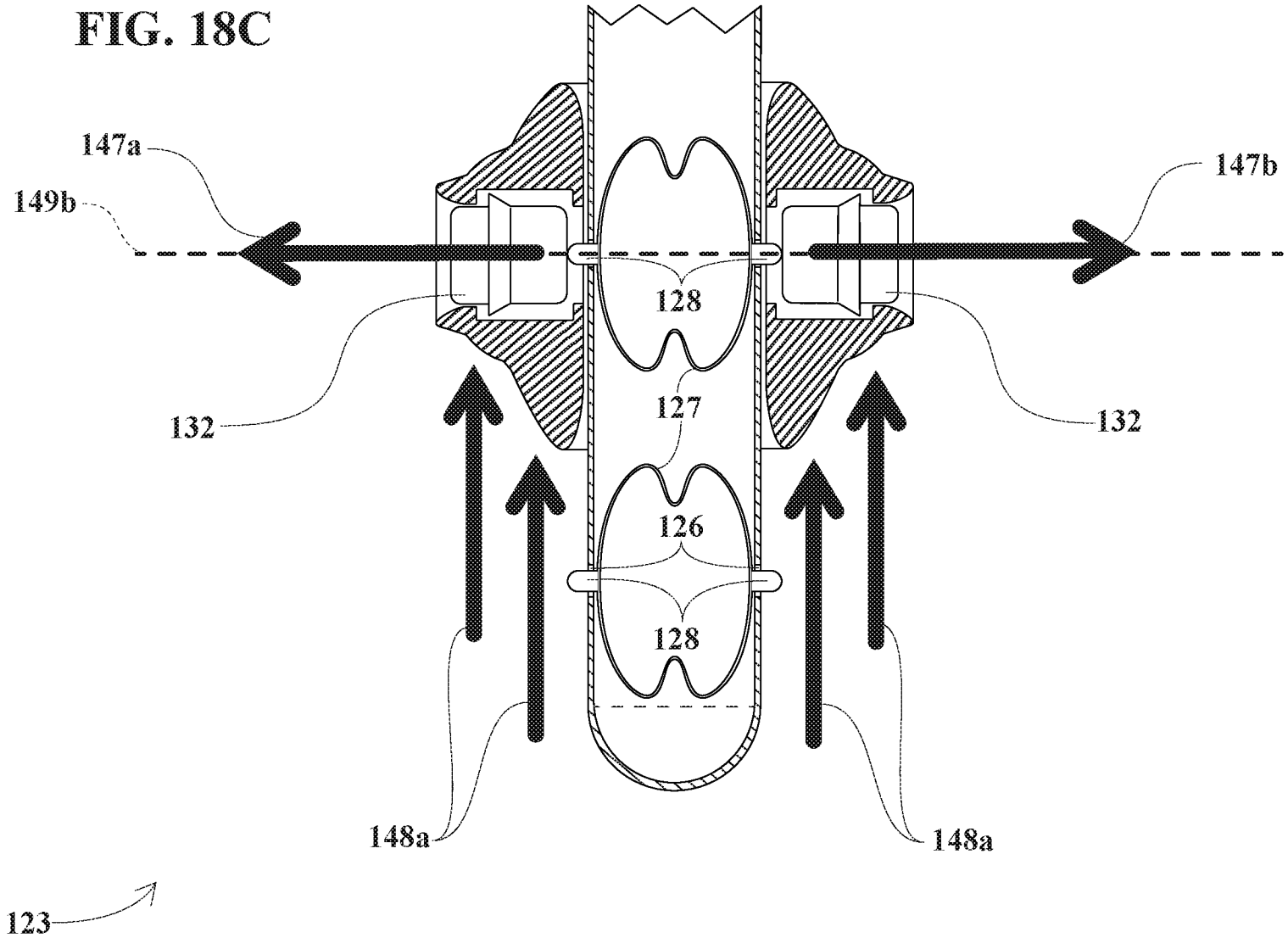
Figure 19B:
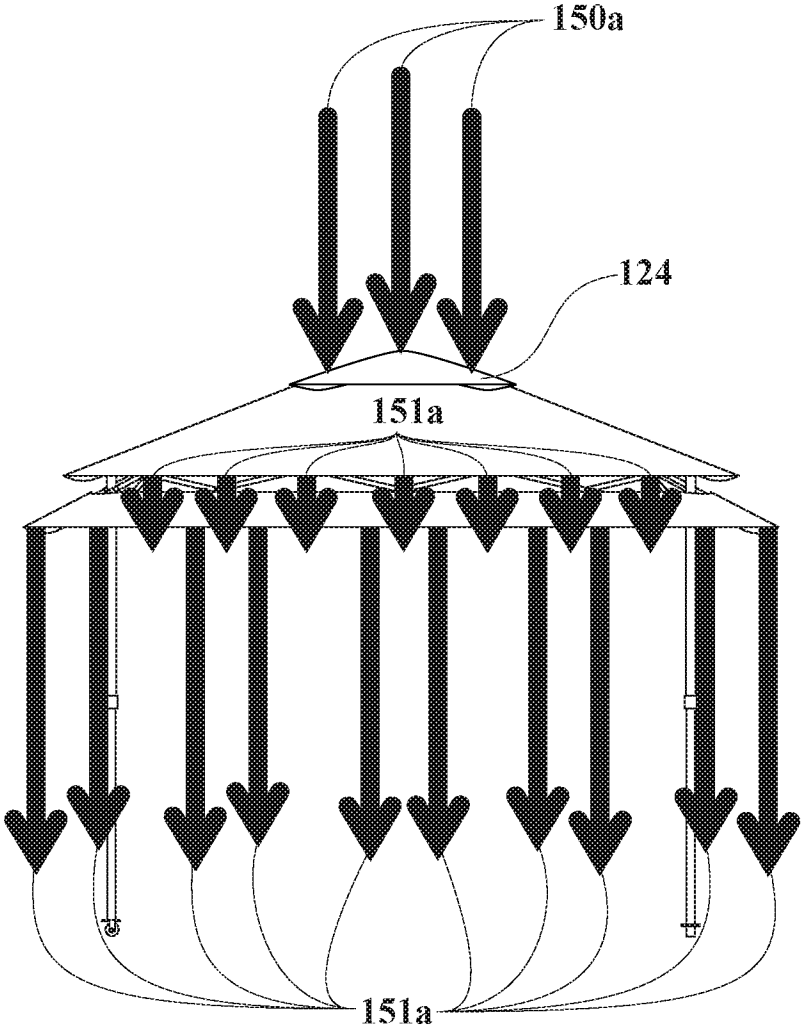
FIG. 19A, FIG. 19B, FIG. 19C, and FIG. 19D illustrate cross-sectional and front views of how to adjustably lock the central-innersurface-locking wind-and-smoke-redirecting adjustable-central-canopy system 123 at open and closed positions.
Figure 19A:
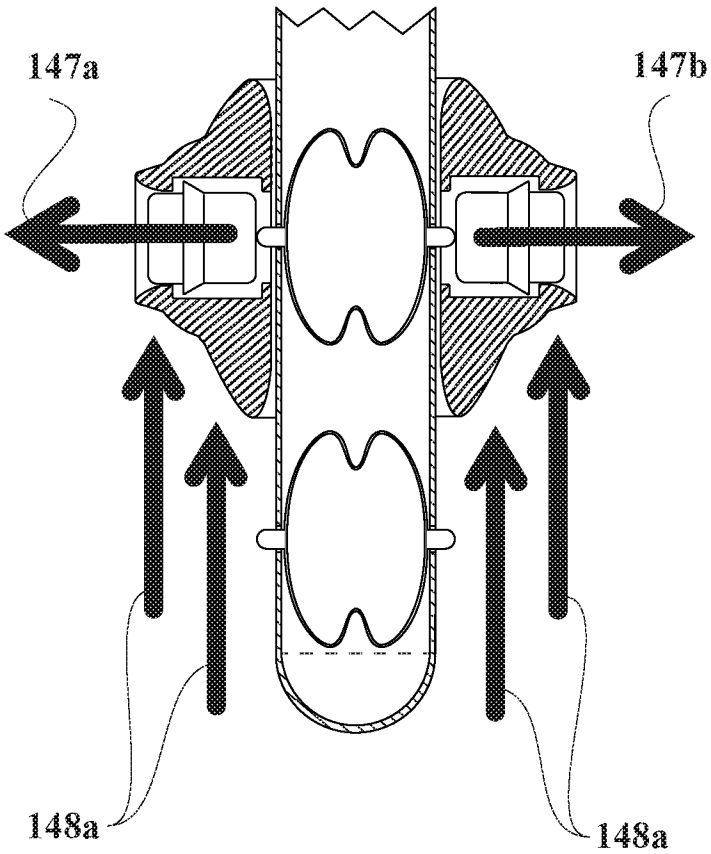
Figure 19D:
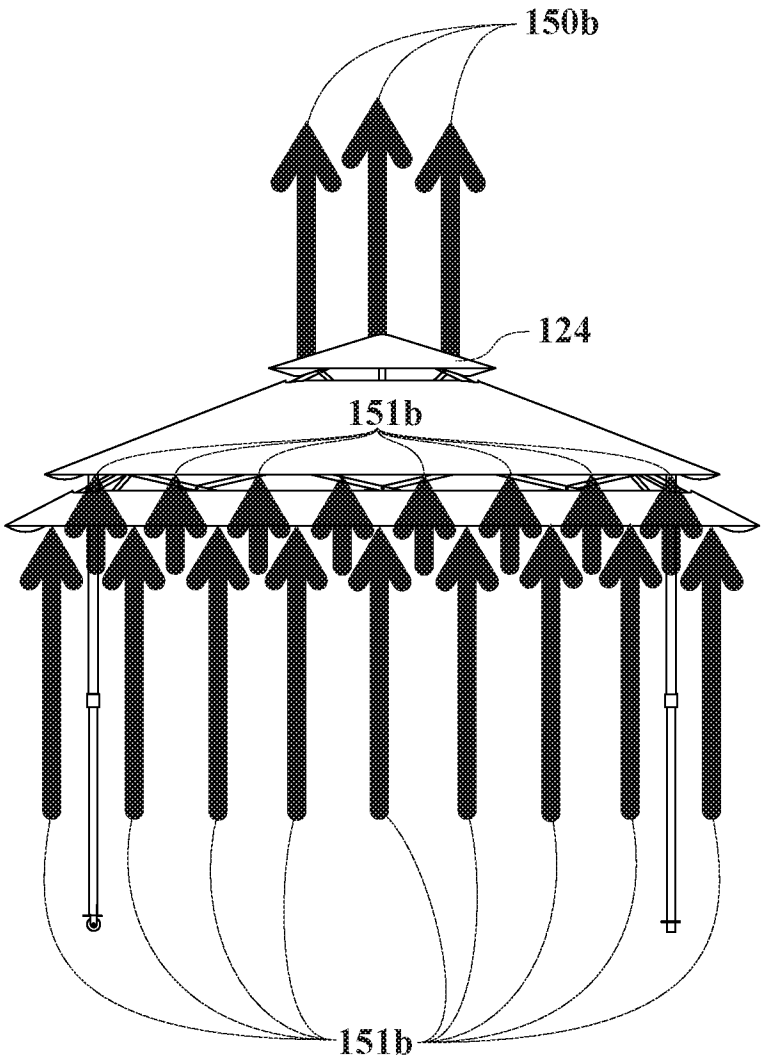
Figure 19C:
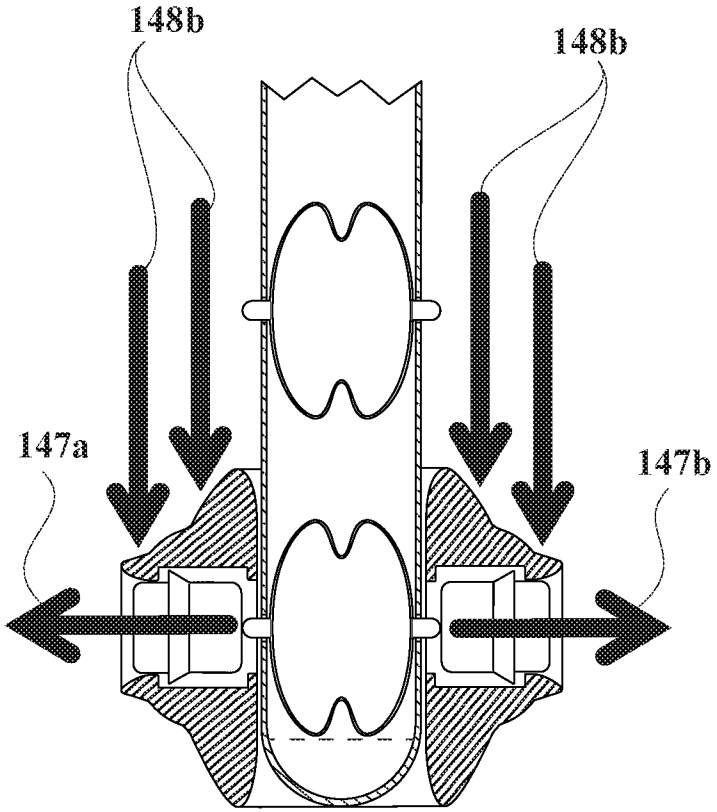
Figure 19E:
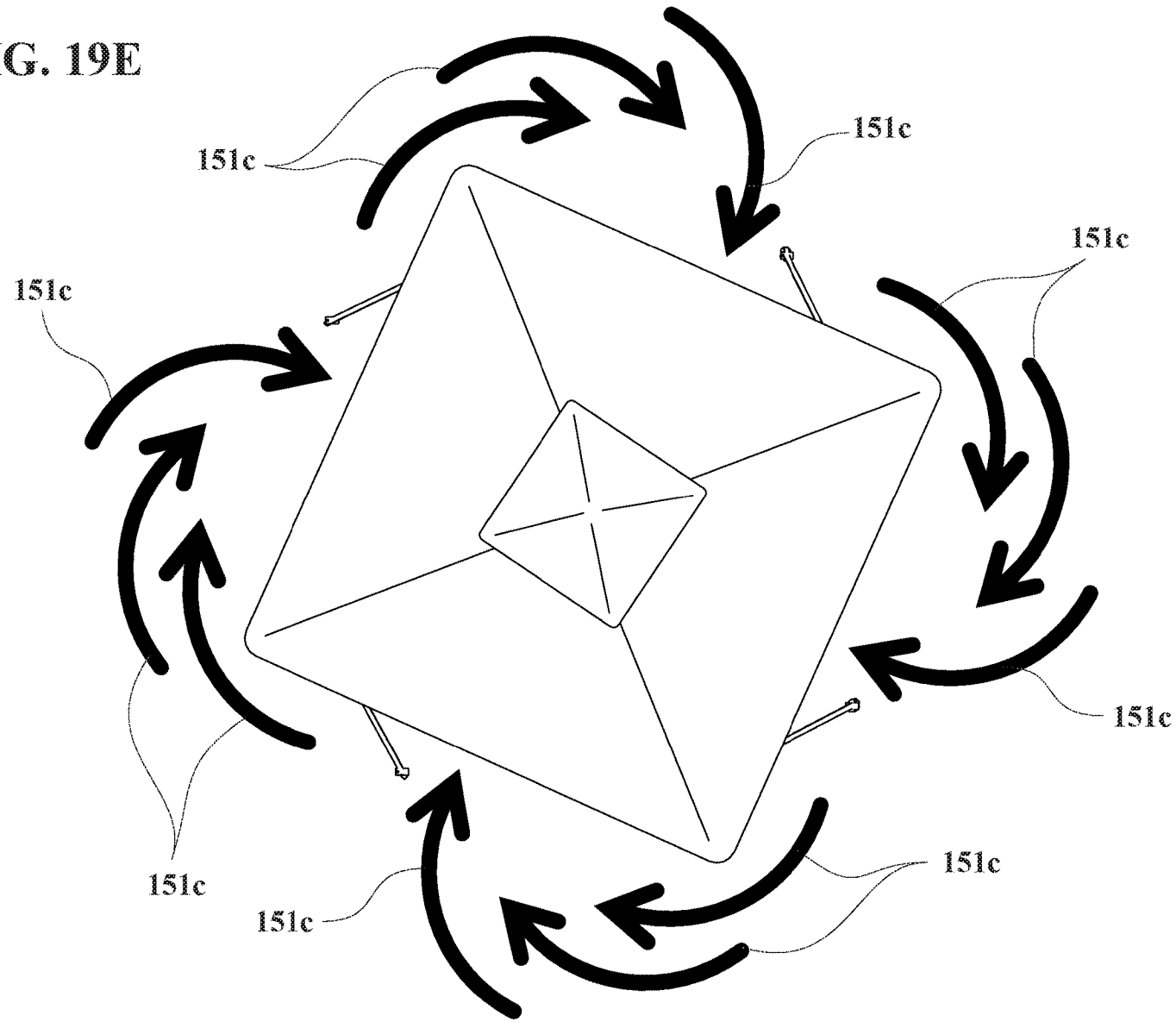
FIG. 19E, FIG. 19F, FIG. 19G, and FIG. 19H illustrate top views of how the central square post 125 prevents the adjustable-central-canopy adjustable-ring-canopy adjustable-surrounding awning single-central-innersurface-square-lock popup from radially twisting out of its desired shape clockwise or counterclockwise.
Figure 19F:
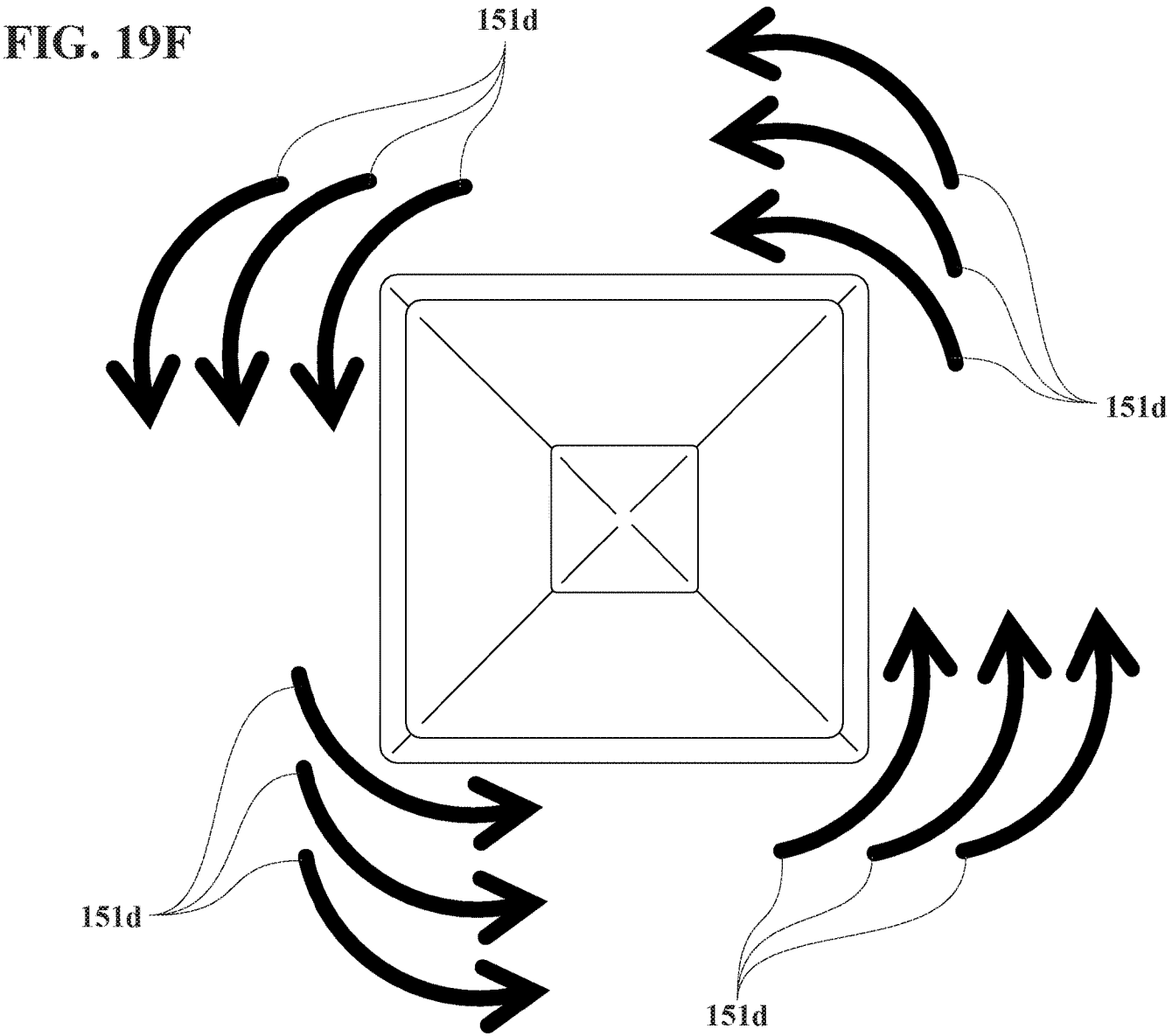
Figure 19G:
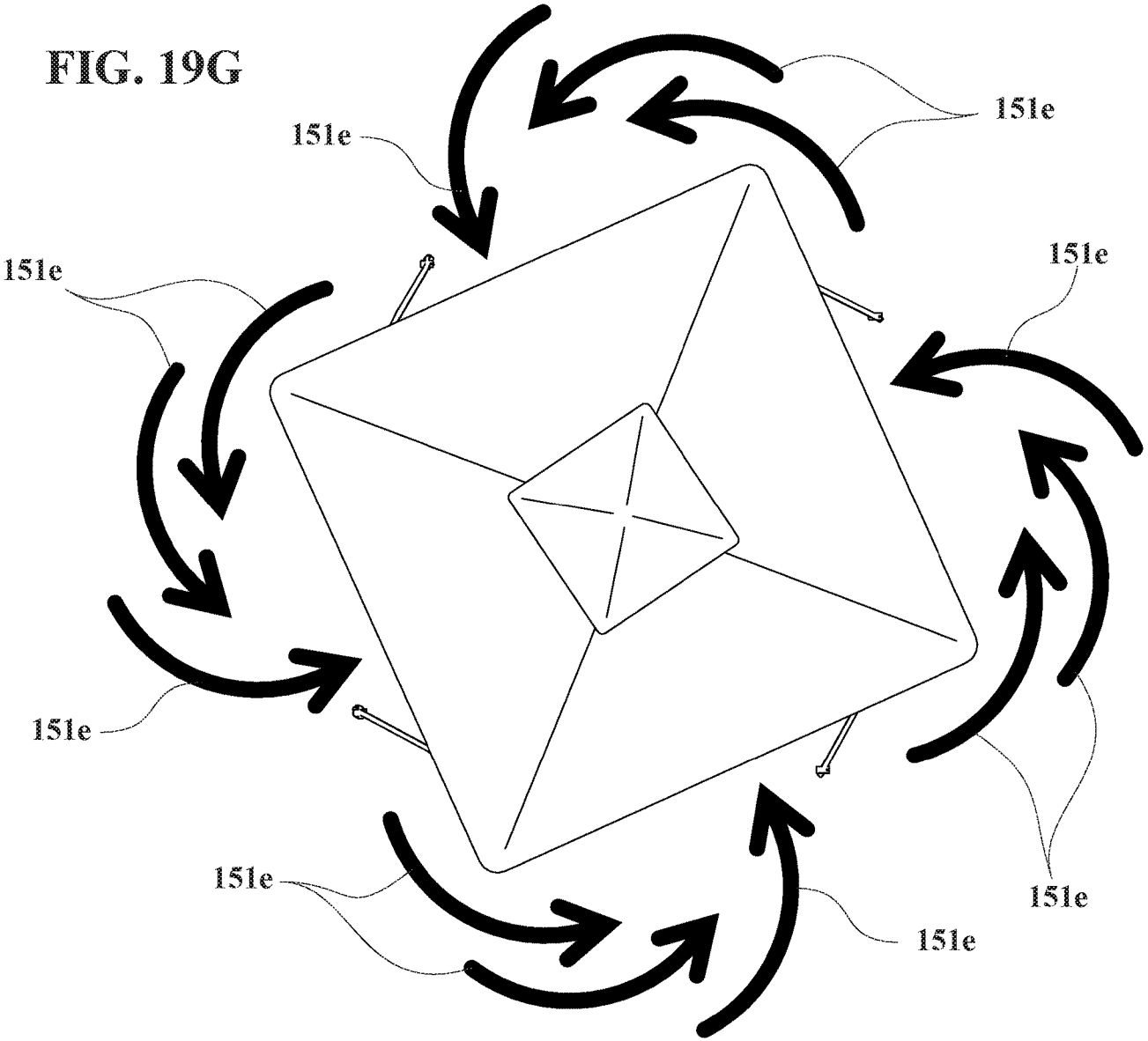
Figure 19H:
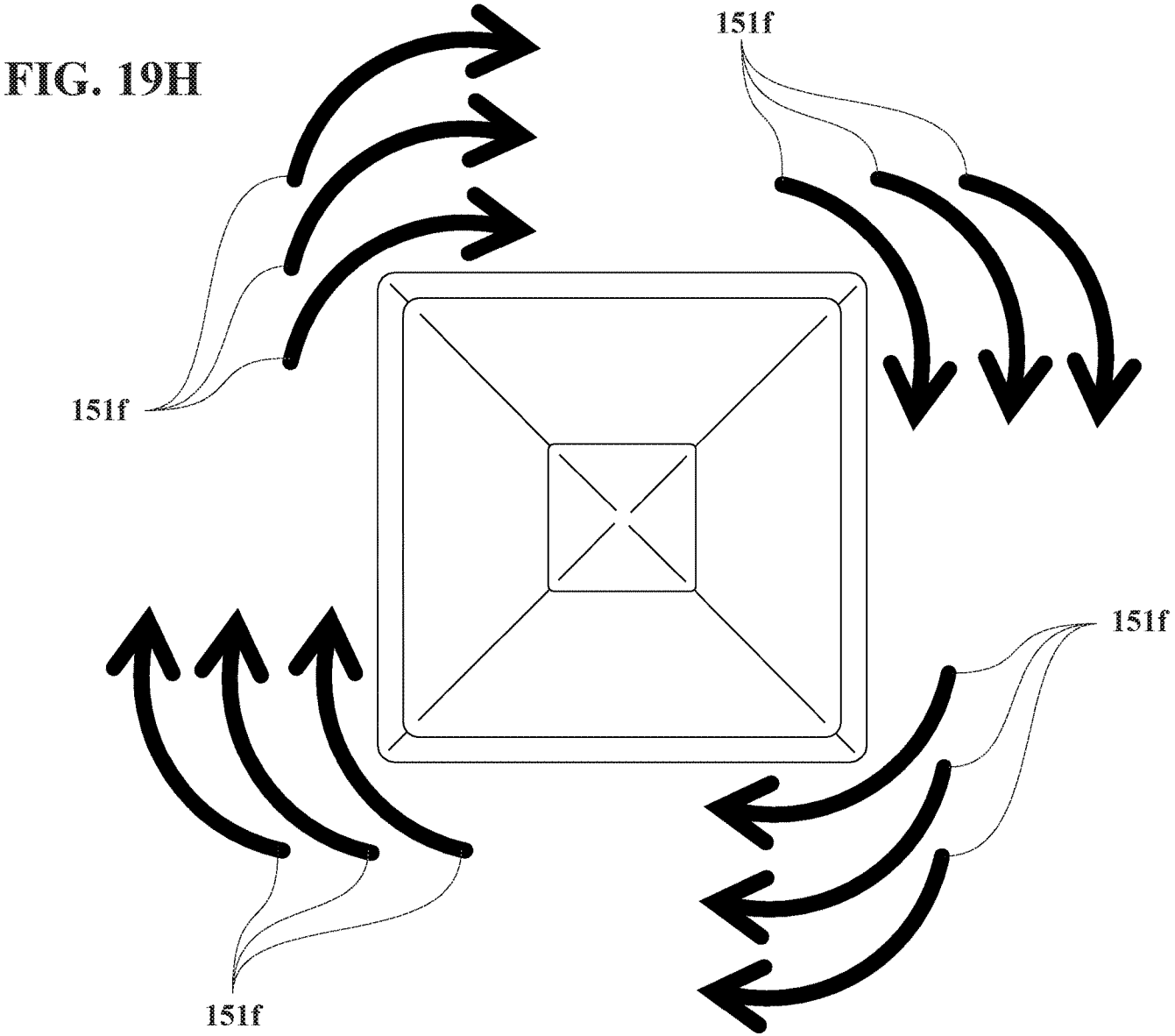

29) Central-innersurface-locking adjustable ring 129 is for:
a) Snap-locking on and off central-innersurface-locking double nipples 128
in the opposite directions of arrows 147*a*, 147*b*, 147*c*, and 147*d* when central-innersurface-locking adjustable ring 129 slides up and down central square post 125
in the opposite directions of arrows 148*a* and 148*b*
(see FIG. 18A, FIG. 18B, and FIG. 18C);
b) Locking and unlocking central square post 125 and central-innersurface-locking double nipples 128 to and from central-innersurface-locking adjustable ring 129 and foldable adjustable central trusses 133
on the same plane 149*a* or 149*b*
(see FIG. 18A, FIG. 18B, and FIG. 18C);
c) Adjusting the height of adjustable central canopy 124, to raise and lower adjustable central canopy 124
to open and close the opening between adjustable central canopy 124 and adjustable ring canopy 102
in the opposite directions of arrows 150*a* and 150*b*
(see FIG. 19A, FIG. 19B, FIG. 19C, and FIG. 19D);
d) Adjusting the height of adjustable surrounding awning 135,
to raise and lower adjustable surrounding awning 135
in the opposite directions of arrows 151*a* and 151*b*
(see FIG. 19A, FIG. 19B, FIG. 19C, and FIG. 19D);
e) Adjusting the height of adjustable ring canopy 102, to raise and lower adjustable ring canopy 102
in the opposite directions of arrows 151*a* and 151*b*
(see FIG. 19A, FIG. 19B, FIG. 19C, and FIG. 19D);
f) Preventing the adjustable-central-canopy adjustable-surround-canopy adjustable awning single-central-innersurface-square-lock popup from radially twisting clockwise and counterclockwise out of its desired shape
in the directions of arrows 151*c*, 151*d*, 151*e*, and 151*f*
(see FIG. 19E, FIG. 19F, FIG. 19G, and FIG. 19H);
g) Locking and unlocking the adjustable-central-canopy adjustable-surround-canopy adjustable-awning single-central-innersurface-square-lock popup
after the single-central-innersurface-square-lock popup is folded or unfolded
(see FIG. 1A, FIG. 16A, and FIG. 16B).

30) Lead-in funnels 130 respectively are for:
Leading central-innersurface-locking double nipples 128 onto the inner surface of central-innersurface-locking adjustable ring 129.

31) Two button tunnels 131 respectively are for:
Housing two buttons 132.

32) Two buttons 132 respectively are for:
Pushing central-innersurface-locking double nipples 128 out of two button tunnels 131.

33) Foldable adjustable central trusses 133 respectively are for:
a) Adjusting the height of adjustable central canopy 124 to raise and lower adjustable central canopy 124;
b) Opening and closing the opening between adjustable central canopy 124 and adjustable ring canopy 102
in the opposite directions of arrows 150*a* and 150*b*
(see FIG. 19A, FIG. 19B, FIG. 19C, and FIG. 19D); and
c) Folding and unfolding adjustable central canopy 124.

34) Wind-and-smoke-redirecting adjustable-surrounding-awning system 134 is for performing the combined functions of its components.

35) Adjustable surrounding awning 135 is for:
a) Covering the surrounding areas of the adjustable-central-canopy adjustable-surround-canopy adjustable-awning single-central-innersurface-square-lock popup;
b) Redirecting wind and smoke under adjustable ring canopy 102 into the inside of the adjustable-central-canopy adjustable-surround-canopy adjustable-awning single-central nnersurface-square-lock popup;
c) Redirecting wind and smoke to flow out and away from under the adjustable-central-canopy adjustable-surround-canopy adjustable-awning single-central-innersurface-square-lock popup; and
d) Allowing light to shine into the inside of the adjustable-central-canopy adjustable-surround-canopy adjustable-awning single-central nnersurface-square-lock popup.

36) Foldable adjustable awning trusses 136 respectively are for:
a) Adjusting the height of adjustable surrounding awning 135
to raise and lower adjustable surrounding awning 135
in the opposite directions of arrows 151*a* and 151*b*
(see FIG. 19A, FIG. 19B, FIG. 19C, and FIG. 19D); and b) Folding and unfolding adjustable surrounding awning 135.

Figure 20A:
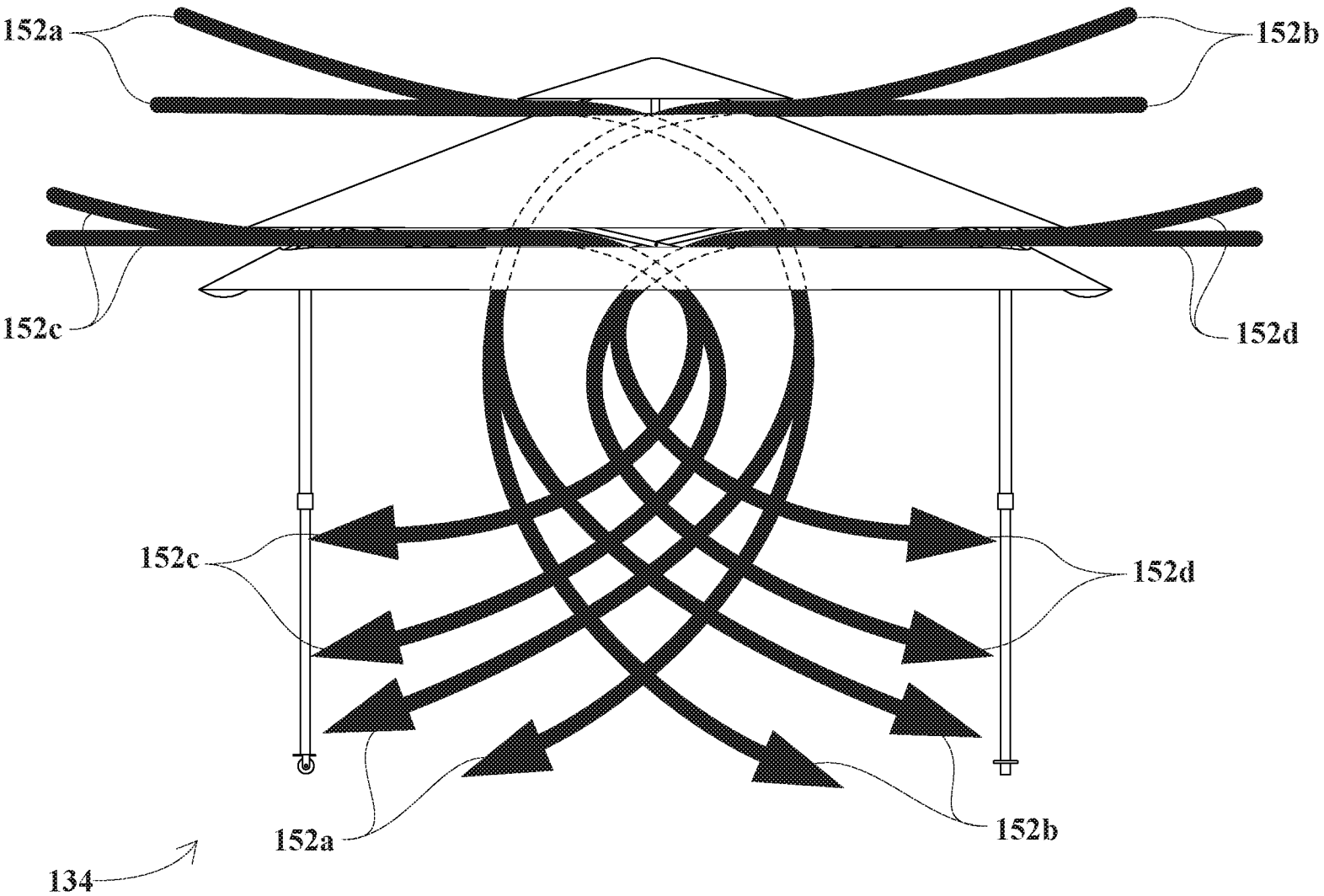
FIG. 20A, FIG. 20B, FIG. 20C, FIG. 20D, FIG. 20E, FIG. 20F, FIG. 20G, and FIG. 20H illustrate front and perspective views of how to redirect wind and smoke using the post-centering tick-preventing water-discharging wind-and-smoke-redirecting ring-canopy system 101, the central-innersurface-locking wind-and-smoke-redirecting adjustable-central-canopy system 123, and the Wind-and-smoke-redirecting surrounding-awning system 134.
Figure 20B:
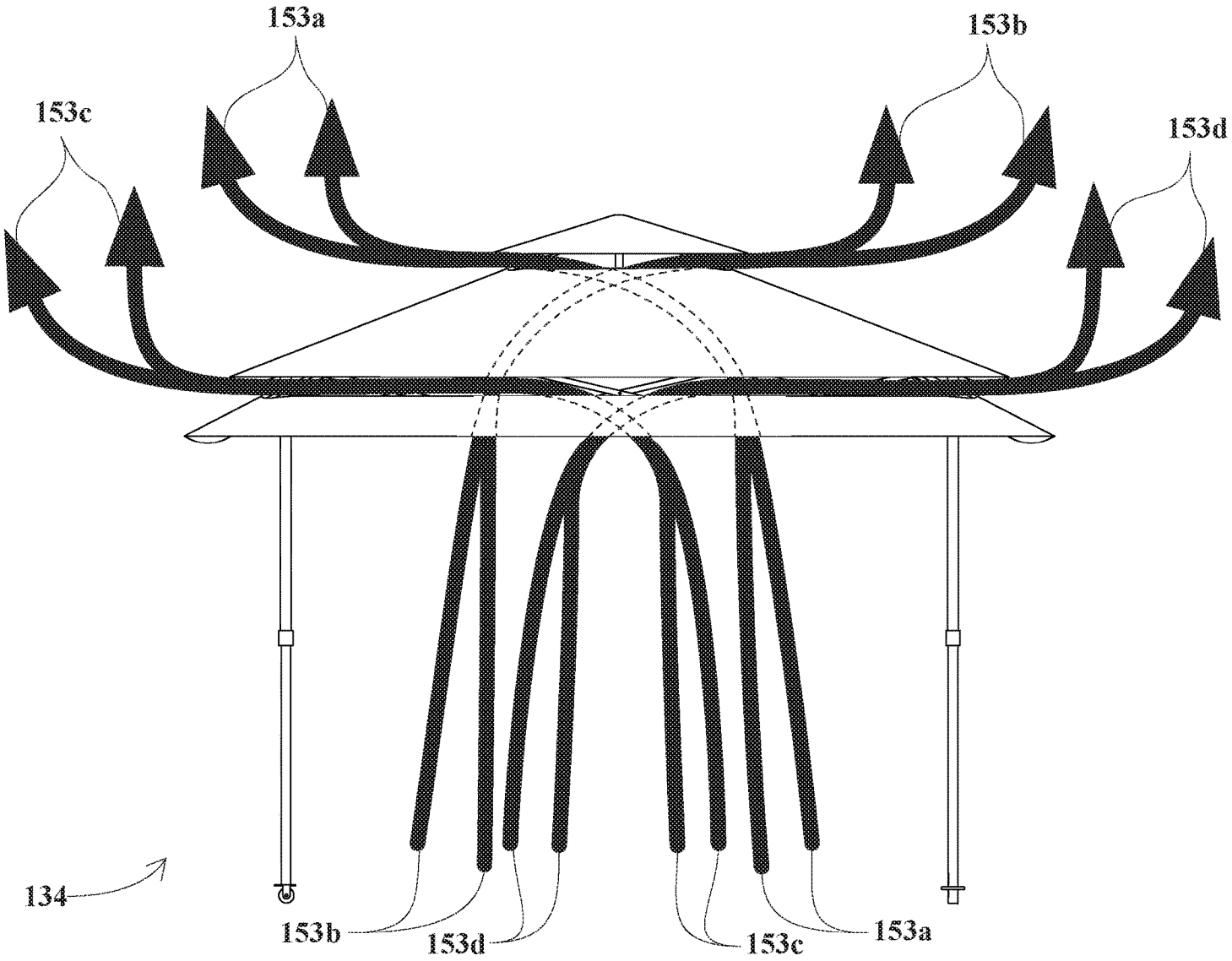
Figure 20C:
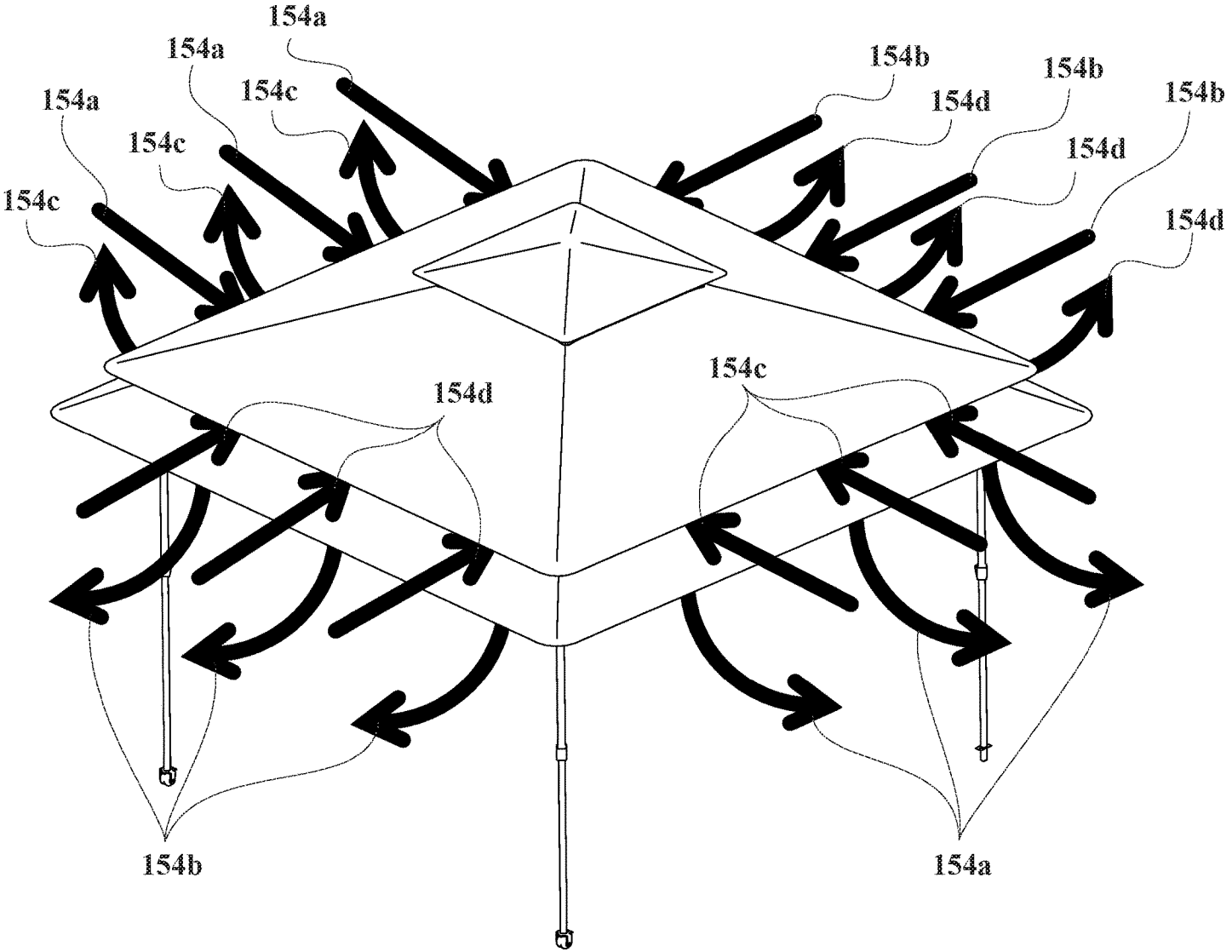
Figure 20D:
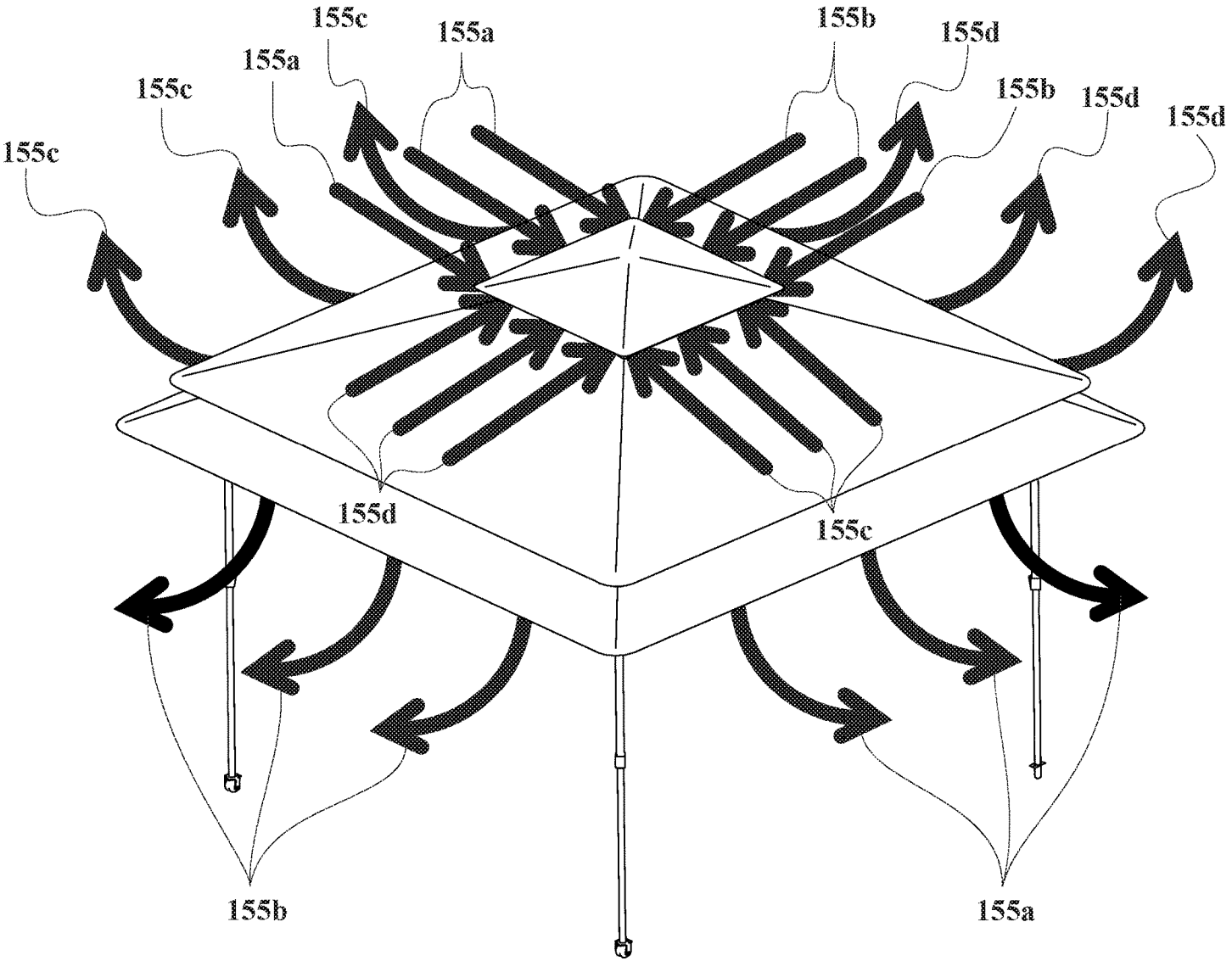
Figure 20E:
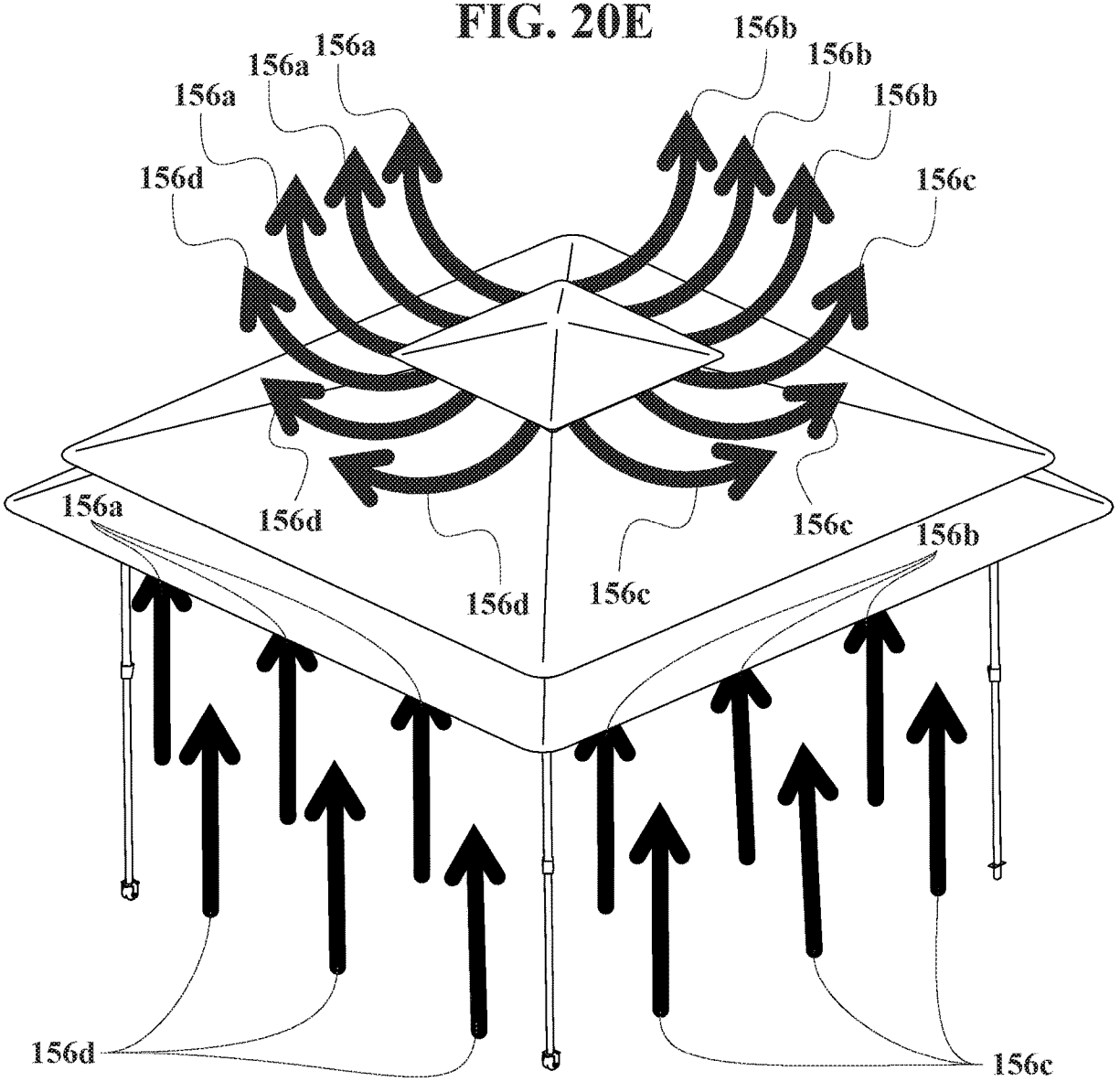
Figure 20F:
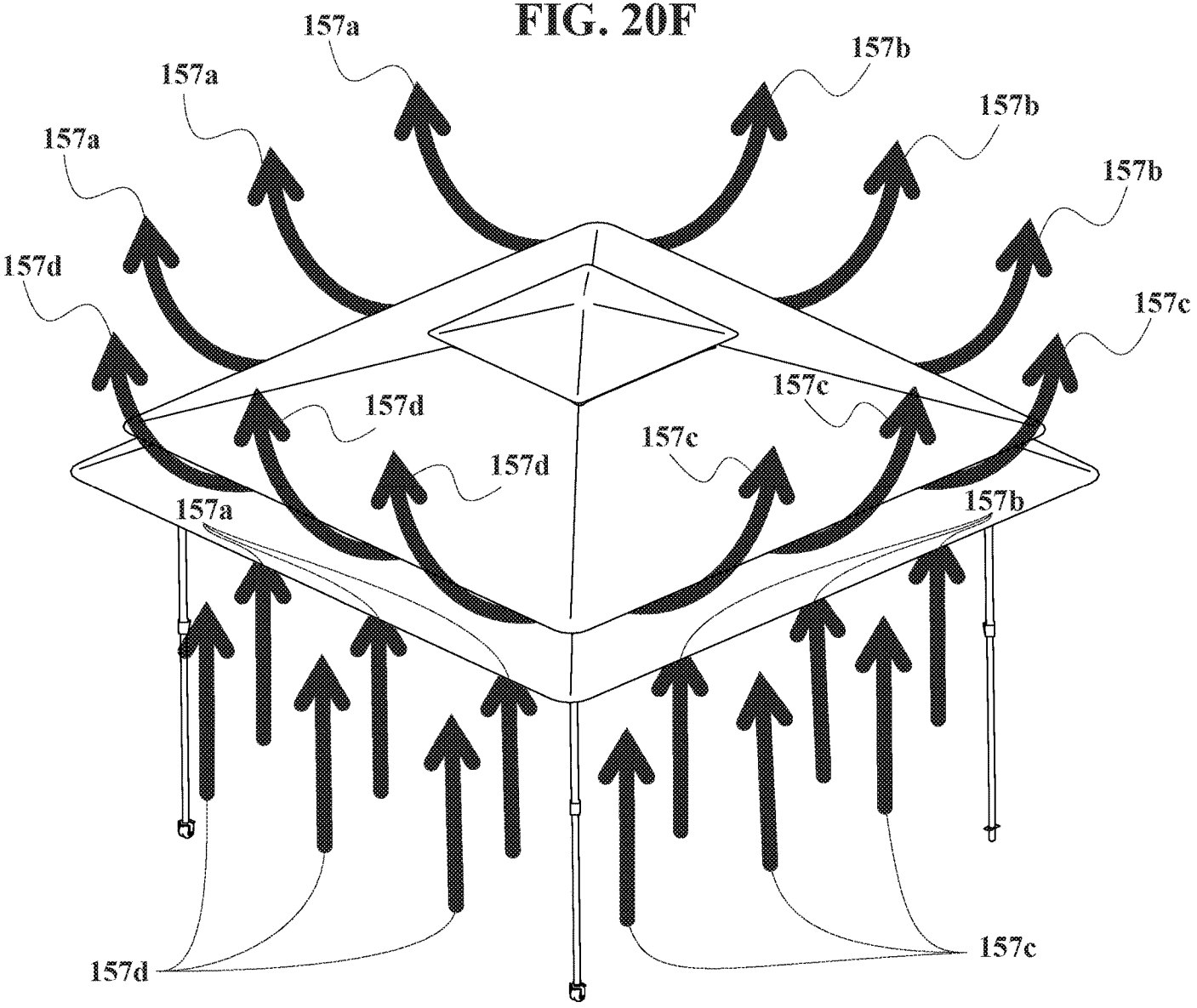
Figure 20G:
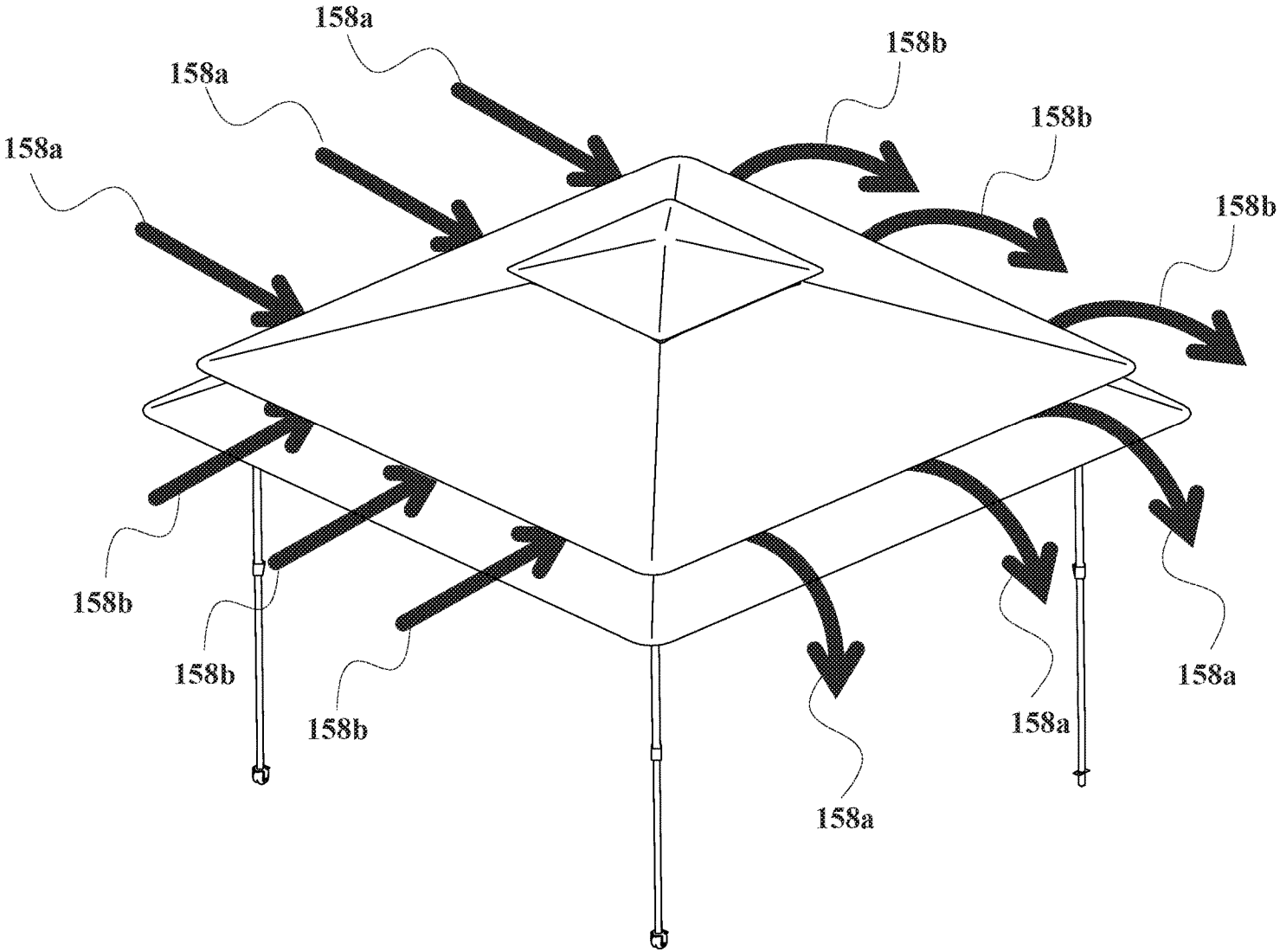
Figure 20H:
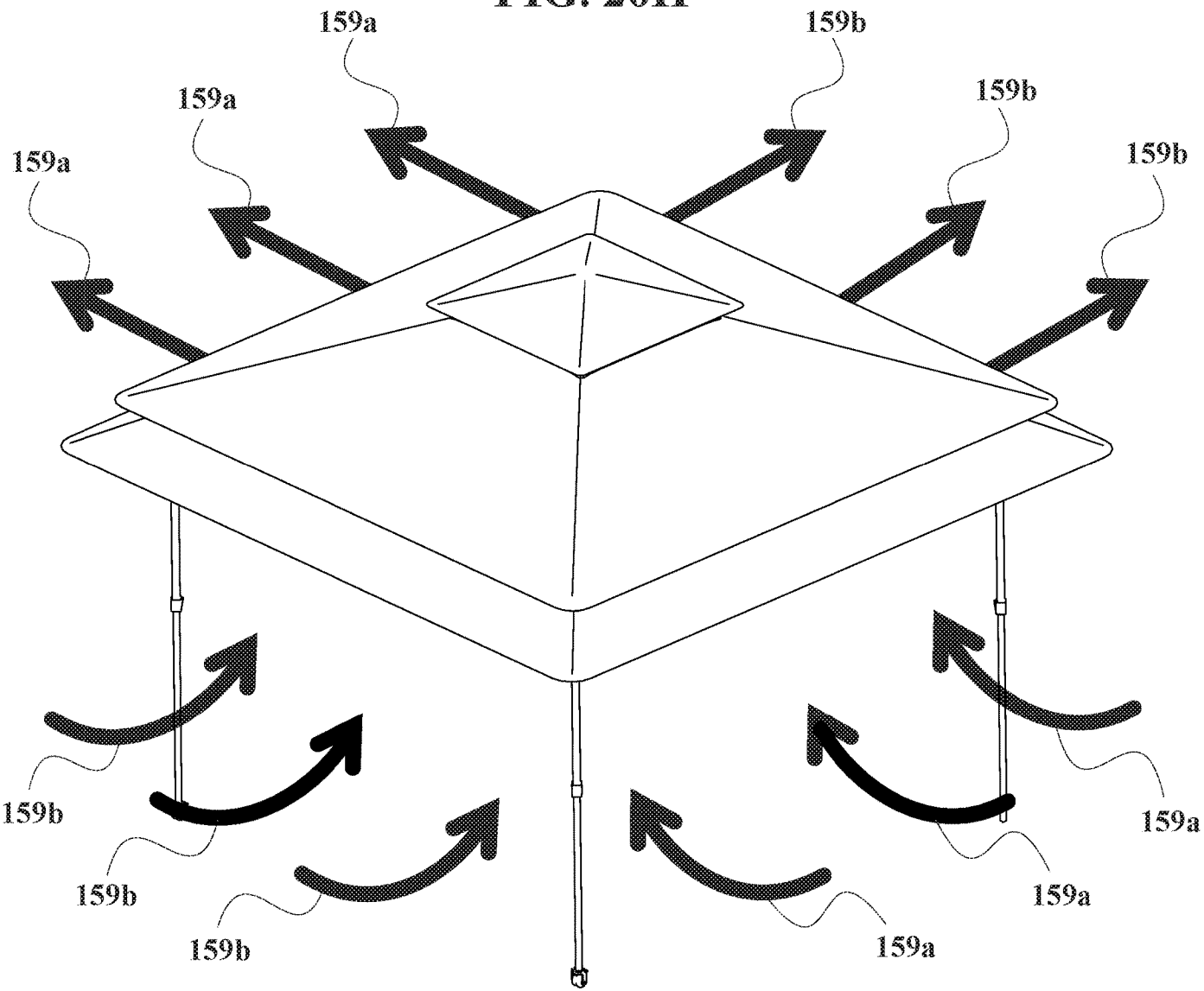
Figure 21B:
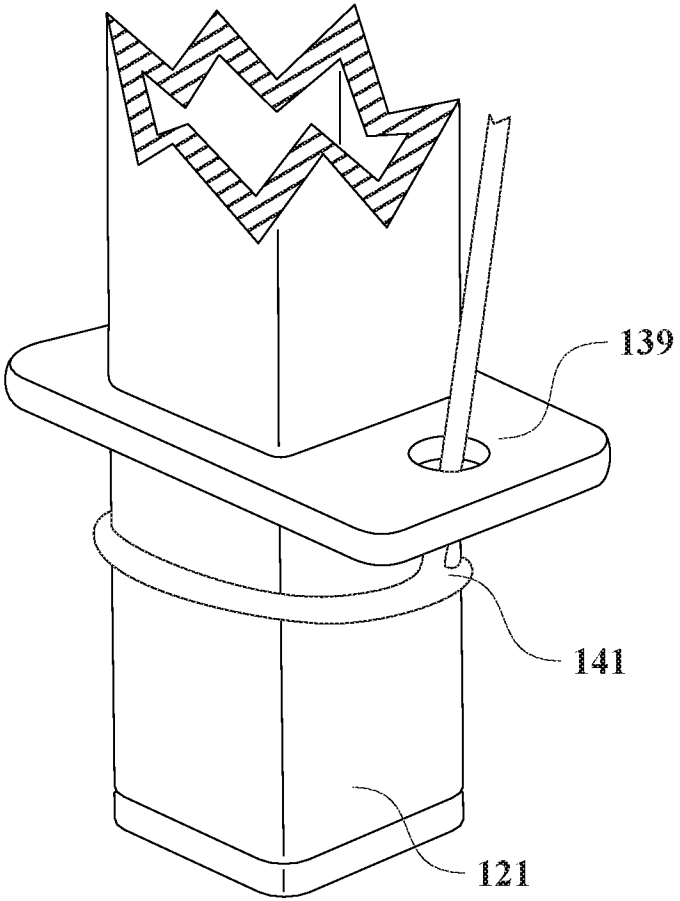
FIG. 21A, FIG. 21B, FIG. 21C, and FIG. 21D illustrate perspective and side views of how ropes 141 hook on and interact with hooks 139, four lower posts 121, and pulley-wheels 145.
Figure 21A:
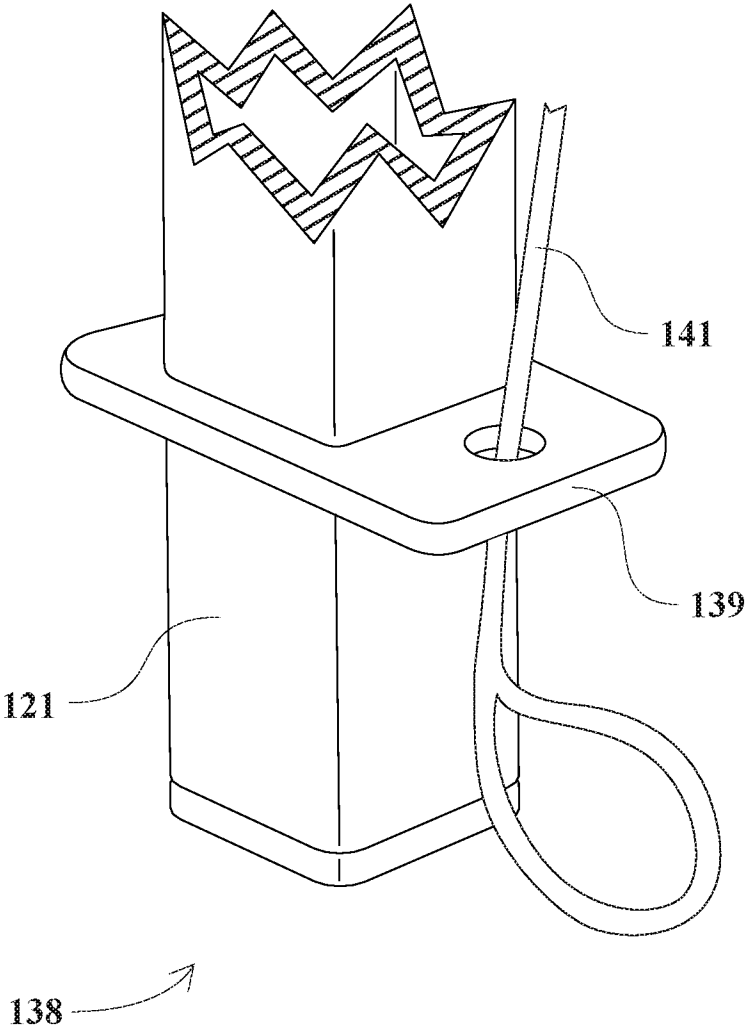
Figure 21D:
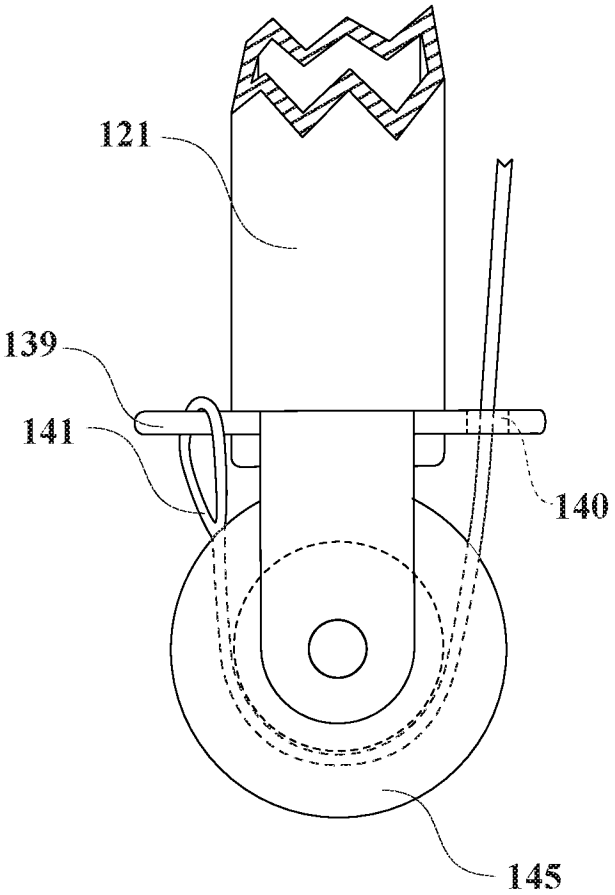
Figure 21C:
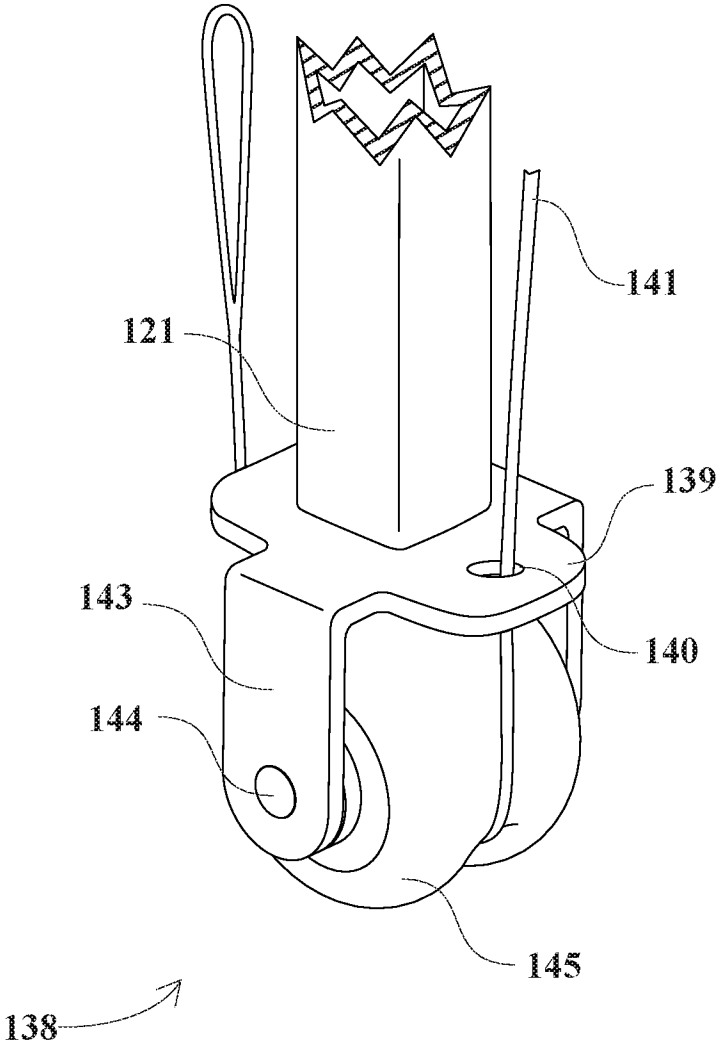
Figure 22B:
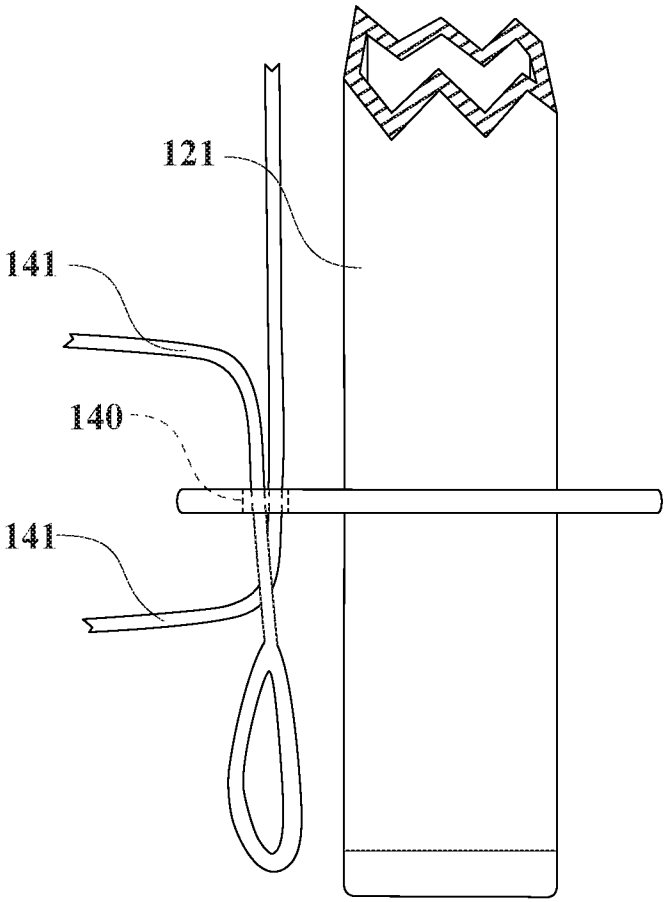
FIG. 22A, FIG. 22B, FIG. 22C, and FIG. 23 illustrate front and perspective views of how ropes 141 hook on and interact with hooks 139, four lower posts 121, and pulley-wheels 145 to prevent four lower posts 121 from spreading outwards (for example, when there is heavy snow sitting on top the adjustable-central-canopy adjustable-ring-canopy adjustable-surrounding awning single-central-innersurface-square-lock popup).
Figure 22A:
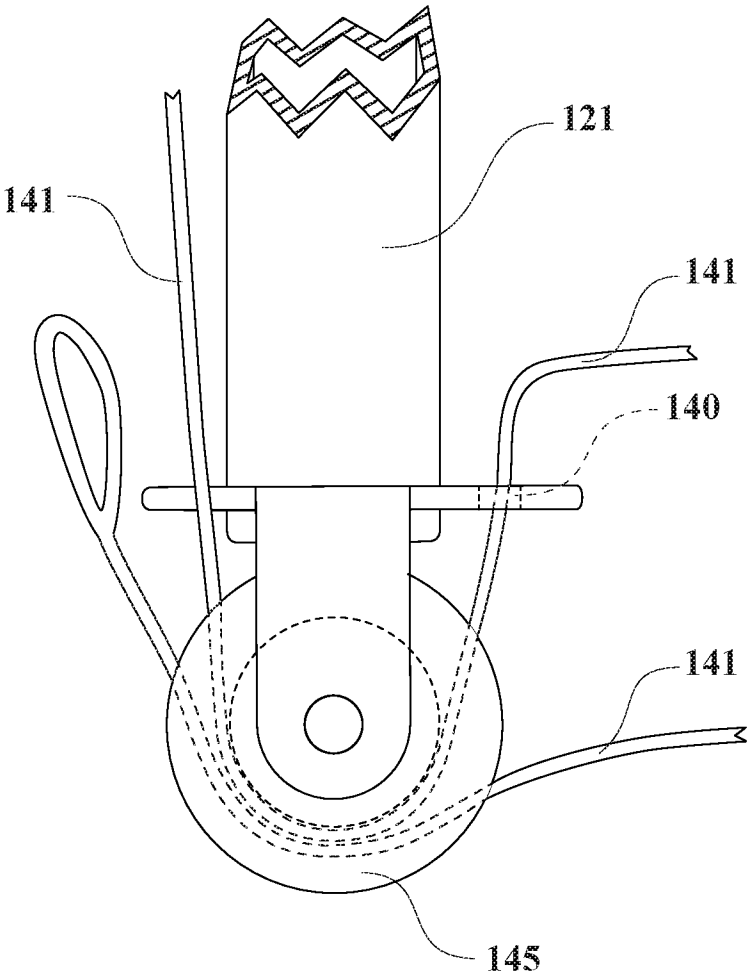
Figure 22C:
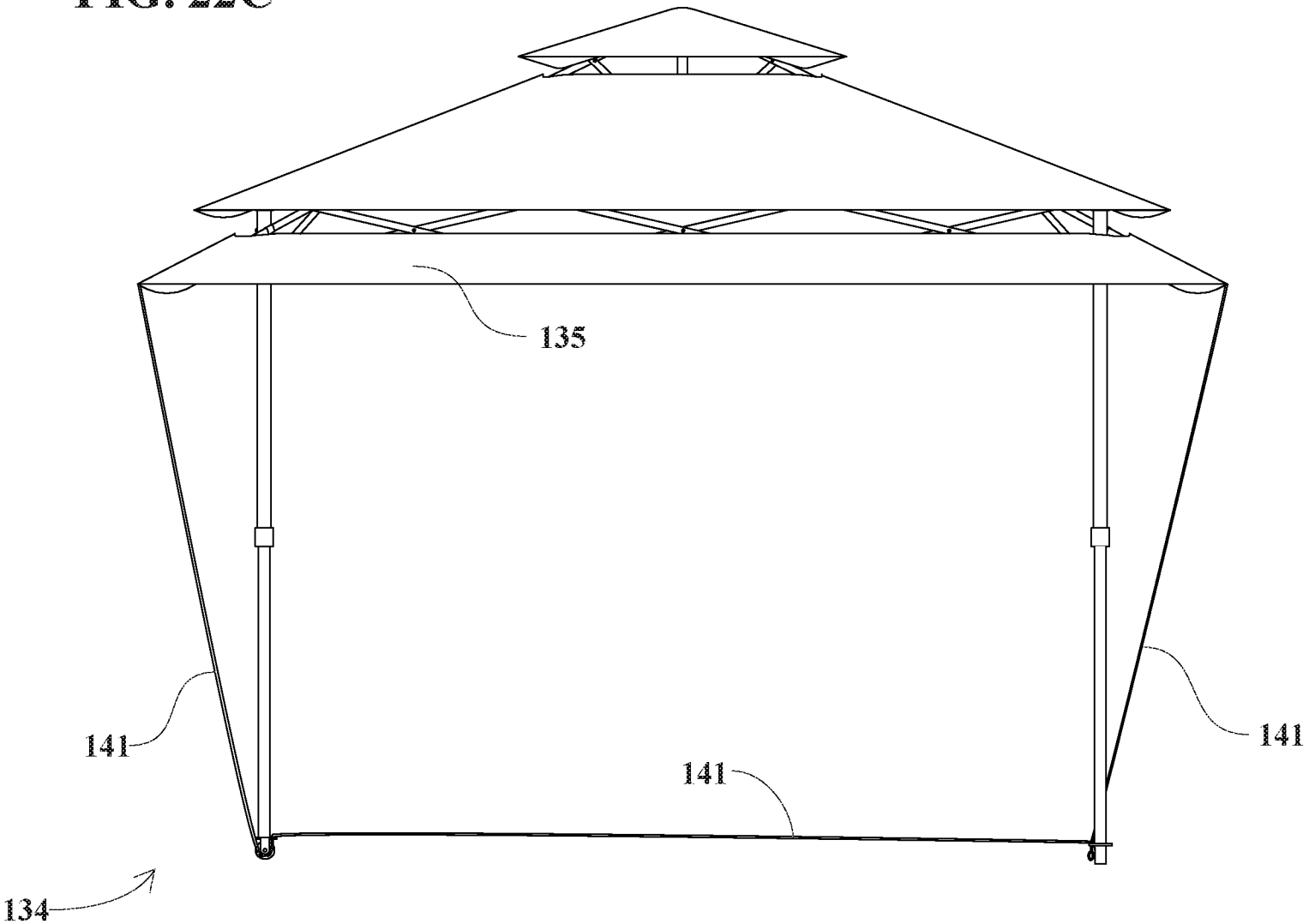
Figure 23:
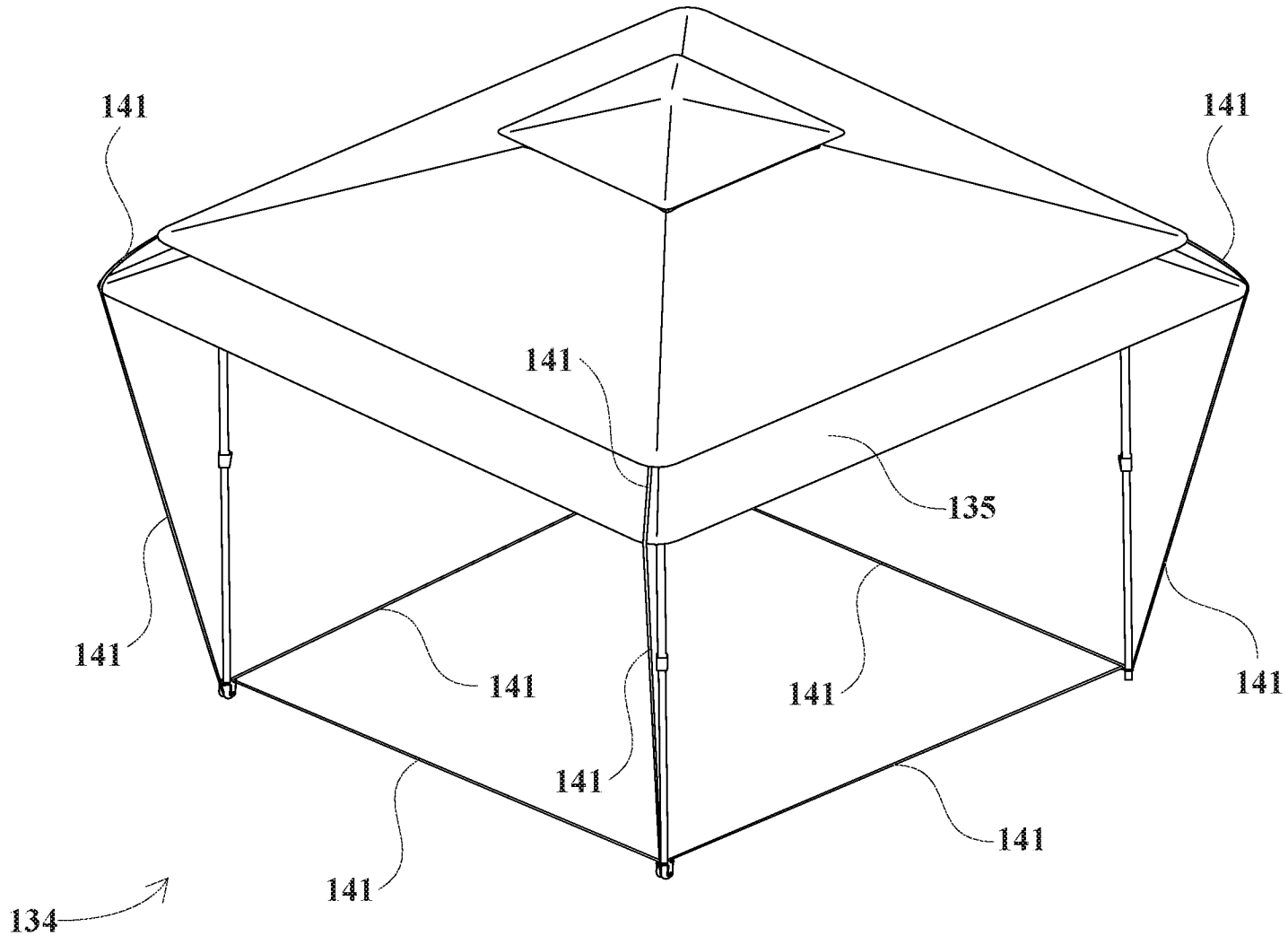
Figure 24B:
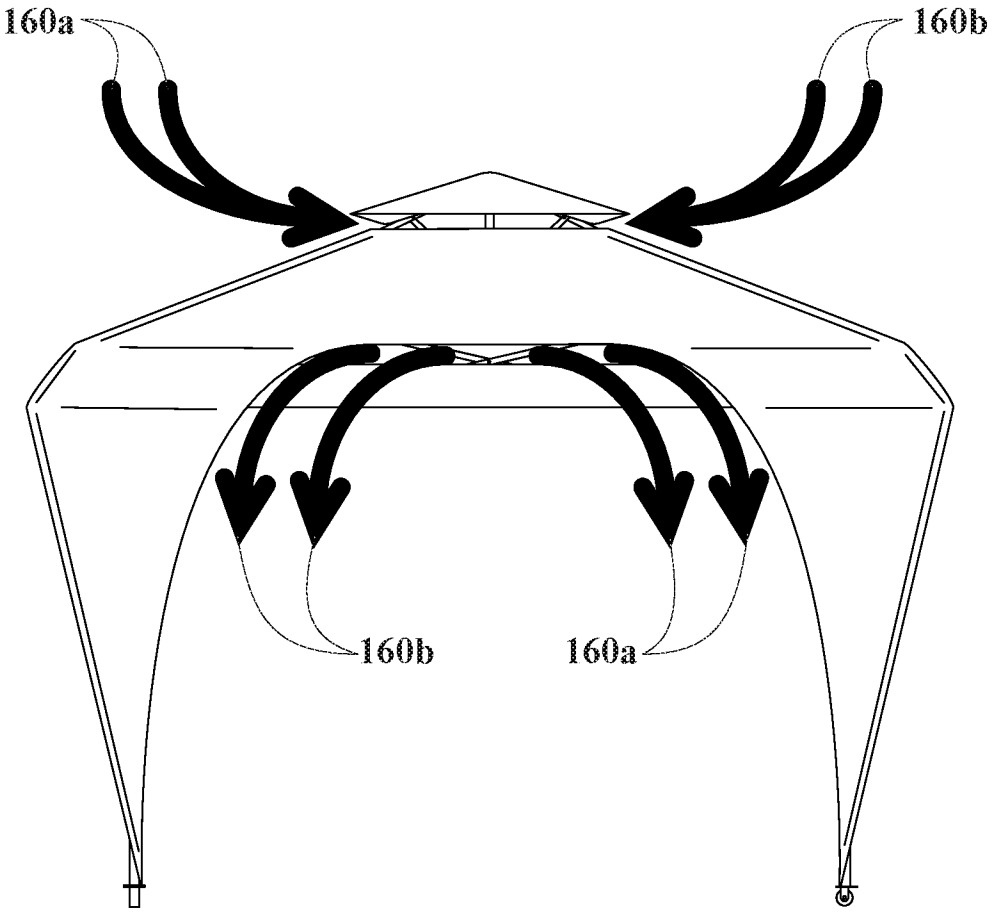
FIG. 24A, FIG. 24B, FIG. 24C, and FIG. 24D illustrate perspective and front views of equivalent variations of adjustable ring canopy 102 and adjustable surrounding awning 135.
Figure 24A:
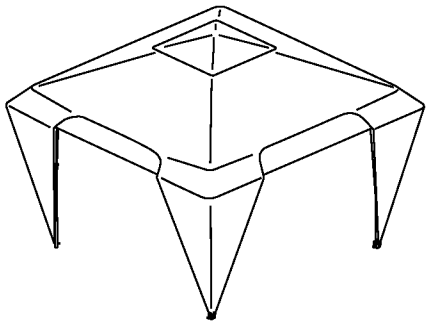
Figure 24D:
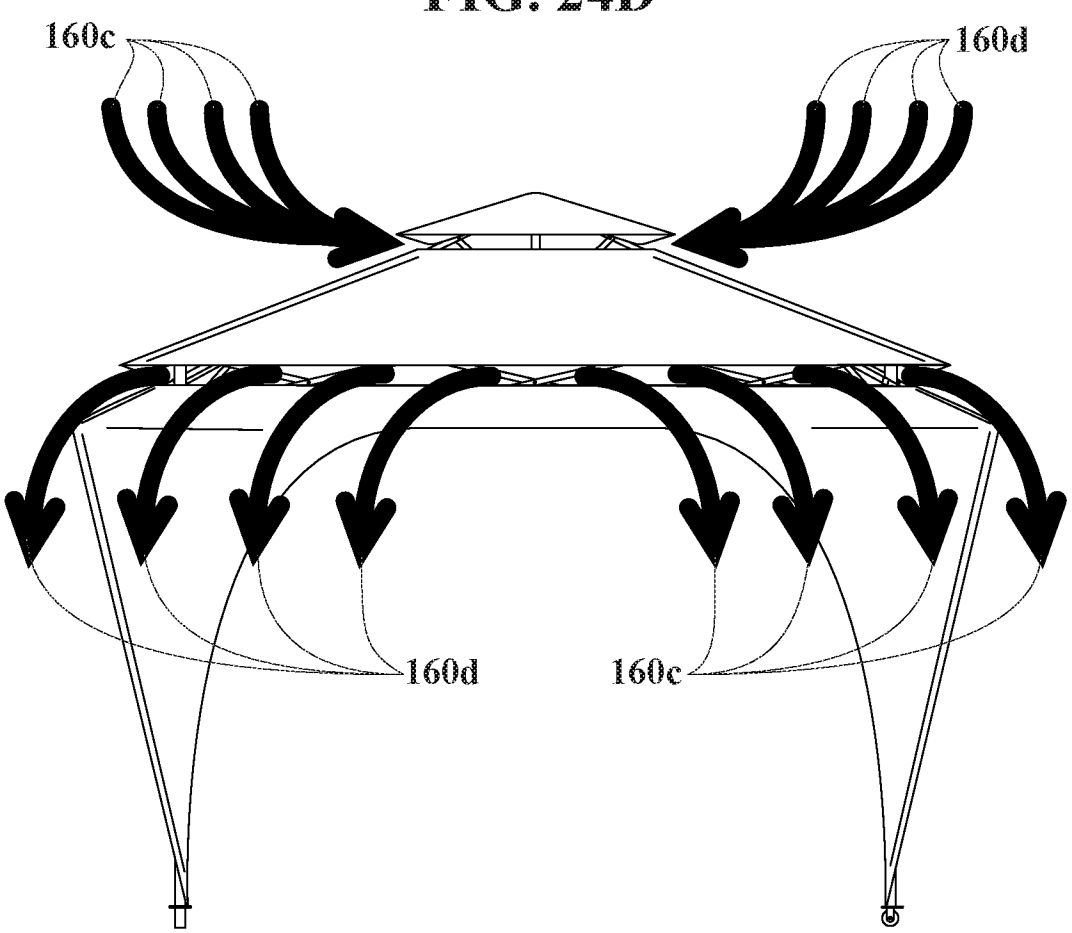
Figure 24C:
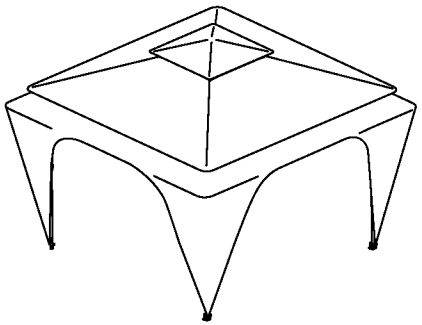

37) Rotatable awning-truss sleeves 137 respectively are for:
Slidably and pivotably attaching to four upper posts 112 to foldable adjustable awning trusses 136.
For example:
The openings between adjustable ring canopy 102, adjustable central canopy 124, and adjustable surrounding awning 135 redirect wind and smoke into and out of the inside of the adjustable-central-canopy adjustable-surround-canopy adjustable-awning single-central-innersurface-square-lock popup:
in the directions of arrows 152*a*, 152*b*, 152*c*, and 152*d* (see FIG. 20A),
in the directions of arrows 153*a*, 153*b*, 153*c*, and 153*d* (see FIG. 20B),
in the directions of arrows 154*a*, 154*b*, 154*c*, and 154*d* (see FIG. 20C),
in the directions of arrows 155*a*, 155*b*, 155*c*, and 155*d* (see FIG. 20D),
in the directions of arrows 156*a*, 156*b*, 156*c*, and 156*d* (see FIG. 20E),
in the directions of arrows 157*a*, 157*b*, 157*c*, and 157*d* (see FIG. 20F),
in the directions of arrows 158*a* and 158*b* (see FIG. 20G),
in the directions of arrows 159*a* and 159*b* (see FIG. 20H).

38) Multi-function hook-rope-stake-pulley-wheel systems 138 is for performing the combined functions of its components.

39) Hooks 139 respectively are for:
Hooking ropes 141 thereon
(see FIG. 21A, FIG. 21B, FIG. 21C, and FIG. 21D).

40) Rope-and-stake holes 140 respectively are for:
a) Threading ropes 141 therethrough
(see FIG. 21A, FIG. 21B, FIG. 21C, and FIG. 21D); and
b) Hammering stakes 142 therethrough.

41) Ropes 141 respectively are for:
a) Being hooked on at least one of hooks 139; and
b) Being hooked on at least one of four lower posts 121.

42) Stakes 142 respectively are for:
Attaching the adjustable-central-canopy adjustable-surround-canopy adjustable-awning single-central-innersurface-square-lock popup to the ground.

43) Pulley-wheel arms 143 respectively are for:
Attaching pulley-wheel axles 144 to hooks 139.

44) Pulley-wheel axles 144 respectively are for:
Attaching pulley-wheels 145 to pulley-wheel arms 143.

45) Pulley-wheels 145 respectively are for:
a) Functioning as pulley to wrap ropes 141 thereon
to reduce rope-pulling forces needed to pull on ropes 141 to stretch adjustable ring canopy 102 and/or adjustable surrounding awning 135 (see FIG. 21C, FIG. 21D, FIG. 22A and FIG. 22B);
b) Functioning as wheel
to allow the adjustable-central-canopy adjustable-surround-canopy adjustable-awning single-central-innersurface-square-lock popup to be rolled along the ground or a surface for transportation and storage (see FIG. 16B); and
c) Working together with rope-and-stake holes 140 to tie four lower posts 121 together
to prevent four lower posts 121 from spreading outwards when there is heavy snow sitting on top of the adjustable-central-canopy adjustable-surround-canopy adjustable-awning single-central-innersurface-square-lock popup, or
when there are heavy items hung on the adjustable-central-canopy adjustable-surround-canopy adjustable-awning single-central-innersurface-square-lock popup
(see FIG. 22A, FIG. 22B, FIG. 22C and FIG. 23).

Variation

Figure 25B:
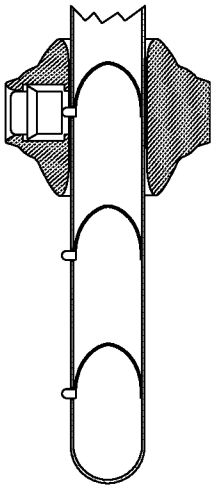
FIG. 25A and FIG. 25B illustrate cross-sectional views of equivalent variations of central-innersurface-locking double-C-shaped spring 127.
Figure 26B:
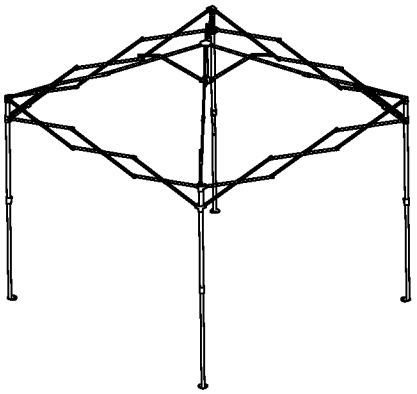
FIG. 26B illustrates a perspective view of an equivalent variation of the the adjustable-central-canopy adjustable-ring-canopy adjustable-surrounding awning single-central-innersurface-square-lock popup having no wind-and-smoke-redirecting adjustable-surrounding-awning system 134 and no pulley-wheels 145.
Figure 25A:
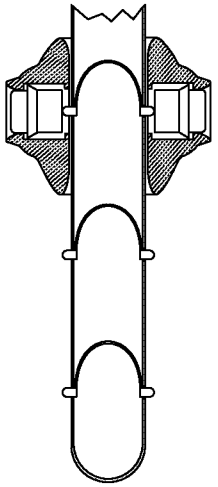
Figure 26A:
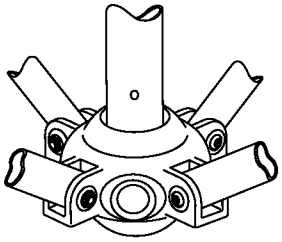
FIG. 26A illustrates a perspective view of how the central-innersurface-locking wind-and-smoke-redirecting adjustable-central-canopy system 123 is assembled with a central round post.
Figure 27A:
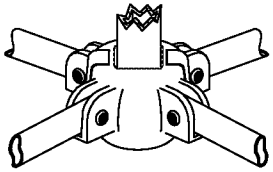
FIG. 27A, FIG. 27B, FIG. 27C, FIG. 27D, FIG. 27E, and FIG. 27F illustrate perspective, cross-sectional, and front views of equivalent variations of two buttons 132.
Figure 27B:
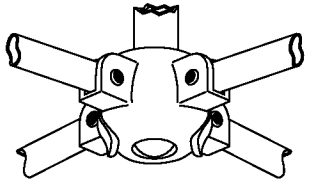
Figure 27C:
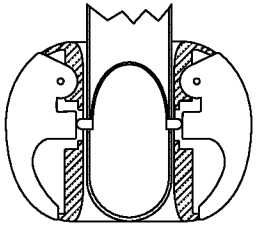
Figure 27D:
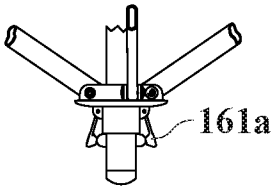
Figure 27E:
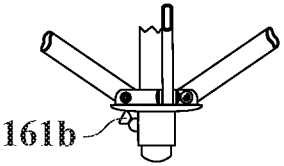
Figure 27F:
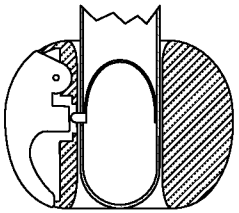
Figure 28A:
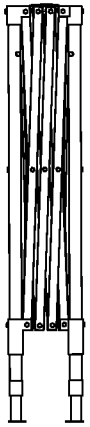
FIG. 28A, FIG. 28B, FIG. 28C, and FIG. 28D illustrate front and perspective views of equivalent variations of the adjustable-central-canopy adjustable-ring-canopy adjustable-surrounding awning single-central-innersurface-square-lock popup, hooks 139, and pulley-wheels 145.
Figure 28B:
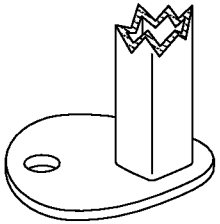
Figure 28C:
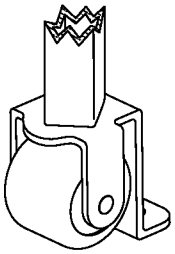
Figure 28D:
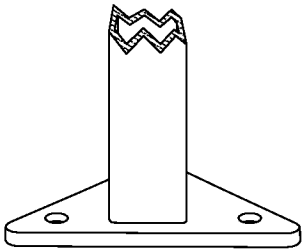

Any component of the adjustable-central-canopy adjustable-surround-canopy adjustable-awning single-central-innersurface-square-lock popup can have any shape and size. Any component of the adjustable-central-canopy adjustable-surround-canopy adjustable-awning single-central-innersurface-square-lock popup can be replaced with an equivalent component. Any component of the adjustable-central-canopy adjustable-surround-canopy adjustable-awning single-central-innersurface-square-lock popup can be made of any material(s) or any combination of any materials. Any component of the adjustable-central-canopy adjustable-surround-canopy adjustable-awning single-central-innersurface-square-lock popup can be made of any flexible, semi-flexible, bendable, semi-bendable, stretchable, semi-stretchable, rigid, or semi-rigid material(s). Any component-attaching method of the adjustable-central-canopy adjustable-surround-canopy adjustable-awning single-central-innersurface-square-lock popup can be replaced with an equivalent method. For example, FIG. 24A, FIG. 24B, 24C, and FIG. 24D illustrate perspective and front views of equivalent variations of adjustable ring canopy 102 and adjustable surrounding awning 135, which redirect wind and smoke into and out of the inside of the adjustable-central-canopy adjustable-surround-canopy adjustable-awning single-central-innersurface-square-lock popup, in the directions of arrows 160*a*, 160*b*, 160*c* and 160*d*. For example, FIG. 25A and FIG. 25B illustrate cross-sectional views of equivalent variations of central-innersurface-locking double-C-shaped spring 127. Each of the equivalent variations can be a central-innersurface-locking V-shaped spring having one or two nipples. For example, FIG. 26A illustrates a perspective view of how the central-innersurface-locking wind-and-smoke redirecting adjustable-central-canopy system 123 is assembled with a central round post. For example, FIG. 26B illustrates a perspective view of an equivalent variation of the adjustable central-canopy adjustable-surround-canopy adjustable-awning single-central-innersurface-square-lock popup having no wind-and-smoke-redirecting adjustable-surrounding-awning system 134 and no pulley-wheels 145. For example, FIG. 27A, FIG. 27B, FIG. 27C, FIG. 27D, FIG. 27E, and FIG. 27F illustrate perspective, cross-sectional, and front views of equivalent variations 161*a* and 161*b* of two buttons 132. Equivalent variations 161*a* and 161*b* each are formed into an L shape and each are pivotably attached to central-innersurface-locking adjustable ring 129 for pushing central-innersurface-locking double nipples 128 back inside central-post holes 126 to allow central-innersurface-locking adjustable ring 129 to slide up and down central square post 125. For example, FIG. 28A, FIG. 28B, FIG. 28C, and FIG. 28D illustrate front and perspective views of equivalent variations of the adjustable-central-canopy adjustable-surround-canopy adjustable-awning single-central-innersurface-square-lock popup, hooks 139, and pulley-wheels 145.

MAJOR ADVANTAGES OF THE INVENTION

The present invention substantially departs from the conventional concepts and designs of the prior art. In doing so, the present invention provides the adjustable-central-canopy adjustable-ring-canopy adjustable-surrounding awning single-central-innersurface-square-lock popup (having: a) Post-centering tick-preventing water-discharging wind-and-smoke-redirecting ring-canopy system, b) Central-innersurface-locking wind-and-smoke-redirecting central-canopy system, c) Wind-and-smoke-redirecting surrounding-awning system, and d) Multi-function hook-rope-stake-pulley-wheel system), having many unique and significant features, functions, and advantages, which overcome all the disadvantages of the prior art, as follows:

1 It is an object of the new invention to provide an adjustable-central-canopy adjustable-ring-canopy adjustable-surrounding awning single-central-innersurface-square-lock popup, having
adjustable ring canopy 102,
adjustable central canopy 124, and
adjustable surrounding awning 135.
Therefore, the adjustable-central-canopy adjustable-ring-canopy adjustable-surrounding awning single-central-innersurface-square-lock popup:
a) Can provide shade to occupants,
to prevent sunburn;
b) Can be adjusted up and down to increase airflow into and out of the adjustable-central-canopy adjustable-ring-canopy adjustable-surrounding awning single-central-innersurface-square-lock popup,
to keep occupants cool;
c) Can help with airflow out of the adjustable-central-canopy adjustable-ring-canopy adjustable-surrounding awning single-central nnersurface-square-lock popup,
to assist in smoke exiting the adjustable-central-canopy adjustable-ring-canopy adjustable-surrounding awning single-central-innersurface-square-lock popup; and
d) Can provide rain protection,
to keep occupants dry.

2) It is another object of the new invention to provide an adjustable-central-canopy adjustable-surround-canopy adjustable-awning single-central-innersurface-square-lock popup, having
central-innersurface-locking adjustable ring 129.
Therefore, the adjustable-central-canopy adjustable-ring-canopy adjustable-surrounding awning single-central-innersurface-square-lock popup:
a) Can lock central square post 125 to the rest of the canopy structure,
to increase overall strength of the adjustable-central-canopy adjustable-ring-canopy adjustable-surrounding awning single-central-innersurface-square-lock popup;
b) Can lock canopy together,
to prevent the adjustable-central-canopy adjustable-ring-canopy adjustable-surrounding awning single-central-innersurface-square-lock popup from collapsing;
c) Can decrease the total number of locking points,
to make setup easier; and
d) Can lock four post-height-adjusting nipples 120 and central square post 125 on the same plane as central-innersurface-locking adjustable ring 129 and two button tunnels 131,
to prevent four post-height-adjusting nipples 120 from twisting and bending out of two button tunnels 131 when the wind tries to twist and bend the adjustable-central-canopy adjustable-ring-canopy adjustable-surrounding awning single-central-innersurface-square-lock popup.

3) It is another object of the new invention to provide an adjustable-central-canopy adjustable-ring-canopy adjustable-surrounding awning single-central-innersurface-square-lock popup, having
pulley-wheels 145.
Therefore, the adjustable-central-canopy adjustable-ring-canopy adjustable-surrounding awning single-central-innersurface-square-lock popup:
a) Can be used as pulleys to thread ropes 141,
to tighten canopies;
b) Can be used to roll the adjustable-central-canopy adjustable-ring-canopy adjustable-surrounding awning single-central-innersurface-square-lock popup along the ground when in collapsed configuration,
to make transportation easier;
c) Can be used to assist in moving the adjustable-central-canopy adjustable-ring-canopy adjustable-surrounding awning single-central-innersurface-square-lock popup when fully erected,
to help with relocating the adjustable-central-canopy adjustable-ring-canopy adjustable-surrounding awning single-central-innersurface-square-lock popup; and
d) Can be used with ropes 141 to connect four lower posts 121 together and other popups to the adjustable-central-canopy adjustable-ring-canopy adjustable-surrounding awning single-central-innersurface-square-lock popup,
to strengthen and expand structure and to keep four lower posts 121 from bending out.

4) It is a further object of the new invention to provide an adjustable-central-canopy adjustable-ring-canopy adjustable-surrounding awning single-central-innersurface-square-lock popup, having
tick-preventing downward teeth 117.
Therefore, the adjustable-central-canopy adjustable-ring-canopy adjustable-surrounding awning single-central-innersurface-square-lock popup:
a) Can prevent ticks from getting inside four upper posts 112 and four lower posts 121,
to protect occupants from disease;
b) Can help protect from weather elements getting up inside four upper posts 112 and four lower posts 121,
to help prevent against rust and increase the lifetime of the adjustable-central-canopy adjustable-ring-canopy adjustable-surrounding awning single-central-innersurface-square-lock popup;
c) Can assist in water drainage,
to help prevent rusting; and
d) Can provide additional structure to four sleeves 115,
to increase strength of four upper posts 112 and four lower posts 121.

5) It is an even further object of the new invention to provide an adjustable-central-canopy adjustable-ring-canopy adjustable-surrounding awning single-central-innersurface-square-lock popup, having
post-centering clamps 116.
Therefore, the adjustable-central-canopy adjustable-surround-canopy adjustable-awning single-central-innersurface-square-lock popup:

a) Can center four lower posts 121 within four upper posts 112,
to help with assembly and disassembly;

b) Can help keep ticks from entering into four upper posts 112 and four lower posts 121,
to protect occupants;

c) Can provide addition strength and stability to four upper posts 112 and four lower posts 121,
to keep occupants safe and increase the adjustable-central-canopy adjustable-ring-canopy adjustable-surrounding awning single-central-innersurface-square-lock popup's lifetime; and d) Can keep four upper posts 112 and four lower posts 121 from binding
to help with adjusting the adjustable-central-canopy adjustable-ring-canopy adjustable-surrounding awning single-central-innersurface-square-lock popup up and down.

6) It is another object of the new invention to provide an adjustable-central-canopy adjustable-ring-canopy adjustable-surrounding awning single-central-innersurface-square-lock popup, having
central square post 125.

Therefore, the adjustable-central-canopy adjustable-ring-canopy adjustable-surrounding awning single-central-innersurface-square-lock popup:

a) Can provide lateral strength to the adjustable-central-canopy adjustable-ring-canopy adjustable-surrounding awning single-central-innersurface-square-lock popup,
to keep the adjustable-central-canopy adjustable-ring-canopy adjustable-surrounding awning single-central-innersurface-square-lock popup from radially twisting;

b) Can lock canopy structure together,
to prevent canopy from collapsing;

c) Can provide multiple adjustment locations,
to give options for setup; and d) Can decrease the total number of overall locking points,
to make setup easier.

7) It is yet another object of the new invention to provide an adjustable-central-canopy adjustable-ring-canopy adjustable-surrounding awning single-central-innersurface-square-lock popup, having
lead-in funnels 130.

Therefore, the adjustable-central-canopy adjustable-ring-canopy adjustable-surrounding awning single-central-innersurface-square-lock popup:

a) Can automatically guide central square post 125 into central-innersurface-locking adjustable ring 129,
to help with setup;

b) Can automatically guide central square post 125 into both top and bottom of central-innersurface-locking adjustable ring 129,
to make up and down adjustments easier;

c) Can automatically depress central-innersurface-locking double nipples 128,
to make locking central square post 125 easier; and d) Can automatically provide less friction between central-innersurface-locking adjustable ring 129 and central square post 125,
to make setup and adjustment easier.

8) It is still yet another object of the new invention to provide an adjustable-central-canopy adjustable-ring-canopy adjustable-surrounding awning singl e-central-innersurfac e-square-lock popup, having
water-discharging grooves 118.

Therefore, the adjustable-central-canopy adjustable-ring-canopy adjustable-surrounding awning singl e-central-innersurface-square-lock popup:

a) Can allow water to drain from four upper posts 112 and four lower posts 121,
to prevent four upper posts 112 and four lower posts 121 from rusting;

b) Can prevent water from getting into posts,
to help prolong the life of the adjustable-central-canopy adjustable-ring-canopy adjustable-surrounding awning single-central-innersurface-square-lock popup;

c) Can help protect against insects,
to help protect occupants; and d) Can provide addition structure to sleeves,
to increase strength of four upper posts 112 and four lower posts 121.

9) It is still yet an even further object of the new invention to provide an adjustable-central-canopy adjustable-ring-canopy adjustable-surrounding awning single-central-innersurface-square-lock popup, having
foldable adjustable awning trusses 136.

Therefore, the adjustable-central-canopy adjustable-ring-canopy adjustable-surrounding awning single-central nnersurface-square-lock popup:

a) Can provide support for surrounding awning 135,
to keep surrounding awning 135 fabric from drooping;

b) Can adjust surrounding awning 135 up,
to redirect airflow out;

c) Can adjust surrounding awning 135 down,
to redirect airflow down; and d) Can provide additional support to the adjustable-central-canopy adjustable-ring-canopy adjustable-surrounding awning single-central-innersurface-square-lock popup,
to strengthen overall structure.

10) It is still yet an even further object of the new invention to provide an adjustable-central-canopy adjustable-ring-canopy adjustable-surrounding awning single-central-innersurface-square-lock popup, having
four sleeves 115.

Therefore, the adjustable-central-canopy adjustable-surround-canopy adjustable-awning single-central nnersurface-square-lock popup:

a) Can prevent four upper posts 112 and four lower posts 121 from scratching each other
to prevent premature wear or rusting;

b) Can minimize friction between four upper posts 112 and four lower posts 121,
to make raising and lowing easier;

c) Can protect exposed joints of four upper posts 112 and four lower posts 121,
to prevent rusting and increase lifetime; and d) Can join four upper posts 112 and four lower posts 121 together
to provide additional strength and support for posts.

11) It is still yet an even further object of the new invention to provide an adjustable-central-canopy adjustable-ring-canopy adjustable-surrounding awning single-central-innersurface-square-lock popup, having
rope-and-stake holes 140.

Therefore, the adjustable-central-canopy adjustable-ring-canopy adjustable-surrounding awning singl e-central-innersurface-square-lock popup:

a) Can be used to thread ropes 141 through,
to use with either pulley wheels or hooks;

b) Can be used to drive stake 142 through into the ground,
to secure the adjustable-central-canopy adjustable-ring-canopy adjustable-surrounding awning single-central-innersurface-square-lock popup to the ground;

c) Can be used as a rope pulley,
to be used with other pulley-wheels 145 and ropes 141; and d) Can be used as a tie-off location for ropes 141,
to increase customization options for ropes 141 and pulley wheels 145.

12) It is still yet an even further object of the new invention to provide an adjustable-central-canopy adjustable-ring-canopy adjustable-surrounding awning single-central-innersurface-square-lock popup, having
hooks 139.

Therefore, the adjustable-central-canopy adjustable-ring-canopy adjustable-surrounding awning single-central-innersurface-square-lock popup:

a) Can hook canopy ropes 141 on hooks 139
to lock ropes 141 and all canopies and awning to keep them from slipping;

b) Can provide a location of rope-and-stake holes 140,
to help with staking four lower posts 121 to the ground;

c) Can be used as a foot step,
to help with setup and to drive four lower posts 121 into the ground; and d) Can hook ropes 141 on hooks 139 from four lower posts 121,
to strengthen structure and keep four lower posts 121 from bending out.

What is claimed is:

1. An adjustable-central-canopy adjustable-ring-canopy adjustable-surrounding-awning single-central-innersurface-square-lock popup comprising:

an adjustable ring canopy;
a central intersector;
foldable top trusses
respectively attached to said adjustable ring canopy and
respectively and pivotably bolted to said central intersector;
top-truss connectors
respectively and pivotably bolted to said foldable top trusses;
foldable corner trusses
respectively and pivotably bolted to said foldable top trusses;
foldable side trusses
respectively and pivotably are bolted to one another;
four upper corner intersectors
respectively and pivotably bolted to said foldable top trusses and
respectively and pivotably bolted to said foldable side trusses;
four upper posts
respectively attached to said four upper corner intersectors,
said four upper posts
each having
a bottom end;
four lower corner intersectors
respectively bolted to said foldable corner trusses,
respectively bolted to said foldable side trusses, and
respectively slid on said four upper posts;
four sleeves
respectively slid on said bottom end of said four upper posts;
post-centering clamps
respectively molded to said four sleeves;
tick-preventing downward teeth
respectively molded to said four sleeves;
water-discharging grooves
respectively molded to said four sleeves;
four post-height-adjusting spring-loaded rockers
respectively attached to said four sleeves;
four post-height-adjusting nipples
respectively molded to said four post-height-adjusting spring-loaded rockers;
four lower posts
respectively and slidably inserted inside said four upper posts;
post-height-adjusting holes
respectively formed in said four upper posts and said four lower posts;
an adjustable central canopy;
a central square post
attached to said central intersector;
central-post holes
respectively formed in said central square post;
a central-innersurface-locking double-C-shaped spring
inserted inside said central square post;
central-innersurface-locking double nipples
respectively molded to said central-innersurface-locking double-C-shaped spring;
a central-innersurface-locking adjustable ring
adjustably and slidably locked on and unlocked from said central square post,
said central-innersurface-locking adjustable ring
having
an outer surface, an inner surface, and two ends;
lead-in funnels
respectively molded to one of said two ends of said central-innersurface-locking adjustable ring;
two button tunnels
respectively molded from said outer surface to said inner surface of said central-innersurface-locking adjustable ring;
two buttons
respectively snapped into said two button tunnels;
foldable adjustable central trusses
respectively and pivotably bolted to said foldable top trusses,
respectively attached to said adjustable central canopy, and
respectively and pivotably bolted to said central-innersurface-locking adjustable ring;
an adjustable surrounding awning;
foldable adjustable awning trusses
respectively and pivotably bolted to said top-truss connectors or
respectively and pivotably bolted to said foldable top trusses, and
respectively attached to said adjustable surrounding awning;
rotatable awning-truss sleeves
respectively and pivotably attached to said four upper posts and respectively and slidably slid on said foldable adjustable awning trusses;
hooks
respectively welded or molded to said four lower posts;
rope-and-stake holes
respectively formed in said hooks; and
ropes
respectively threaded through at least one of said rope-and-stake holes and
respectively hooked on at least one of said four lower posts or said hooks,
wherein
said adjustable ring canopy
is for
redirecting wind, smoke, and light into and out of the popup,
said adjustable central canopy
is for
redirecting wind, smoke, and light into and out of the popup,
said adjustable surrounding awning
is for
redirecting wind, smoke, and light into and out of the popup,
said post-centering clamps
respectively are for
centering said four lower posts inside said four upper posts,
said tick-preventing downward teeth
respectively are for
preventing ticks from getting inside said four upper posts and said four lower posts,
said water-discharging grooves
respectively are for
allowing water to discharge out of said four upper posts and said four lower posts,
said central-innersurface-locking adjustable ring
is for
locking and unlocking said central square post and said central-innersurface-locking double nipples to and from said central-innersurface-locking adjustable ring and said foldable adjustable central trusses on the same plane,
raising and lowering said adjustable ring canopy and said adjustable central canopy and said adjustable surrounding awning
preventing the popup from radially twisting clockwise or counterclockwise, and
locking and unlocking the popup after the popup is folded or unfolded,
said central square post
is for
preventing the popup from radially twisting clockwise or counterclockwise.

2. The adjustable-central-canopy adjustable-ring-canopy adjustable-surrounding-awning single-central-nnersurface-square-lock popup of claim 1,
further comprising
pulley-wheel arms
respectively welded or molded to said hooks,
pulley-wheels, and
pulley-wheel axles,
said pulley-wheels respectively slid on said pulley-wheel axles,
said pulley-wheel axles respectively attached to and between said pulley-wheel arms,
wherein
said pulley-wheels
respectively are for
functioning as pulleys to wrap said ropes thereon,
functioning as wheel to allow the popup to be rolled along the ground, and
working together with said rope-and-stake holes to tie said four lower posts together to prevent said four lower posts from spreading outwards.

3. The adjustable-central-canopy adjustable-ring-canopy adjustable-surrounding-awning single-central-innersurface-square-lock popup of claim 1,
further comprising
four corner-intersector stoppers
respectively attached to said four upper posts above said four lower corner intersectors,
wherein
said four corner-intersector stoppers
respectively are for
preventing said four lower corner intersectors from sliding upward.

4. The adjustable-central-canopy adjustable-ring-canopy adjustable-surrounding-awning single-central-innersurface-square-lock popup of claim 1,
further comprising
stakes
respectively hammered through said rope-and-stake holes,
wherein
said stakes
respectively are for
attaching the popup to the ground.

5. The adjustable-central-canopy adjustable-ring-canopy adjustable-surrounding-awning single-central-innersurface-square-lock popup of claim 1,
wherein
said adjustable surrounding awning
is formed into a square-ring shape,
wherein
said adjustable ring canopy
is formed into a square-ring shape.

6. The adjustable-central-canopy adjustable-ring-canopy adjustable-surrounding-awning single-central-innersurface-square-lock popup of claim 1,
wherein
said two buttons
each are made of metal or plastic material.

7. The adjustable-central-canopy adjustable-ring-canopy adjustable-surrounding-awning single-central-innersurface-square-lock popup of claim 1,
wherein
said central-innersurface-locking double nipples
each are made of metal or plastic material.

8. A single-central-innersurface-square-lock popup comprising:
an adjustable ring canopy;
a central intersector;
foldable top trusses
respectively attached to said adjustable ring canopy and
respectively and pivotably bolted to said central intersector;
top-truss connectors
respectively and pivotably bolted to said foldable top trusses;
foldable corner trusses
respectively and pivotably bolted to said foldable top trusses;

foldable side trusses
respectively and pivotably are bolted to one another;
four upper corner intersectors
respectively and pivotably bolted to said foldable top trusses and
respectively and pivotably bolted to said foldable side trusses;
four upper posts
respectively attached to said four upper corner intersectors,
said four upper posts
each having
a bottom end;
four lower corner intersectors
respectively bolted to said foldable corner trusses,
respectively bolted to said foldable side trusses, and
respectively slid on said four upper posts;
four sleeves
respectively slid on said bottom end of said four upper posts;
post-centering clamps
respectively molded to said four sleeves;
four post-height-adjusting spring-loaded rockers
respectively attached to said four sleeves;
four post-height-adjusting nipples
respectively molded to said four post-height-adjusting spring-loaded rockers;
four lower posts
respectively and slidably inserted inside said four upper posts;
post-height-adjusting holes
respectively formed in said four upper posts and said four lower posts;
an adjustable central canopy;
a central square post
attached to said central intersector;
central-post holes
respectively formed in said central square post;
a central-locking spring
inserted inside said central square post;
central-locking nipples
respectively molded to said central-locking spring;
a central-locking ring
adjustably and slidably locked on and unlocked from said central square post,
said central-locking ring
having
an outer surface, an inner surface, and two ends;
two button tunnels
respectively molded from said outer surface to said inner surface of said central-locking ring;
two buttons
respectively snapped into said two button tunnels;
foldable adjustable central trusses
respectively and pivotably bolted to said foldable top trusses,
respectively and pivotably bolted to said central locking ring, and
respectively attached to said adjustable central canopy;
an adjustable surrounding awning;
foldable adjustable awning trusses
respectively and pivotably bolted to said top-truss connectors or
respectively and pivotably bolted to said foldable top trusses, and
respectively attached to said adjustable surrounding awning;
rotatable awning-truss sleeves
respectively and pivotably attached to said four upper posts and
respectively and slidably slid on said foldable adjustable awning trusses; and
hooks
respectively welded or molded to said four lower posts,
wherein
said adjustable ring canopy
is for
redirecting wind, smoke, and light into and out of the popup,
said adjustable central canopy
is for
redirecting wind, smoke, and light into and out of the popup,
said adjustable surrounding awning
is for
redirecting wind, smoke, and light into and out of the popup,
said post-centering clamps
respectively are for
centering said four lower posts inside said four upper posts,
said central-locking ring
is for
locking and unlocking said central square post and said central-locking nipples to and from said central-locking ring and said foldable adjustable central trusses on the same plane,
raising and lowering said adjustable ring canopy and said adjustable central canopy and said adjustable surrounding awning,
preventing the popup from radially twisting clockwise or counterclockwise, and
locking and unlocking the popup after the popup is folded or unfolded,
said central square post
is for
preventing the popup from radially twisting clockwise or counterclockwise.

9. The single-central-innersurface-square-lock popup of claim 8,
further comprising
pulley-wheel arms
respectively welded or molded to said hooks,
pulley-wheels, and
pulley-wheel axles,
said pulley-wheels respectively slid on said pulley-wheel axles,
said pulley-wheel axles respectively attached to and between said pulley-wheel arms,
wherein
said pulley-wheels
respectively are for
functioning as pulleys to wrap said ropes thereon,
functioning as wheel to allow the popup to be rolled along the ground, and
working together with said rope-and-stake holes to tie said four lower posts together to prevent said four lower posts from spreading outwards.

10. The single-central-innersurface-square-lock popup of claim 8,
further comprising
four corner-intersector stoppers
respectively attached to said four upper posts above said four lower corner intersectors, wherein
said four corner-intersector stoppers
respectively are for
preventing said four lower corner intersectors from sliding upward.

11. The single-central-innersurface-square-lock popup of claim 8,
further comprising:
rope-and-stake holes
respectively formed in said hooks, and
stakes
respectively hammered through said rope-and-stake holes,
wherein
said stakes
respectively are for
attaching the popup to the ground.

12. The single-central-innersurface-square-lock popup of claim 8,
wherein
said adjustable surrounding awning
is formed into a square-ring shape,
wherein
said adjustable ring canopy
is formed into a square-ring shape.

13. The single-central-innersurface-square-lock popup of claim 8,
wherein
said two buttons
each are made of metal or plastic material.

14. The single-central-innersurface-square-lock popup of claim 8,
wherein
said central-locking nipples
each are made of metal or plastic material.

15. A multiple-adjustable-canopy central-lock popup comprising:
an adjustable ring canopy;
a central intersector;
foldable top trusses
respectively attached to said adjustable ring canopy and
respectively and pivotably bolted to said central intersector;
top-truss connectors
respectively and pivotably bolted to said foldable top trusses;
foldable corner trusses
respectively and pivotably bolted to said foldable top trusses;
foldable side trusses
respectively and pivotably are bolted to one another;
four upper corner intersectors
respectively and pivotably bolted to said foldable top trusses and
respectively and pivotably bolted to said foldable side trusses;
four upper posts
respectively attached to said four upper corner intersectors,
said four upper posts
each having
a bottom end;
four lower corner intersectors
respectively bolted to said foldable corner trusses,
respectively bolted to said foldable side trusses, and
respectively slid on said four upper posts;
four sleeves
respectively slid on said bottom end of said four upper posts;
four post-height-adjusting spring-loaded rockers
respectively attached to said four sleeves;
four post-height-adjusting nipples
respectively molded to said four post-height-adjusting spring-loaded rockers;
four lower posts
respectively and slidably inserted inside said four upper posts;
post-height-adjusting holes
respectively formed in said four upper posts and said four lower posts;
an adjustable central canopy;
a central square post
attached to said central intersector;
central-post holes
respectively formed in said central square post;
a central-locking spring
inserted inside said central square post;
central-locking nipple
respectively molded to said central-locking spring;
a central-locking ring
adjustably and slidably locked on and unlocked from said central square post,
said central-locking ring
having
an outer surface, an inner surface, and two ends;
two button tunnels
respectively molded from said outer surface to said inner surface of said central-locking ring;
two buttons
respectively attached to said two button tunnels;
foldable adjustable central trusses
respectively and pivotably bolted to said foldable top trusses,
respectively and pivotably bolted to said central-locking ring, and
respectively attached to said adjustable central canopy; and
hooks
respectively welded or molded to said four lower posts.

16. The multiple-adjustable-canopy central-lock popup of claim 15,
further comprising
pulley-wheel arms
respectively welded or molded to said hooks,
pulley-wheels, and
pulley-wheel axles,
said pulley-wheels respectively slid on said pulley-wheel axles,
said pulley-wheel axles respectively attached to and between said pulley-wheel arms,
wherein
said pulley-wheels
respectively are for
functioning as pulleys to wrap said ropes thereon,
functioning as wheel to allow the popup to be rolled along the ground, and
working together with said rope-and-stake holes to tie said four lower posts together to prevent said four lower posts from spreading outwards.

17. The multiple-adjustable-canopy central-lock popup of claim 15, further comprising
four corner-intersector stoppers
respectively attached to said four upper posts above said four lower corner intersectors,
wherein
said four corner-intersector stoppers
respectively are for
preventing said four lower corner intersectors from sliding upward.

18. The multiple-adjustable-canopy central-lock popup of claim 15,
further comprising:
rope-and-stake holes
respectively formed in said hooks, and
stakes
respectively hammered through said rope-and-stake holes,
wherein
said stakes
respectively are for
attaching the popup to the ground.

19. The multiple-adjustable-canopy central-lock popup of claim 15,
wherein
said adjustable ring canopy
is formed into a square-ring shape.

20. The multiple-adjustable-canopy central-lock popup of claim 15,
wherein
said two buttons
each are made of metal or plastic material.

* * * * *